US005347352A

United States Patent [19]

Morigami et al.

[11] Patent Number: 5,347,352

[45] Date of Patent: Sep. 13, 1994

[54] COPYING APPARATUS WITH AUTOMATIC DOCUMENT FEEDING DEVICE

[75] Inventors: Yuusuk Morigami; Akira Ohhata, both of Toyohashi; Wataru Hamakawa, Okazaki; Hirokazu Matsuo, Toyonashi; Hiroyasu Nagato; Takuma Ishikawa, both of Toyokawa, all of Japan

[73] Assignee: Minolta Camera Kabushiki Kaisha, Osaka, Japan

[21] Appl. No.: 952,649

[22] Filed: Sep. 28, 1992

[30] Foreign Application Priority Data

| | | | |
|---|---|---|---|
| Sep. 30, 1991 | [JP] | Japan | 3-252420 |
| Oct. 1, 1991 | [JP] | Japan | 3-253971 |
| Oct. 1, 1991 | [JP] | Japan | 3-253972 |
| Oct. 1, 1991 | [JP] | Japan | 3-253973 |

[51] Int. Cl.[5] ..... G03G 15/00

[52] U.S. Cl. ..... 355/321; 355/308; 355/309; 355/313; 355/316; 271/3.1; 271/8.1

[58] Field of Search ..... 355/308, 309, 313, 316, 355/318–321, 23, 24; 271/3, 3.1, 8.1, 9, 264–266

[56] References Cited

U.S. PATENT DOCUMENTS

| | | | |
|---|---|---|---|
| 4,731,637 | 3/1988 | Acquaviva et al. | 355/317 |
| 4,771,319 | 9/1988 | Hamakawa | 271/265 X |
| 4,998,133 | 3/1991 | Segawa | 355/316 X |
| 5,010,371 | 4/1991 | Matsuo et al. | 355/313 |
| 5,117,266 | 6/1992 | Takemura et al. | 355/316 |
| 5,119,145 | 6/1992 | Honjo et al. | 271/265 X |
| 5,125,636 | 6/1992 | Higashio et al. | 355/311 X |
| 5,192,976 | 3/1993 | Kitajima et al. | 271/3.1 X |

FOREIGN PATENT DOCUMENTS

| | | | |
|---|---|---|---|
| 0348951 | 1/1990 | European Pat. Off. | 355/321 |
| 0410454 | 1/1991 | European Pat. Off. | 355/321 |
| 0161874 | 10/1982 | Japan | 355/321 |
| 60-140364 | 7/1985 | Japan . | |
| 1-236136 | 9/1989 | Japan . | |
| 0087851 | 4/1991 | Japan | 355/321 |
| 0100563 | 4/1991 | Japan | 355/316 |
| 0102048 | 4/1991 | Japan | 271/266 |

*Primary Examiner*—Matthew S. Smith

*Attorney, Agent, or Firm*—Burns, Doane, Swecker & Mathis

[57] ABSTRACT

Copying apparatus capable of high speed document exchange and high speed copying. Sets an original at the exposure position and prefeeds at least two originals to their respective standby positions. Pre-fed originals are detected by various sensors. Prefeeds copy paper for the respective originals based on the aforesaid detection results. Copying efficiency is improved by prefeeding originals and prefeeding copy paper.

24 Claims, 80 Drawing Sheets

COPYING APPARATUS WITH AUTOMATIC DOCUMENT FEEDING DEVICE

BACKGROUND OF THE INVENTION

1. Field of the Invention

The present invention relates to a copying apparatus for forming an image of an original document placed on a platen on the surface of a copy paper sheet, and having an automatic document feeding device for feeding original documents onto a platen.

2. Description of the Related Art

Copying apparatus have been provided in recent years with automatic document feeding devices (hereinafter referred to as "ADF") to decrease the manual labor of exchanging original documents and increase copy processing capacity. The ADF feeds original documents one sheet at a time and places the fed sheet at a predetermined position on a glass platen, then discharges the scanned original document from the glass platen.

The ADF allows high-speed copy processing by prefeeding a next original document into the original feed path immediately after feeding a prior original document (hereinafter referred to as "prefeed process").

In conventional copying apparatus, however, the paper prefeed process is only executed for the second sheet. Therefore, even when there is suitable space available to allow a prefeed process for a third sheet due to a relatively long feed path extending from the feed opening to immediately in front of the image transfer portion, a prefeed process for a third sheet cannot be implemented, thereby preventing a subsequent increase in copy speed.

Conventional ADF separately provide a motor for driving a feed means for feeding original documents from the paper tray to immediately in front of the glass platen, and a motor for driving a transport means for transporting the original document onto the glass platen. In recent years, there has been strong demand for higher speed copy processing using ADF, and the percentage of mid-grade apparatus and basic-grade apparatus incorporating ADF has increased.

It is, however, extremely difficult to reduce the cost of conventional copying apparatus which use separate motors to independently drive the paper feed means and the paper transport means.

SUMMARY OF THE INVENTION

A main object of the present invention is to provide a copying apparatus and copying method which improve copying speed.

Another object of the present invention is to provide and ADF having a simplified construction and copying apparatus which use said ADF.

To achieve the aforesaid objects, the copying apparatus of the present invention has a construction which detects three uncopied original documents in the ADF, and controls the feeding of the copy paper based on the result of said detection.

To achieve the aforesaid objects, the ADF of the present invention drives the original document feeding means and the original document transporting means by means of a single drive source.

These and other objects and the distinctive construction of the present invention will become clear from the following description.

BRIEF DESCRIPTION OF THE DRAWINGS

FIGS. 1–34 show a first embodiment of the present invention.

FIG. 1 briefly shows the construction of the copying apparatus;

FIG. 2 briefly shows the construction of the ADF;

FIG. 8 is a block diagram of the control circuit;

FIG. 9 is a flow chart showing the main routine of the CPU 1 for controlling the main unit of the copying apparatus;

FIG. 10 is a flow chart showing the ADF control subroutine;

FIG. 11 is a flow chart showing the copy paper check subroutine;

FIG. 12 is a continuation of FIG. 11 showing the copy paper check subroutine;

FIG. 13 is a flow chart showing the copy paper feed subroutine;

FIG. 14 is a flow chart is a flow chart showing the upper feeder subroutine;

FIG. 15 is a continuation of FIG. 14 showing the upper feeder subroutine;

FIG. 16 is a flow chart showing the timer check subroutine;

FIG. 17 is a flow chart showing the scan control subroutine;

FIG. 18 is a flow chart showing the timing control subroutine;

FIG. 19 is a flow chart showing the main routine of the CPU 2 for controlling the ADF;

FIG. 20 is a flow chart showing the original document detection subroutine;

FIG. 21 is a flow chart showing the one-sided original mode subroutine;

FIG. 22 is a flow chart showing the original document feed subroutine;

FIG. 23 is a continuation of FIG. 22 showing the original document feed routine;

FIG. 24 is a continuation of FIG. 23 showing the original document feed subroutine;

FIG. 25 is a flow chart showing the original document set subroutine;

FIG. 26 is a continuation of FIG. 25 showing the original document set subroutine;

FIG. 27 is a continuation of 26 showing the original document set subroutine;

FIG. 28 is a continuation of FIG. 27 showing the original document set subroutine;

FIG. 29 is a continuation of FIG. 27 showing the original document set subroutine;

FIG. 30 is a flow chart showing the original document discharge subroutine;

FIG. 31 is a flow chart showing the size detection subroutine;

FIG. 32 Is a continuation of FIG. 31 showing the size detection subroutine;

FIG. 33 is a continuation of 31 showing the size detection subroutine;

FIG. 34 is a flow chart showing the pulse correction subroutine.

FIGS. 35–74 show a second embodiment of the present invention.

FIG. 35 is a brief construction view showing a copying apparatus incorporating an ADF;

FIG. 36 is a brief construction view showing the ADF;

FIG. 37 is an illustration showing the arrangement of the original document sensor on the document tray;

FIG. 38 is a top view showing the pick-up roller, roller, registration roller, and transport belt drive mechanism;

FIGS. 39*a* and 39*b* are exploded views of the drive mechanism of FIG. 38, wherein FIG. 39*a* shows the aforesaid components during forward rotation of the main motor, and FIG. 39*b* shows the aforesaid components during reverse rotation of the main motor;

FIG. 40 is a top view showing the mechanism for stopping erroneous rotation of the belt drive shaft; only the kick spring is notched;

FIG. 45 is a block diagram showing the control circuit;

FIG. 46 is a flow chart showing the main routine of the CPU 1 for controlling the main unit of the copying apparatus;

FIG. 47 is a flow chart showing the ADF control subroutine;

FIG. 48 is a flow chart showing the copy paper check subroutine;

FIG. 49 is a continuation of FIG. 48 showing the copy paper check subroutine;

FIG. 50 is a flow chart showing the copy paper feed subroutine;

FIG. 51 is a flow chart showing the upper feeder subroutine;

FIG. 52 is a continuation of FIG. 51 showing the upper feeder subroutine;

FIG. 53 is a flow chart showing the timer check subroutine;

FIG. 54 is a flow chart showing the scan control subroutine;

FIG. 55 is a flow chart showing the timing control subroutine;

FIG. 56 is a flow chart showing the main routine of the CPU 2 for controlling the ADF;

FIG. 57 is a flow chart showing the original document detection subroutine;

FIG. 58 is a flow chart showing the original document exchange subroutine;

FIG. 59 is a flow chart showing the second original document detection subroutine;

FIG. 60 is a flow chart showing the third original document detection subroutine;

FIG. 61 is a flow chart showing the original document feed subroutine;

FIG. 62 is a continuation of FIG. 61 showing the original document feed subroutine;

FIG. 63 is a continuation of FIG. 62 showing the original document feed subroutine;

FIG. 64 is a flow chart showing the original document transport subroutine;

FIG. 65 is a continuation of FIG. 64 showing the original document transport subroutine;

FIG. 66 is a continuation of FIG. 64 showing the original document transport subroutine;

FIG. 67 is a flow chart showing the original document discharge subroutine;

FIG. 68 is a continuation of FIG. 67 showing the original document discharge subroutine;

FIG. 69 is a continuation of FIG. 68 showing the original document discharge subroutine;

FIG. 70 is a flow chart showing the SE120 interrupt subroutine;

FIG. 71 is a flow chart showing the size detection subroutine;

FIG. 72 is a continuation of FIG. 71 showing the size detection subroutine;

FIG. 73 is a continuation of FIG. 71 showing the size detection subroutine;

FIG. 74 is a flow chart showing the M110 pulse interrupt subroutine;

DESCRIPTION OF THE PREFERRED EMBODIMENTS

First Embodiment

Figure 1:
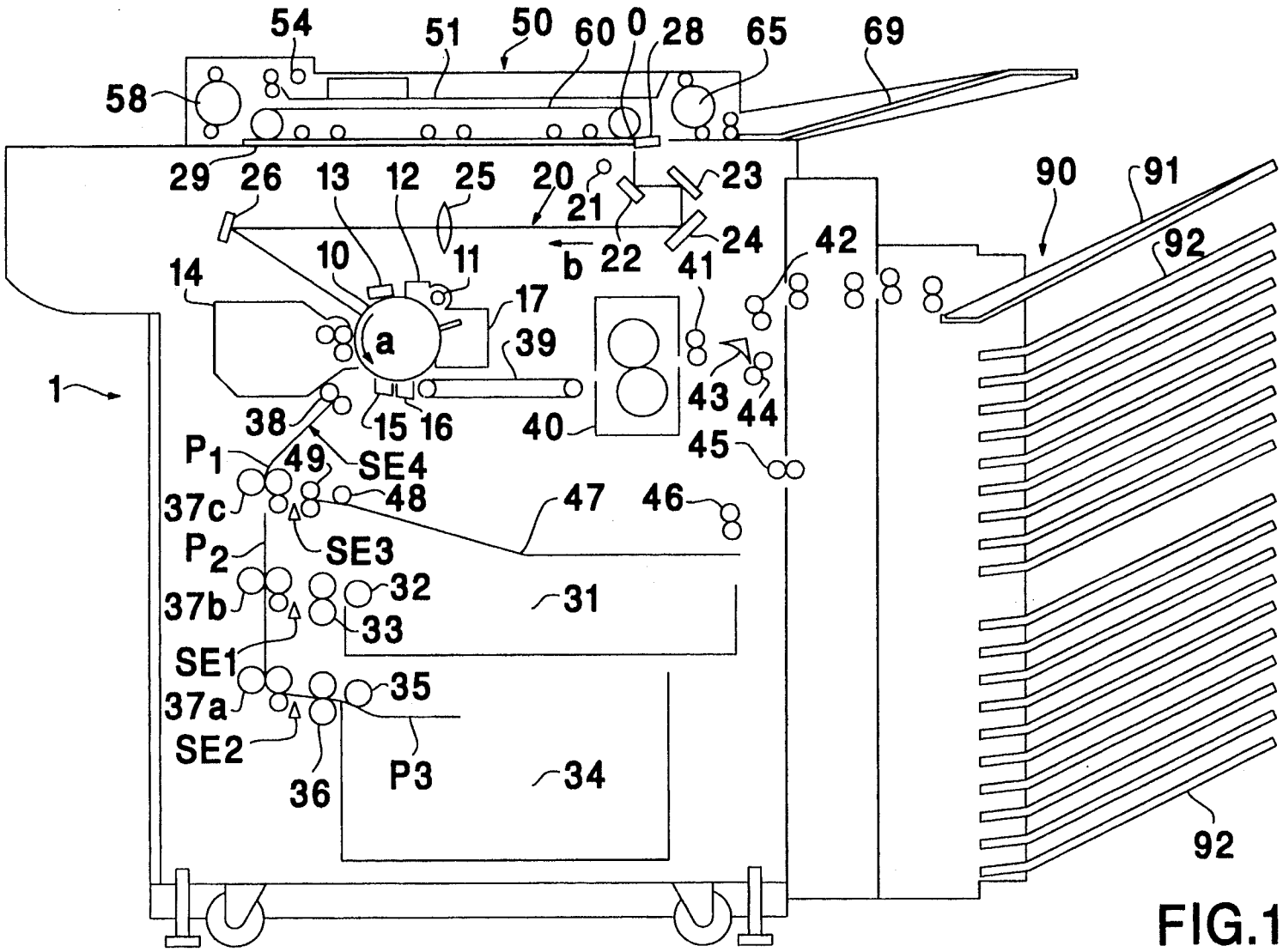

The copying apparatus shown in FIG. 1 comprises a copying apparatus main unit 1, ADF 50 mounted on top of the main unit 1, and sorter 90 provided at the right side in the drawing.

In the center of the copying apparatus main unit 1 is provided a photosensitive drum 10 which is rotatably driven in the arrow a direction at constant circumferential speed v. Arranged around the periphery of the photosensitive drum 10 in the direction of rotation are main eraser 11, charger 12, sub-eraser 13, developing device 14 of a magnetic brush type, transfer charger 15, paper separation charger 16, and cleaner 17 of a blade type. Furthermore, an optical unit 20 is provided above the photosensitive drum, 10.

The photosensitive drum 10 is of a well known type provided with a photosensitive layer provided on the surface thereof, which is discharged, charged, and discharge for image interval and image end by means of the main eraser 11, charger 12 and sub-eraser 13 in conjunction with the rotation in the arrow a direction.

The optical unit 20 is provided immediately below the platen glass 29, and scans the image of an original document placed at a predetermined position onto the surface of the photosensitive drum 10. That is, during the image scan, the exposure lamp 21 and the first mirror 22 integratedly move in the arrow b direction at a speed v/m (where m is the copy magnification) relative to the circumferential speed v (v remains constant whether equal or variable magnifications) of the photosensitive drum 10. At the same time, the second mirror 23 and the third mirror 24 move in the arrow b direction at a speed of v/2 m. Furthermore, whenever the copy magnification is changed, the projection lens 25 moves on the optical axis, and the fourth mirror 25 is oscillated to correct the length of the optical path.

The copy paper feed system mainly comprises upper feeder portion 31, lower feeder portion 34, and intermediate tray 47. The copy paper is accommodated beforehand in the upper feeder portion 31 and the lower feeder portion 34, and the copy paper is fed one sheet at a time from either said upper or lower feeder 31 or 34 in accordance with the specified operator selection. The feeder portions 31 and 34 are provided with take-up rollers 32 and 35, and handling rollers 33 and 36 comprising forward rollers and reverse rollers, respectively. The paper fed from the upper feeder portion 31 is advanced passed the transport rollers 37*b* and 37*c* to the timing roller 38 positioned immediately in front of the image transfer portion. The paper fed from the lower feeder portion 34 is advanced passed the transport rollers 37*a*, 37*b* and 37*c* to the timing roller 38.

The intermediate tray 47 for processing duplex/composite copies is provided immediately above the upper feed portion 31. Copy paper is re-fed from the intermediate tray 47 via the re-feed roller 48, and via the handling roller 49 passes the transport roller 37*c* so as to be delivered to the timing roller 38.

The copy paper which has been delivered to the timing roller 38 is held there temporarily, then is transported to the transfer portion synchronously with the image formed on the surface of the photosensitive drum 10 when the timing roller 38 is turned ON. The copy paper is adhered to the surface of the photosensitive drum 10 at the transfer portion, and the toner image is transferred from the drum 10 to the copy paper via a corona discharge from the transfer charger 15, then the copy paper is separated from the surface of the photosensitive drum 10 via an alternating current (AC) corona discharge from the separation charger 16. Thereafter, the copy paper is transported via the transport belt 39 to the fixing device 40 where the toner image is fixed onto the copy paper which then advances past the transport rollers 41 and 42 and is accommodated in the sorter 90.

On the other hand, the photosensitive drum 10 continues to rotate in the arrow a direction even after the aforesaid transfer. The residual toner remaining on the surface of the drum 10 is removed therefrom by the cleaner 17, and the residual electric charge remaining on the surface of the drum 10 is removed therefrom by the main eraser 11 so as to prepare the surface of the drum 10 for the next copy process.

In the composite copy mode, the transport direction of the copy paper sheets bearing the transferred images of the odd-numbered pages of an original document is changed to a downward direction by means of a direction switching member 43, such that said copy paper is transported past the transport rollers 44, 45 and 46 and is accommodated in the intermediate tray 47. In the duplex copy mode, the copy paper is transported to the entrance portion of the temporary sorter 90, switched back by reversely rotating the transport roller 42, whereupon the transport direction is changed to a downward direction by means of the switching means 43, such that said copy paper is transported past the transport rollers 44, 45 and 46 and is accommodated in the intermediate tray 47, as in the previous case. Thereafter, the copy paper is re-fed from the intermediate tray 47 to complete the duplex/composite copying of the images of the even-numbered pages of the original document.

Figure 8:
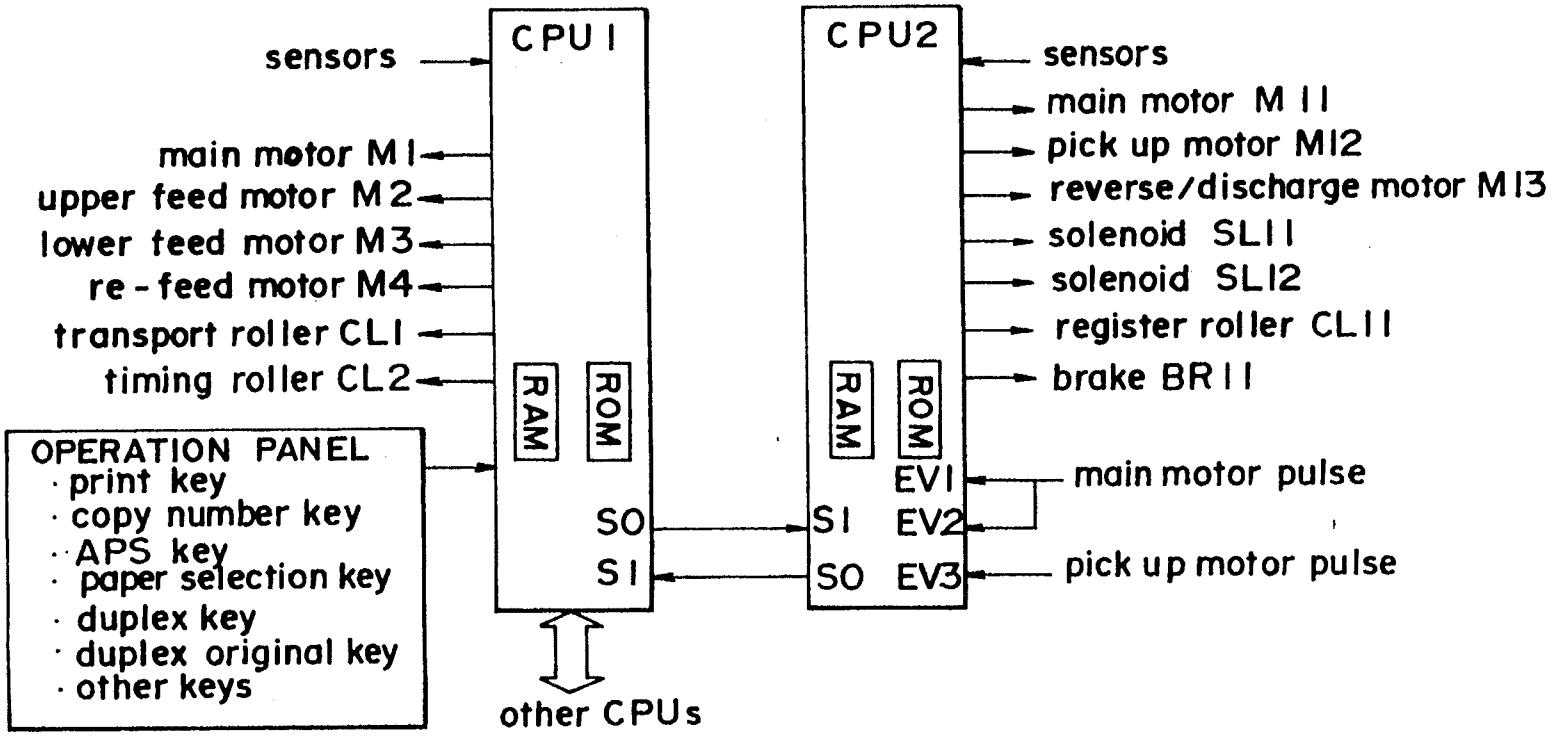

The copying apparatus main unit 1 and the ADF 50 are driven by means of individual motors actuated via clutches, as shown in FIG. 8. The drive source for the transport rollers 37*a*, 37*b* and 37*c* and the timing roller 38 is the main motor M1. The transport roller clutch CL1 selectively transmits the drive force of the main motor M1 to the transport rollers 37. Furthermore, the timing roller clutch CL2 selectively transmits the drive force of the main motor M1 to the timing roller 38.

Also provided is the feed motor M2 for driving the feed roller 32 and the handling roller 33, feed motor M3 for driving the feed roller 35 and handling roller 36, and the re-feed motor M4 for driving the re-feed roller 48 and handling roller 49.

The sensors SE1, SE2, and SE3 are provided in proximity to the respective feed openings to detect the copy paper fed therethrough. A further sensor SE4 is provided immediately in front of the timing roller 38 to detect the arriving copy paper.

The aforesaid copy paper transport system is capable of simultaneously transporting a plurality (at least two sheets) of copy paper sheets within the paper feed path extending from the feed rollers 32 and 35 to the timing roller 38. When the lower feeder portion 34 is used for copying, a first copy paper $P_1$ and thereafter a second copy paper $P_2$ are fed into the feed path, and subsequently a third copy paper $P_3$ is also fed to immediately in front of the transport roller 37*a*. When the upper feeder portion 31 is used for copying, a first copy paper $P_1$ and thereafter a second copy paper $P_2$ are advanced to immediately in front of the transport roller 37*c*. The aforesaid prefeeding process may be executed not only in the multicopy mode, but also in the single copy mode so as to improve copying speed.

On the other hand, the sorter 90 is of a well known type provided with a non-sort tray 91 and 20-stage sort tray 92. A description of the sorter 90 is, therefore, omitted herefrom.

The ADF 50 is described hereinafter with reference to FIGS. 2–7.

Figure 2:
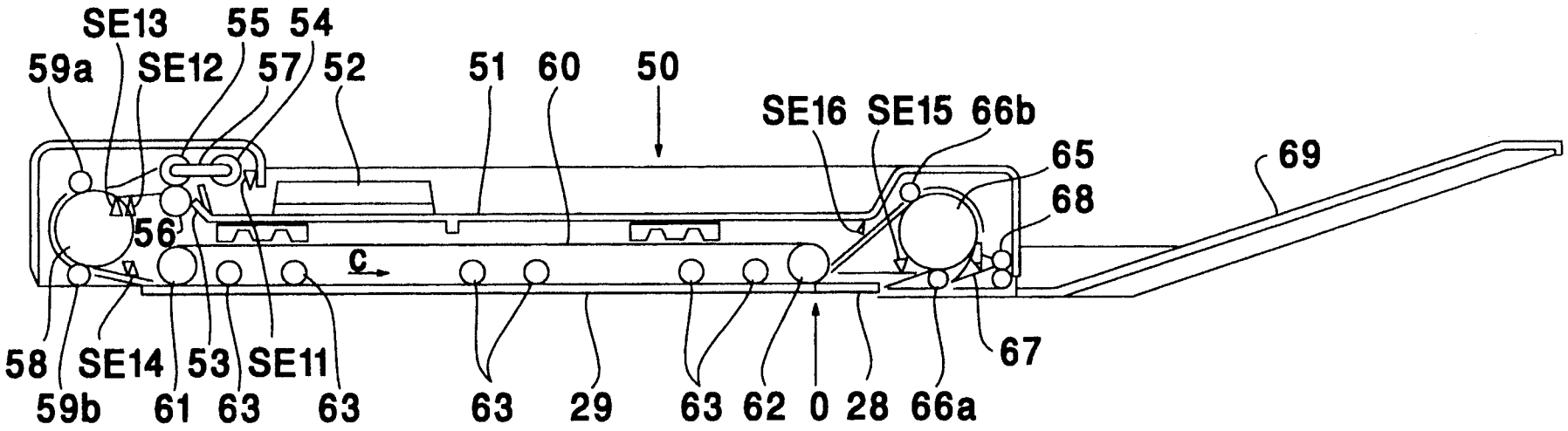

In FIG. 2, the ADF 50 briefly comprises an original document tray 51, pick-up roller 54, register roller 58, transport belt 60, reversing roller 65, and discharge tray 69. The ADF 50 is provided on the top surface of the copying apparatus main unit 1 such that the transport belt 60 is positioned above the platen glass 29, and is openable via a hinge fitting not shown in the drawing so as to expose the glass platen. The ADF 50 is raised upward whenever an operator manually places an original document on the platen glass 29. The opening/closing operation of the ADF 50 is detected by means of a magnetic sensor not shown in the drawing; the ADF 50 first becomes operable when its proper closure is detected by the aforesaid sensor.

The original document tray 51 is provided with a pair of side regulating panels 52 and a front end stopper 53. An original document is placed with the first page facing up on the tray 51. The front end stopper 53 swings downwardly during the paper feeding operation so as to be retracted from the regulating position. The pick-up roller 54 is mounted at the front end of the rotatable lever 57 supported on the shaft of the forward handling roller 55, and during the feeding operation is lowered so as to press on the top surface of the original document. The reverse handling roller 56 has a two-stage variable state so as to apply a contact force from below on the forward handling roller 550.

The register roller 58 is disposed in pressure contact with top and bottom pinch rollers 59*a* and 59*b*, respectively, and turns over the fed original document and transports said original to the entrance of the platen glass 29.

The transport belt 60 is an endless belt stretched between the drive roller 61 and the driven roller 62 so as to dover the entire surface of the platen glass 29. A plurality of back-up rollers 63 are rotatably provided on the inner side of the transport belt 60 so as to press the belt 60 against the platen glass 29. The transport belt 60 is rotatably driven in the arrow c direction, and sets the original document so that the leading edge of said original document is aligned with the standard position 0 at the boundary of the scale 28 and the platen glass 29. Descriptions of the original document feeding, transporting, stopping, and discharging processes follow hereinafter.

The platen glass 29 is of a sufficient size to allow two A4-size original documents to be placed side by side. Furthermore, the transport belt 60 is also of a sufficient size to allow simultaneous transporting of two A4-size original documents.

The inverting roller 65 is disposed in pressure contact with the pinch rollers 66*a* and 66*b*, and turns over the original document during the duplex mode copy operation.

During processing of the first surface copy process of a duplex original document, the inverting roller 65 and the switching member 67 are operated to turn over the original document. That is, the original document on the platen glass 29 is rotationally transported on the circumference of the inverting roller 65, and in the inverted state said original is returned again onto the platen glass 29. This time, the transport belt 60 is rotatably driven in the reverse direction. In the discharge mode, the switching member 67 is not operated, and the original document advances from the rollers 65 and 66*a* past the discharge roller 68 so as to be discharged onto the discharge tray 69. In the duplex mode, after the second side of the original document has been copied, the original document is inverted once to adjust the page sequence, and thereafter discharged to the discharge tray 69.

In the ADF 50, driving is accomplished by means of the various motors, solenoids and clutches shown in FIG. 8.

The pick-up roller 54, and handling rollers 55 and 56 are driven by means of the pick-up motor M12, whereas the transport belt 60 is driven by the main motor M11 capable of forward and reverse rotation, and the inverting roller 65 and discharge roller 68 are driven by the inverting/discharge motor M13. The register roller 58 is constructed so as to be driven by either the pick-up motor M12 or the main motor M11. The ON/OFF switching of the drive force for the register roller 58 is linked to the ON/OFF switching of the clutch CL11. Furthermore, an electromagnetic brake BR11 is provided on the shaft of the register roller 58 to stop unnecessary rotation of said register roller 58.

The pick-up roller 54 and the front end stopper 53 are constructed so as to be linkable to the ON/OFF switching of the solenoid SL11. That is, when the solenoid SL11 is turned ON, the pick-up roller 54 is lowered to make pressure contact with the original document, and the front end stopper 53 is retracted from the regulating position to permit retraction of the original document. Conversely, when the solenoid SL11 is turned OFF, the pick-up roller 54 is raised to eliminate the pressure contact on the original document, and the front end stopper 53 is returned to the regulating position. The front end stopper 53 is constructed so as to apply some spring force in the regulating position direction without affecting the transport of the original document during the original feeding operation.

During the handling operation, the reverse handling roller 56 makes pressure contact with the forward handling roller 55 with a pressure force required to separate a plurality of original documents, and when the handling operation is completed, the aforesaid pressure contact is reduced. Changing the pressure contact is accomplished by means of a coil spring and cam assembly not shown in the drawing. Changing the pressure contact force is linked to the ON/OFF switching of the solenoid SL12.

The aforesaid motors M11 and M12 are provided with decoders which generate rotation pulse signals to detect the number of rotations of said motors, and said pulse signals are input to the counters EV1, EV2, and EV3 of the microcomputer CPU2. These pulse signals are used to detect the length of the original document and control the stopping position of the original document.

Original document detection sensors SE11, SE12, SE13, SE14, SE15, and SE16 are provided in the ADF 50. The sensor SE11 is disposed near the pick-up roller 54 to detect the presence of an original document on the tray 51. The sensor SE12 is disposed immediately in front of the register roller 58 to detect a separated original document. The sensor SE13 is disposed at a side position comparable to the position of the sensor SE12 and has the role of detecting the size of the original document in the width direction. The sensor SE14 is disposed between the register roller 58 and the platen glass 29 as a reference for controlling the transport of the original document, i.e., to detect the length of the original document. The sensor SE15 is disposed detects an original document discharged from the platen glass 29, and the sensor SE16 detects an original document inverted by the roller 65.

The presence of a number of unexposed original documents in the feed path extending from the tray 51 to the exposure position on the platen glass 29 is detected by means of the aforesaid sensors SE11, SE12, SE14, and SE15. In the copy paper transport system, the number of copy paper sheets pre-fed into the copy paper transport path is determined based on the results of the aforesaid detection. That is, the number of pre-fed copy paper sheets is controlled in accordance with the number of pre-fed original documents. Thus, copying speed is improved, and pre-feeding unnecessary copy sheets in excess of the number of original documents is avoided.

For example, when N copies are made of a plurality of originals using the upper feeder portion 31, the plurality of originals are set in the tray 51 and the numerical value N is input via the numeric input keys, whereupon the print key is turned ON and the copying operation is started. As shown in FIG. 4*c*, a first original is set at the exposure position, a second original is set at the preparing position on the platen glass 29, and a third original is pre-fed to the register roller 58; in this state the copy operation is started. In the aforesaid described state, the presence of the three unprocessed original documents in the ADF is detected by the previously mentioned sensors. In the feed portion, N sheets of copy paper are fed corresponding to the first original. Then, the $(N+1)^{th}$ copy paper sheet, i.e., the first sheet of copy paper corresponding to the second original, is pre-fed during the time after the presence of the second original has been detected and while the N copy paper is waiting at the timing roller 38. Thus, interruption of the copying process is prevented between the copy operation corresponding to the first original and the copy operation corresponding to the second original. Furthermore, the $(2N+1)^{th}$ copy paper, i.e., the first sheet copy paper corresponding to the third original, is pre-fed during the time after the presence of the third original has been detected and while the $2N^{th}$ copy paper is waiting at the timing roller Thus, interruption of the copying process is prevented between the copy operation corresponding to the second original and the copy operation corresponding to the third original. The above-described method is particularly effective when the original documents are exchanged frequently, i.e., when $N=1$.

The original document feeding and transporting process of the ADF 50 are described hereinafter.

Original documents are placed on the tray 51 with the first page facing upward, both sides of the originals are regulated by the side regulating panels 52, and the leading end of the original is regulated by the stopper 53. The originals are detected by the sensor SE11, and the copy process (original document feeding operation) enters the enabled state. When the print key is turned ON by an operator, the solenoid SL11 is switched ON, the pick-up roller 54 is lowered onto the original document D, and the stopper 53 is retracted (refer to FIG. 3*a*). At this time, the solenoid SL12 is switched ON, and the reverse handling roller 56 applies pressure on the forward handling roller 55.

After a fixed time, the pick-up motor M12 is turned ON, and the first sheet of the original $D_1$ is separated and fed from between the rollers 55 and 56 by rotatably driving the rollers 54, 55 and 56, such that the leading end of said original abuts the nip portion of the register roller 58 and the pinch roller 59*a*. When the leading end of the original $D_1$ is detected by the sensor SE12, the electromagnetic brake BR11 is turned ON and the register roller 58 is locked. The aforesaid arrangement prevents the register roller 58 from being driven rotatingly through contact with the abutting leading end of the original $D_1$.

When the leading end of the original $D_1$ forms somewhat of a loop immediately in front of the register roller 58 (refer to FIG. 3*b*) following a fixed time after the leading end of said original is detected by the aforesaid sensor SE12, the electromagnetic brake BR11 is turned OFF, and the clutch CL11 is turned ON. At the same time, the solenoids SL11 and SL12 are turned OFF, the pick-up roller 54 is raised, the stopper 53 is returned to the regulating position, and the reverse handling roller 56 pressure force is reduced. When the leading end of the original $D_1$, transported by the register roller 58, is detected by the sensor SE14, the pick-up motor M12 and the clutch CL11 are turned OFF, and the electromagnetic brake BR11 is turned ON. Thus, the rotation of the register roller 58 is forcibly stopped, and the transport of the original $D_1$ is stopped at that position. The aforesaid process up to the detection point of the original document by the sensor SE14 is termed the "prefeed process."

After the prefeed process for the original $D_1$, the main motor M11 is turned ON, and the clutch CL11 is turned ON. Thus, the register roller 58 and the transport belt 60 are rotatably driven, and the original $D_1$ is fed onto the platen glass 29. Pulse signals generated from the main motor M11 are input to the CPU2, and the length of said original $D_1$ is detected via the number of said pulses generated until the detection of the trailing end of the original $D_1$ by the sensor SE14. The detection point of the sensor SE13 is such that the width of the original $D_1$ is detected via its passage thereby. The size of the original $D_1$ is therefore determined by combining both the aforesaid detection results.

Figure 3A:
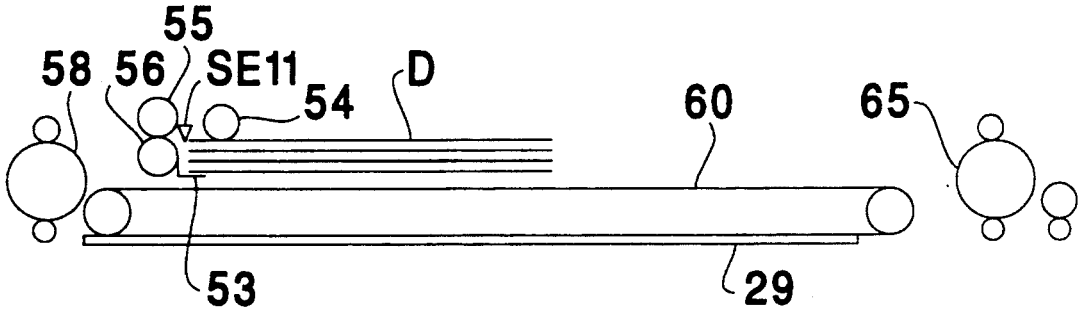
FIGS. 3*a*–3*f* are illustrations showing the step feed mode operation of the ADF.
Figure 3B:
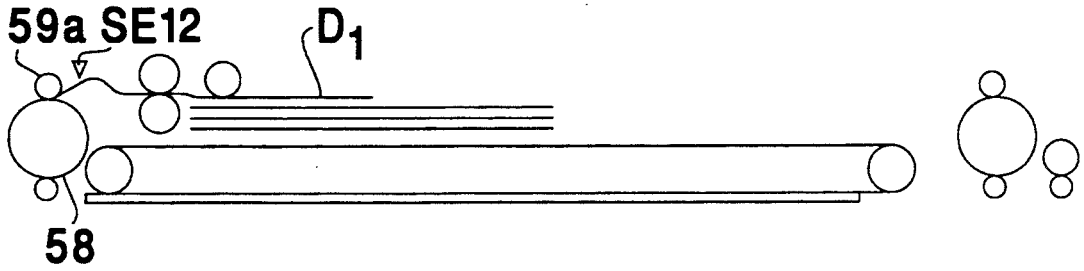
Figure 3C:
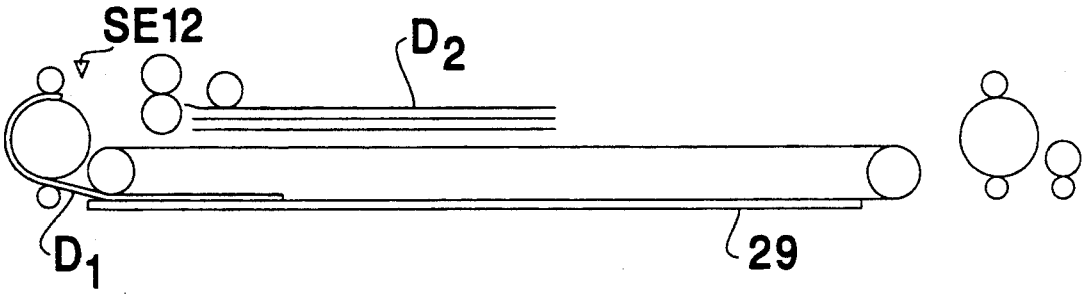
Figure 3D:
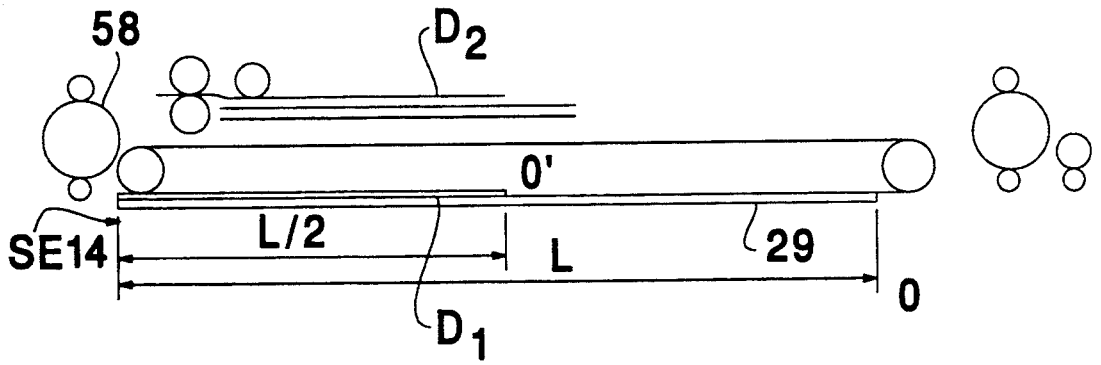
Figure 3E:
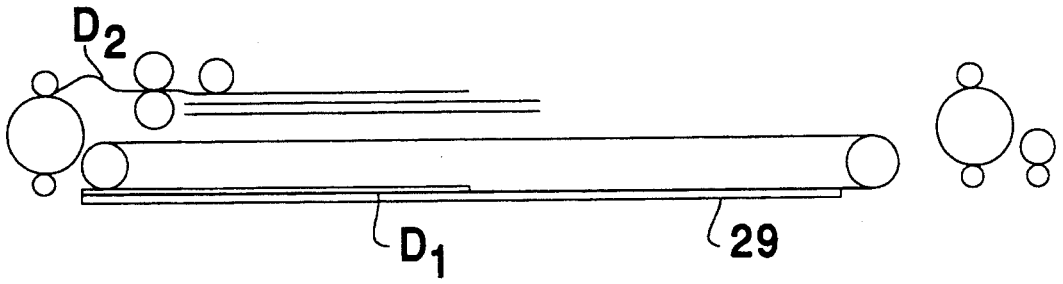
Figure 3F:
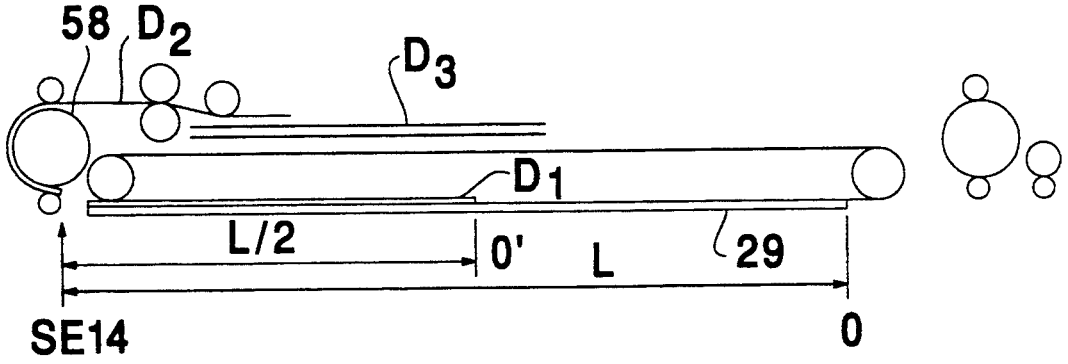

When the detected length based on the rotation pulse signals of the main motor M11 is shorter than the than L/2 relative to the distance L from the detection point of the sensor SE14 to the original standard position 0, the main motor M11 is stopped with the original $D_1$ at the position 0', and remains on temporary standby until the prefeed process of the second original $D_2$ is completed (refer to FIG. 3*d*).

When the trailing end of the original $D_1$ is detected by the sensor SE12, the feed process for feeding the second original $D_2$ from the tray 51 is executed. This feed process is identical to that for the aforesaid first original $D_1$. When the leading end of the original $D_2$ is detected by the sensor SE14, the aforesaid prefeeding process is completed (refer to FIGS. 3*c*–3*f*).

Figure 4A:
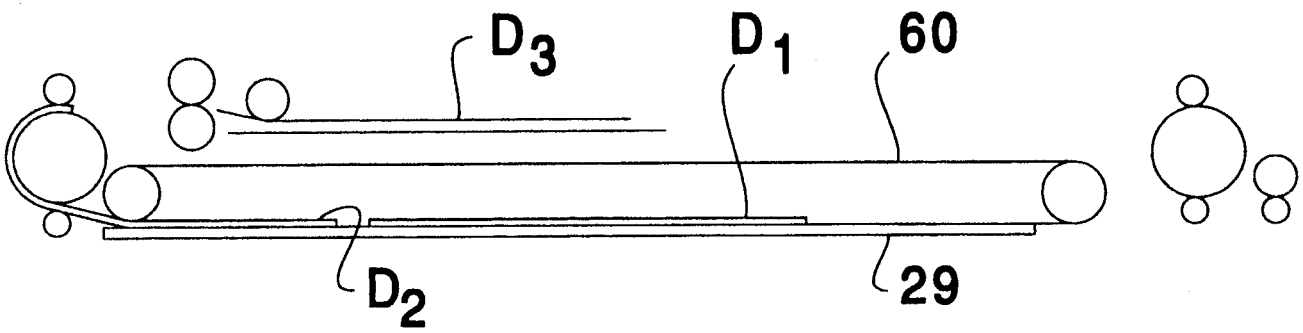
FIGS. 4*a*–4*d* are continuations of FIGS. 3*a*–3*f* showing the step feed mode operation of the ADF.
Figure 4B:
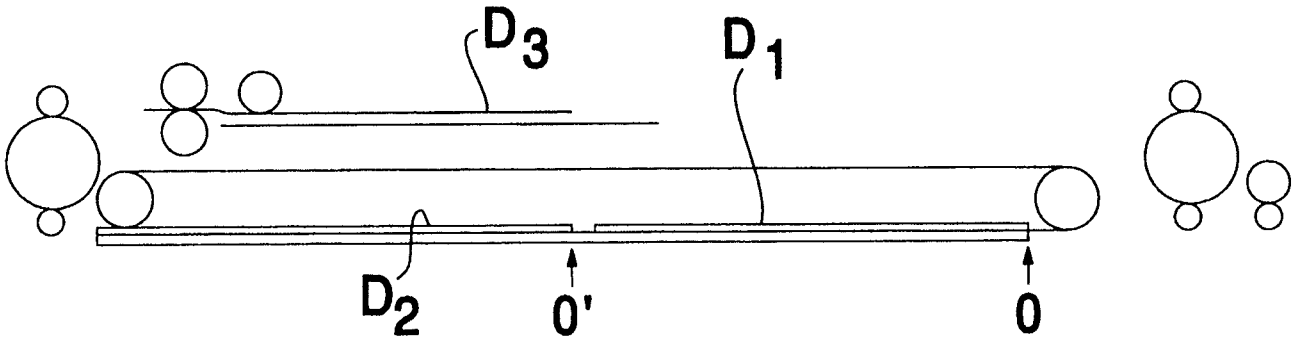
Figure 4C:
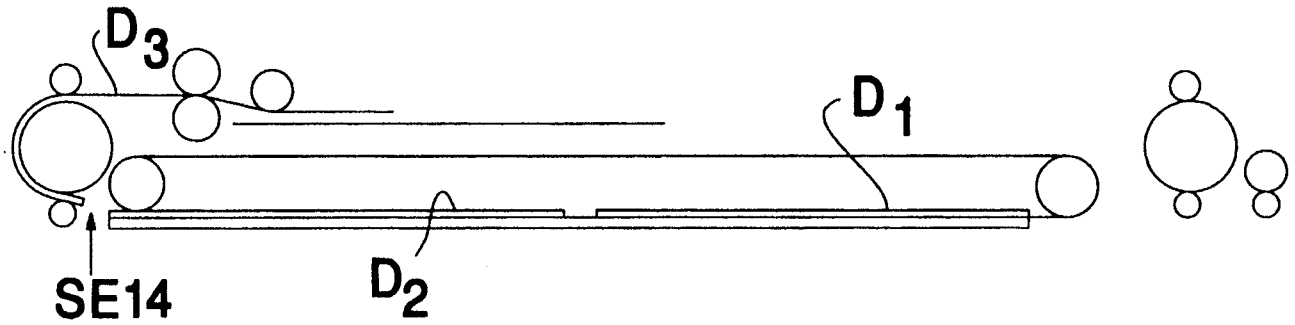
Figure 4D:
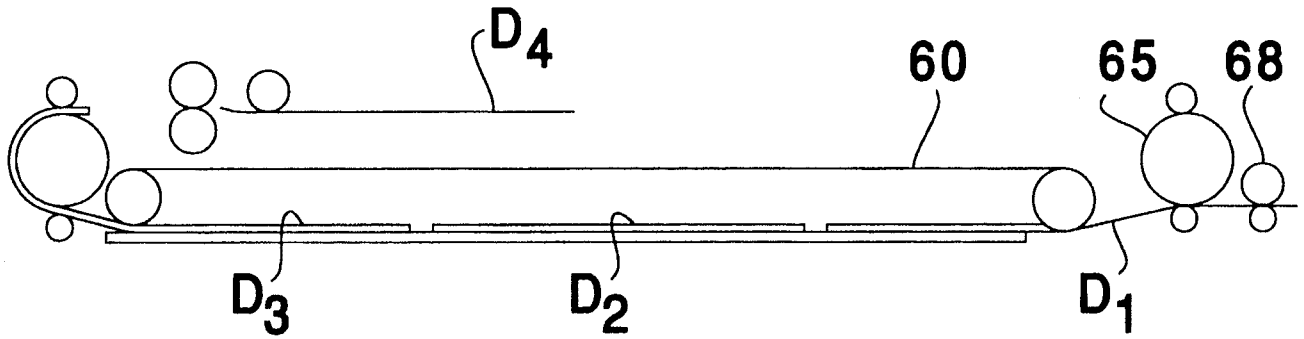

When the prefeed process for the original $D_2$ is completed, the main motor M11 and the clutch CL11 are turned ON, and transports the original $D_1$ to the standard position 0 and the original $D_2$ to the center position 0' via the transport belt 60 and register roller 58 (refer to FIGS. 4*a*, 4*b*).

The counter $C_1$, which is set with a predetermined pulse number J, is actuated from the transport start timing to the platen glass 29 for the first original $D_1$. The length is determined based on the detection of the original $D_1$ by the sensor SE14, so that when the original $D_1$ is temporarily stopped at the center position 0', the remaining pulse number in the counter $C_1$ is about J/2. At this time, the prefeed process for the second original $D_2$ is completed, and the counter $C_2$, which is set with the same predetermined pulse number J, is actuated for the original $D_2$. After the prefeed process of the original $D_2$ is completed, the transport of the original $D_1$ from the center position 0' is resumed, and when the remaining pulse number of the counter $C_1$ reached 0, the main motor M11 is turned OFF and stopped at that position. At this time, the original $D_2$ is stopped at the approximate center position 0', and the remaining pulse number of the counter $C_2$ is about J/2. The pulse number J set in the counters $C_1$ and $C_2$ starts to decrement from the start of the transport of originals $D_1$ and $D_2$ toward the platen glass 29 (when the main motor M11 is OFF), and are set so that the leading ends of the originals $D_1$ and $D_2$ arrive at the standard position 0 when the counters reach 0.

When the original $D_1$ arrives at the standard position 0, the optical unit 20 starts the image scan of the original $D_1$. The prefeed process of the third original $D_3$ from the tray 51 starts when the trailing end of the second original $D_2$ is detected by the sensor SE12, and this prefeed process ends before the completion of the image scan of the first original $D_1$ (refer to FIGS. 4*a*, 4*b*, 4*c*).

The previously mentioned counter $C_1$ is reset at the moment the original $D_1$ arrives at the standard position 0, and is used to control the transport of the third original $D_3$. Thereafter, when the original document length is determined to be L/2 or less based on the detection of the sensor SE14, is previously described operation is repeated. The counter $C_1$ is used for the odd-numbered originals and the counter $C_2$ is used for the even-numbered originals.

The original document feeding process described above is termed the "step feed mode." The step feed mode is executed during the single-side copy mode for single-sided original document having an image on only one side of the sheet.

In the step feed mode, when the first original $D_1$ has been set at the exposure position on the platen glass 29, the second original $D_2$ is simultaneously fed to the standby position on the platen glass 29 (FIG. 4*b*), but only the first original $D_1$ is subjected to exposure. After the exposure of the first original $D_1$ has been completed, the first original $D_1$ is discharged from the exposure position via the actuation of the transport belt 60, and at the same time the second original $D_2$ is fed and set at the exposure position, and the third original $D_3$ is advanced to the standby position. Thus, the speed of exchanging the original documents is markedly improved.

At the end of the prefeed process, the position of the leading end of the original document is somewhat misaligned, i.e., when the original is fed by the register roller 58 and the leading end of the original is detected by the sensor SE14, the electromagnetic brake BR11 is turned ON to stop the rotation of the register roller 58. At this time, the stopping position of the leading end of the original is not regularized due to variations produced by the mechanical imprecision of the electromagnetic brake BR11, and differences in the thickness of originals, external environmental factors and the like. In the present embodiment, after the leading end of the original is detected by the sensor SE14, the distance travelled by the original document until the pick-up motor M12 stops completely is calculated by the number of pulse signals generated by the pick-up motor M12, and the original document transport control is corrected by decrementing said calculated value from the standard pulse number J.

On the other hand, when the original document length is longer than L/2, the original $D_1$ is fed to the standard position 0 without being temporarily stopped at the center position 0' (refer to FIGS. 6*a*–6*d*). The feeding of the second original $D_2$ is accomplished in the same manner as in the previously described step feed mode, that is, when the trailing end of the first original $D_1$ is detected by the sensor SE14, the prefeed process of the original $D_2$ is started, and the said prefeed process ends before the scanning of the original $D_1$ is completed (refer to FIGS. 6*c*, 6*d*). This type of original document transport process is termed the normal mode. In the normal mode, only the counter C1 is used to control the feeding of the original documents. Furthermore, the normal mode is executed even during the duplex mode wherein a duplex original document having images on both sides of the sheet is inverted by the inverting roller 65 and returned to the platen glass 29. The single-side mode and the duplex mode are both operator selectable.

Then, the original $D_1$ set at the standard position 0 is discharged from the platen glass 29 after the scan ends when the main motor M11 is turned ON. The inverting-/discharge motor M13 is turned On a fixed time after the main motor M11 is turned ON, so as to rotate the inverting roller 65 and the discharge roller 68. Thus, the original $D_1$ is discharged to the tray 69, and the subsequent originals $D_2$ and $D_3$ are simultaneously fed onto the platen glass 29 (refer to FIG. 4*d*). The inverting/discharge motor M13 is switched to low speed rotation when the trailing end of the original is detected by the sensor SE15. The aforesaid arrangement prevents the originals from flying up on the tray 69,and is particularly effective with thin paper sheets.

Figure 5A:
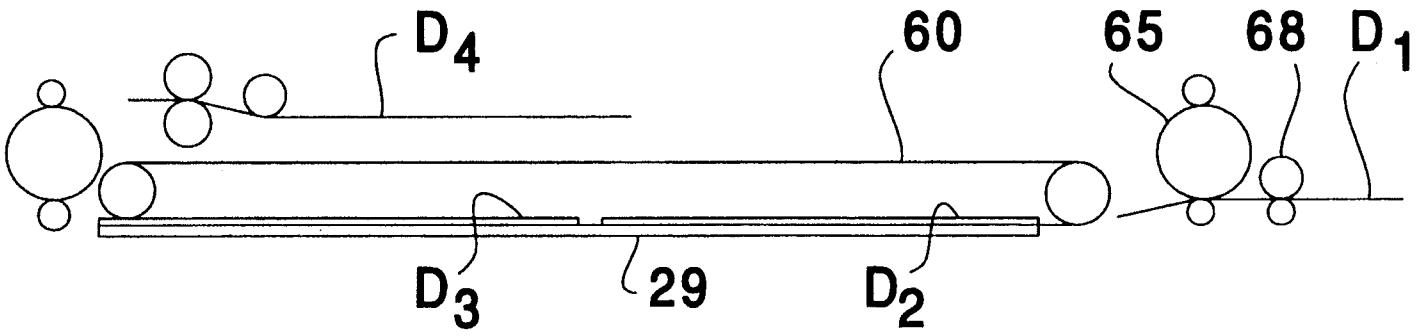
FIGS. 5*a*–5*d* are continuations of FIGS. 4*a*–4*d* showing the step feed mode operation of the ADF.
Figure 5B:
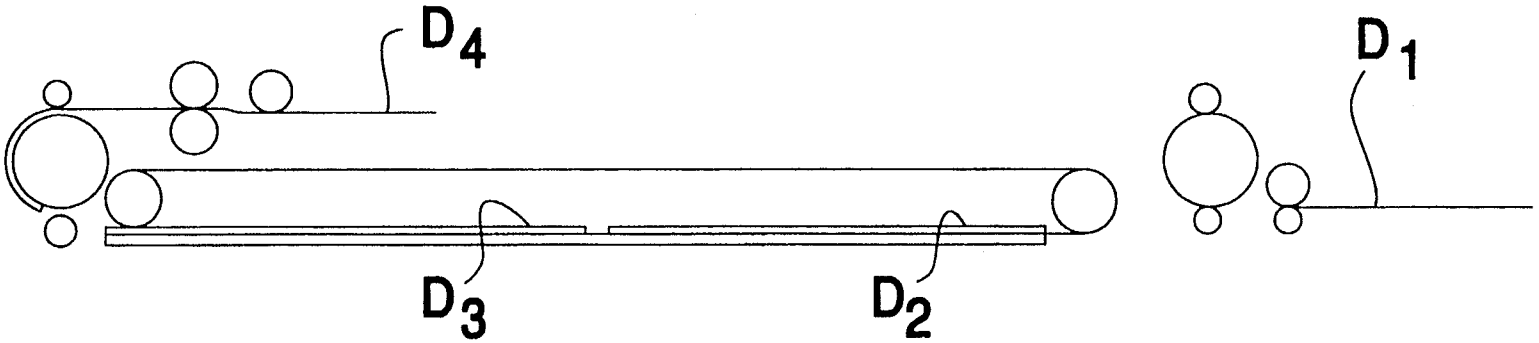
Figure 5C:
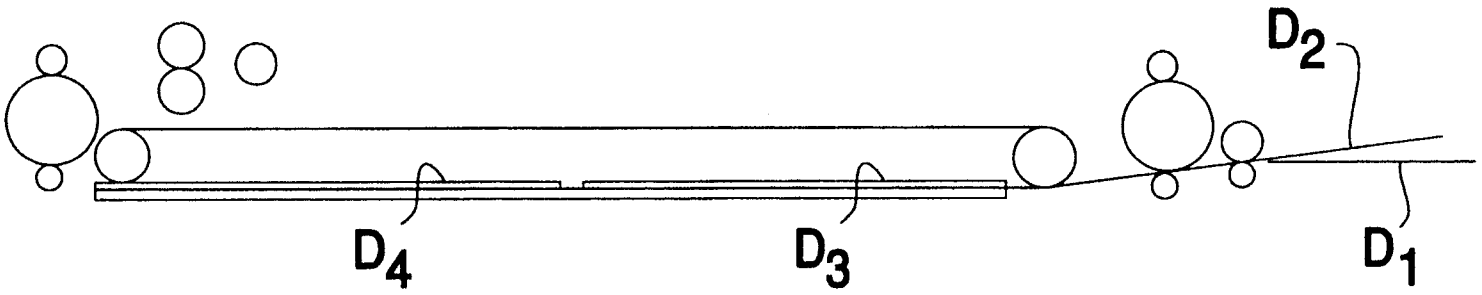
Figure 5D:
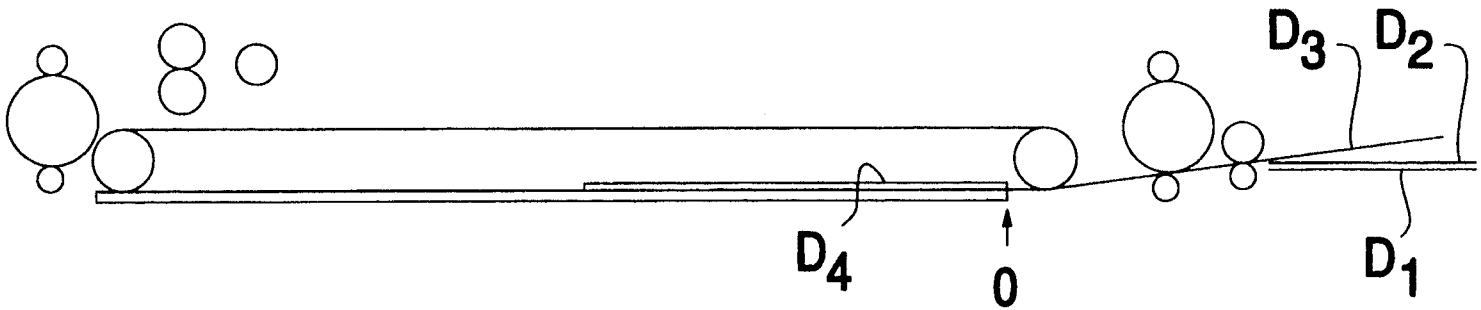
Figure 6A:
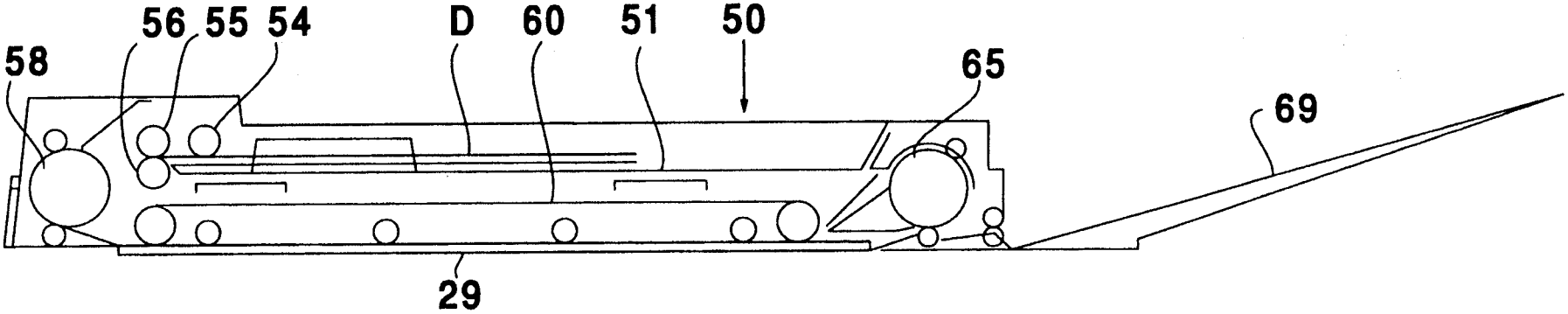
FIGS. 6*a*–6*d* are illustrations showing the normal feed mode operation of the ADF.
Figure 6B:
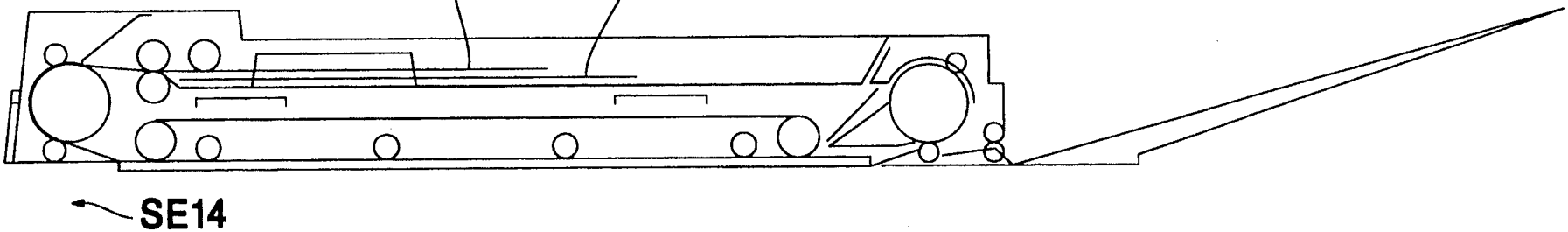
Figure 6C:
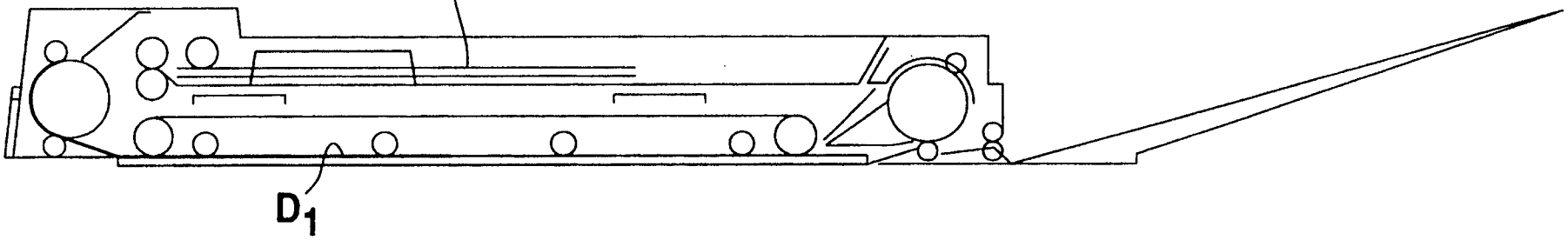
Figure 6D:
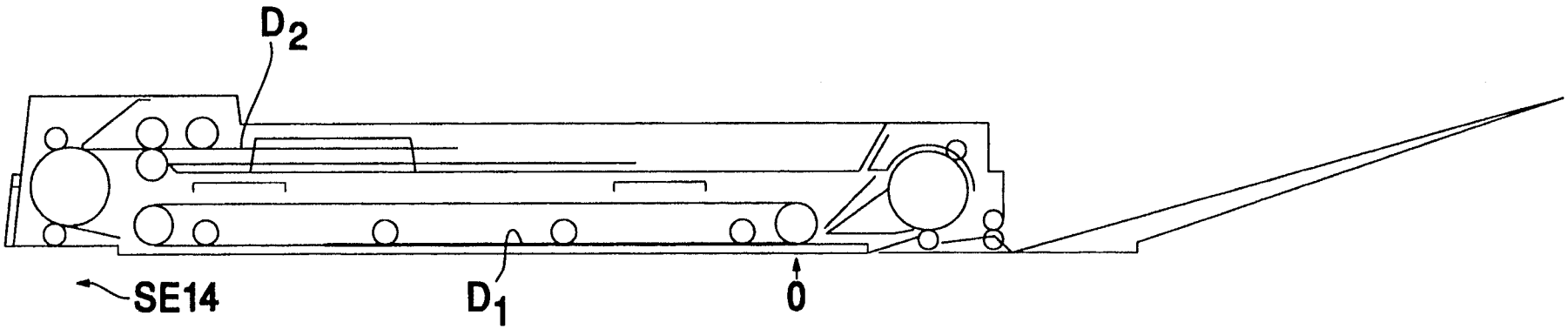

The second original $D_2$ is image scanned while the first original $D_1$ is passing the inverting roller 65 (refer to FIG. 5*a*). FIG. 5*b* shows the moment the discharge of the original $D_1$ is completed; FIG. 5*c* shows the scanning time of the third original; FIG. 5*d* shows the scanning time of the fourth original.

Figure 7A:
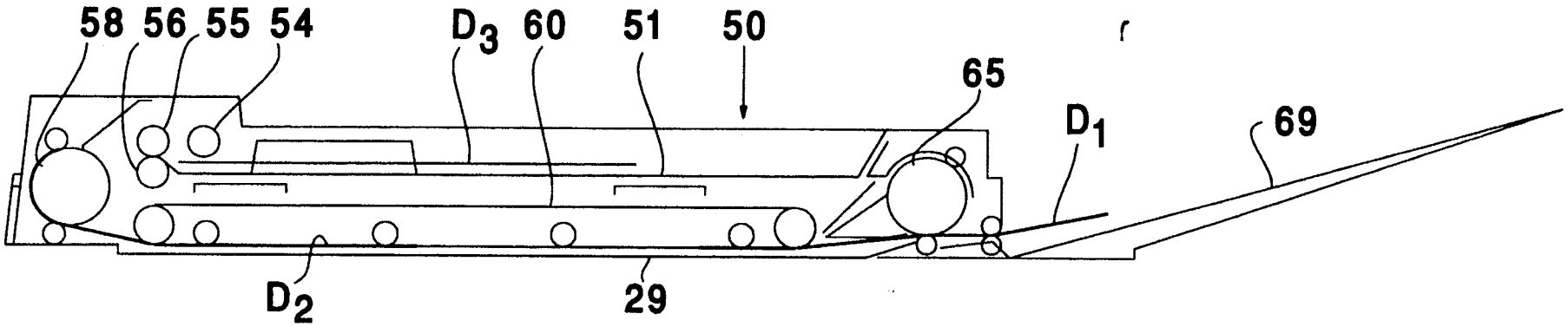
FIGS. 7*a*–7*d* are continuations of FIGS. 6*a*–6*d* showing the normal feed mode operation of the ADF.
Figure 7B:
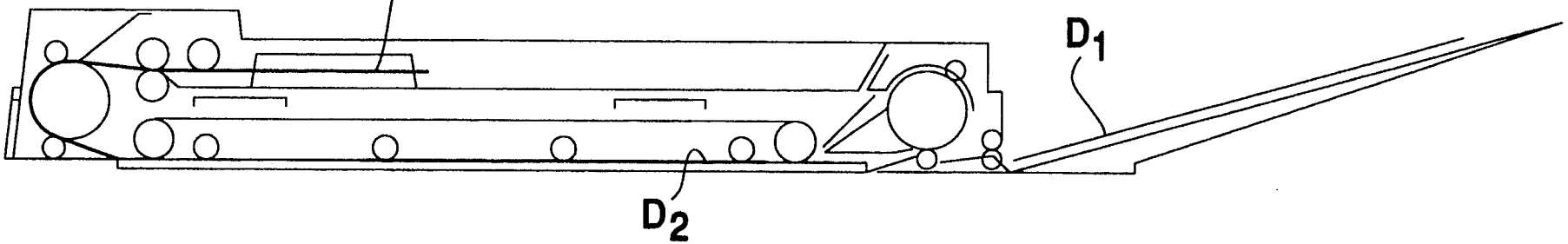
Figure 7C:
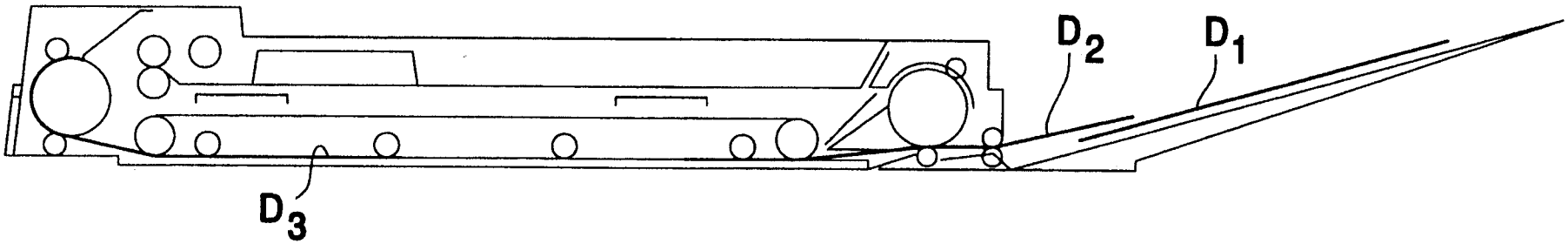
Figure 7D:
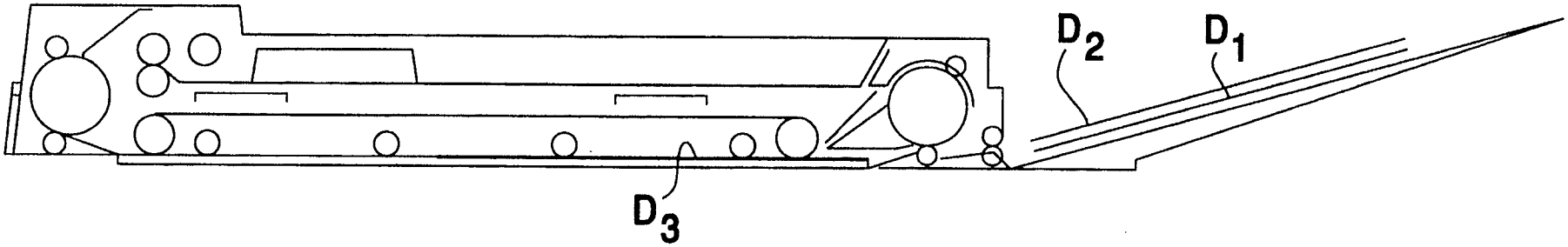

On the other hand, the discharge of the original document in the normal mode is shown in FIG. 7*a*. FIG. 7*b* shows the scanning time of the second original $D_2$; FIG. 7*c* shows the discharge time of the original $D_2$; FIG. 7*d* shows the scanning time of the third original $D_3$.

The control sequence of the aforesaid copying apparatus is described hereinafter.

Control is accomplished using the CPU1 to control the copying apparatus main unit 1, CPU2 for controlling the ADF 50, a CPU (not illustrated) for controlling the optical unit 20, and a CPU (not illustrated) for controlling the sorter 90. The CPU1 processes the communications with the various CPUs with the necessary timing.

In the controls hereinafter described, "ON edge" describes the various switches, sensors, signals and the like switching from the OFF state to the ON state, and "OFF edge" describes the various switches, sensors, signals and the like switching from the ON state to the OFF state. Furthermore, the sensors used for the previously described sheet detection are turned ON when detecting said sheets.

Figure 9:
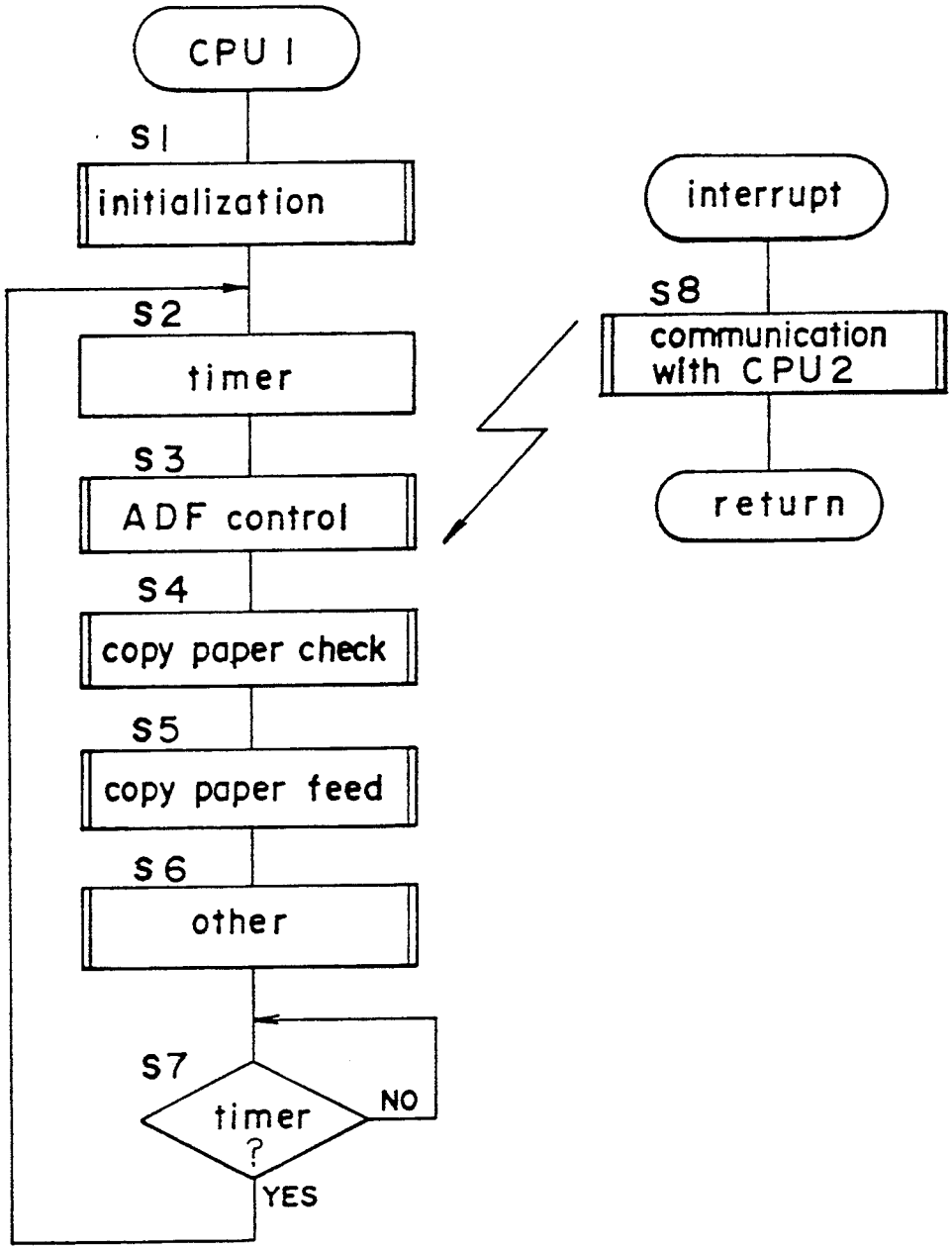

FIG. 9 shows the main routine of the CPU1.

When the power source is turned ON, the CPU1 is reset and the program starts, and in step S1 initialization is executed to clear the random access memory (RAM), reset the various registers, and set the initial modes for the various types of components. An internal timer determines the time required for one routine of the main routine, and the value set in said timer is set in step S1. Furthermore, the aforesaid internal timer sets the counting standard for the various timers described in the various subroutines hereinafter.

Next, the various subroutines in steps S3 through S6 are sequentially called, the required processes are executed, and in step S7 the end of the internal timer is awaited, whereupon the routine returns to step S2. Step S3 is the subroutine for instructing the exchange of the original documents in the ADF 50, step S4 is the subroutine checking the copy paper, and step S5 is the subroutine for feeding the copy paper from the selected feed opening. The aforesaid subroutines are described later. Step S6 executes various other processes, e.g., the input/display process for the control panel, copy paper feed opening and magnification setting processes, and charging, exposure, transfer, and fixing processes and the like.

The CPU1 is connected to the CPU2 via a serial communication line, said communication being executed in step S8 in the interrupt process.

Figure 10:
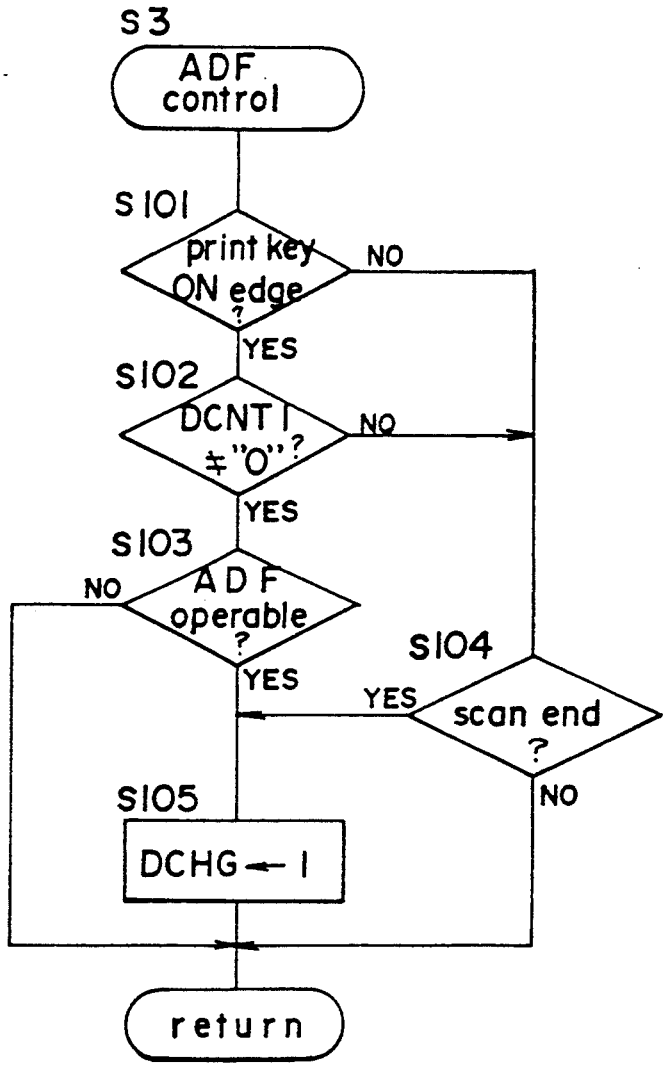

FIG. 10 shows the subroutine for controlling the ADF 50 in step S3.

In this subroutine, when the operator turns ON the print key on the operation panel, or when a set number "N" (number of copies set by the operator) corresponding to the originals set on the platen glass 29 have been scanned, the DCHG flag is set at 1 to exchange the original document in the ADF 50.

That is, in step S101 a check is made to determine whether or not the print key is ON edge, and if said print key is ON edge, the counter DCNT1 is checked in step S102. The DCNT1 is set by the CPU2; when set at 0, the indication is that no unprocessed original remain, when set at 1, the indication is that a single pre-fed and unprocessed original remains, and when set at 2, the indication is that two pre-fed and unprocessed originals remain. If the counter DCNT1 is set at a value other than 0, i.e., if an unprocessed original is present, a check is made in step S103 to determine whether or not the ADF 50 is operational. The ADF 50 is deemed inoperable when not completely closed on the platen glass 29, or when a paper jam of a fed original document occurs. Accordingly, when operational, the DCHG flag is set at 1 in step S105. When the DCHG flag is set at 1, the ADF 50 is instructed to exchange the originals.

If the reply to the query in either step S101 or step S102 is NO, a check is made in step S104 to determine whether or not the scanning of the set number of originals has been completed. If the reply to the query is YES, the DCHG flag is reset at 1 in step S105.

Figure 11:
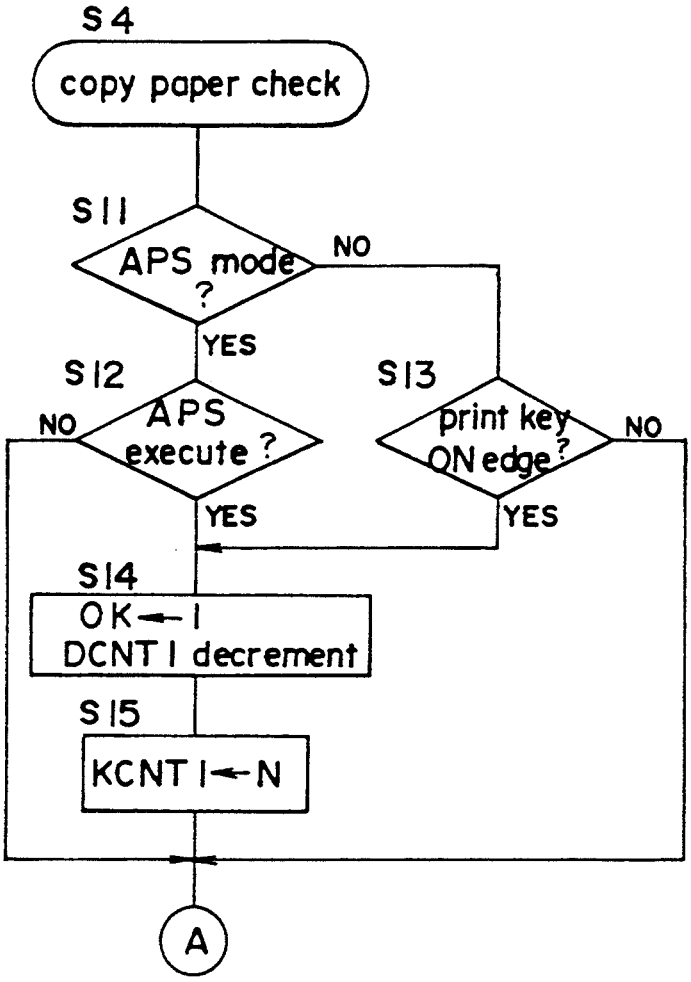
Figure 12:
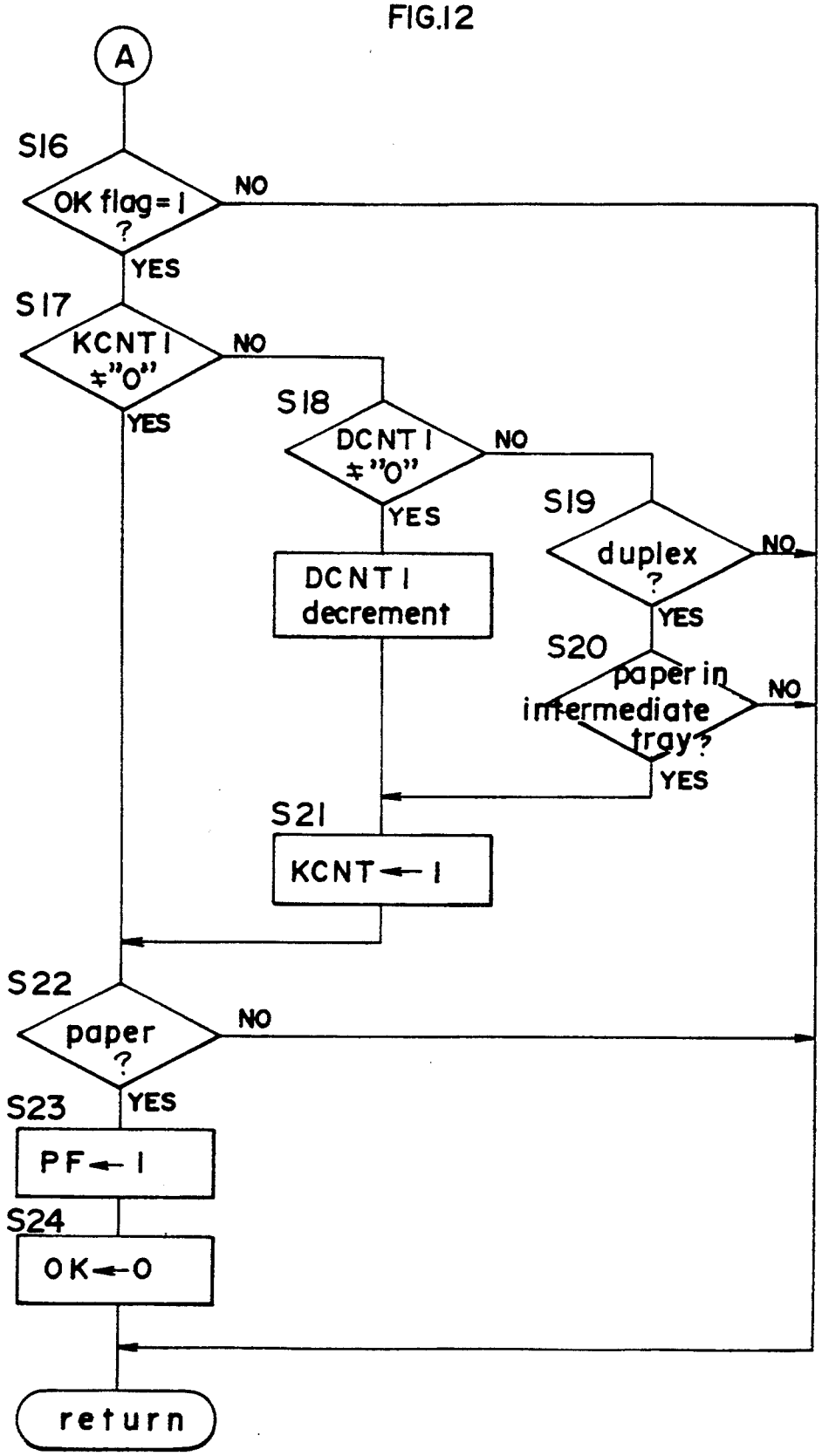

FIGS. 11 and 12 show the copy paper check subroutine executed in step S4.

In step S4, a check is made to determine whether or not a copy paper sheet is to be fed, and if so, the copy paper feed flag is set at 1.

First, in step S11, a check is made to determine whether or not the APS mode has been selected. The APS mode is the mode for automatically selecting and feeding suitable size copy paper based on the size of the original document and the copy magnification. If the APS mode is selected, a predetermined APS operation is executed. When end of the APS operation is confirmed in step S12, the OK flag is set at 1 and the DCNT1 flag is decremented in step S14, then the counter KCNT1 is set at the set number "N" in step S15. When the OK flag is set at 1, it indicates that copy paper feed is enabled. Further, the KCNT1 indicates the number of sheets of copy paper still to be fed for a single sheet of the original document.

Then, a check is made in step S16 to determine whether or not the OK flag is set at 1. If the OK flag is set at 1, the counter KCNT1 is checked in step S17. If the counter KCNT1 is not set at 0, the presence of copy paper in the feeder portions is confirmed in step S22, the feed flag is set at 1 in step S23, and the OK flag is reset at 0 in step S24.

Therefore, when the copying apparatus is operating normally, the copy paper feed flag is set at 1 while pre-fed originals are present (DCNT1≠0), so as to enable the feeding of the copy paper for the pre-fed originals. Furthermore, the actual feeding operation in response to the copy paper feed flag is described fully in FIGS. 13–18.

On the other hand, when the counter KCNT1 is found to be set at 1 in step S17, the counter DCNT1 is checked in step S18. If the counter DCNT1 is set at a value other than 0, the DCNT1 is decremented, and thereafter the operator-set value is set in the counter KCNT1 in step S21 for the next original copying process, whereupon the routine continues to step S22. If the DCNT1 is set at 0, a check is made in step S19 to determine whether or not the duplex copy mode or the composite copy mode has been selected. If neither of the aforesaid modes has been selected, the program returns to the main routine, whereas if either one of the aforesaid modes has been selected, a check is made in step S20 to determine whether or not copy paper is accommodated in the intermediate tray 47, and if none is present the program returns to the main routine. If copy paper is present in the intermediate tray 47, the processes in step S21 and subsequent steps are executed so as to re-feed said copy paper.

When the APS mode is not selected (step S11; NO), a check is made in step S13 to determine whether or not the print key is ON edge. If the print key is ON edge, the processes of steps S14 and subsequent steps are executed, whereas if the print key is not ON edge, the processes of step S16 and subsequent steps are executed.

Figure 13:
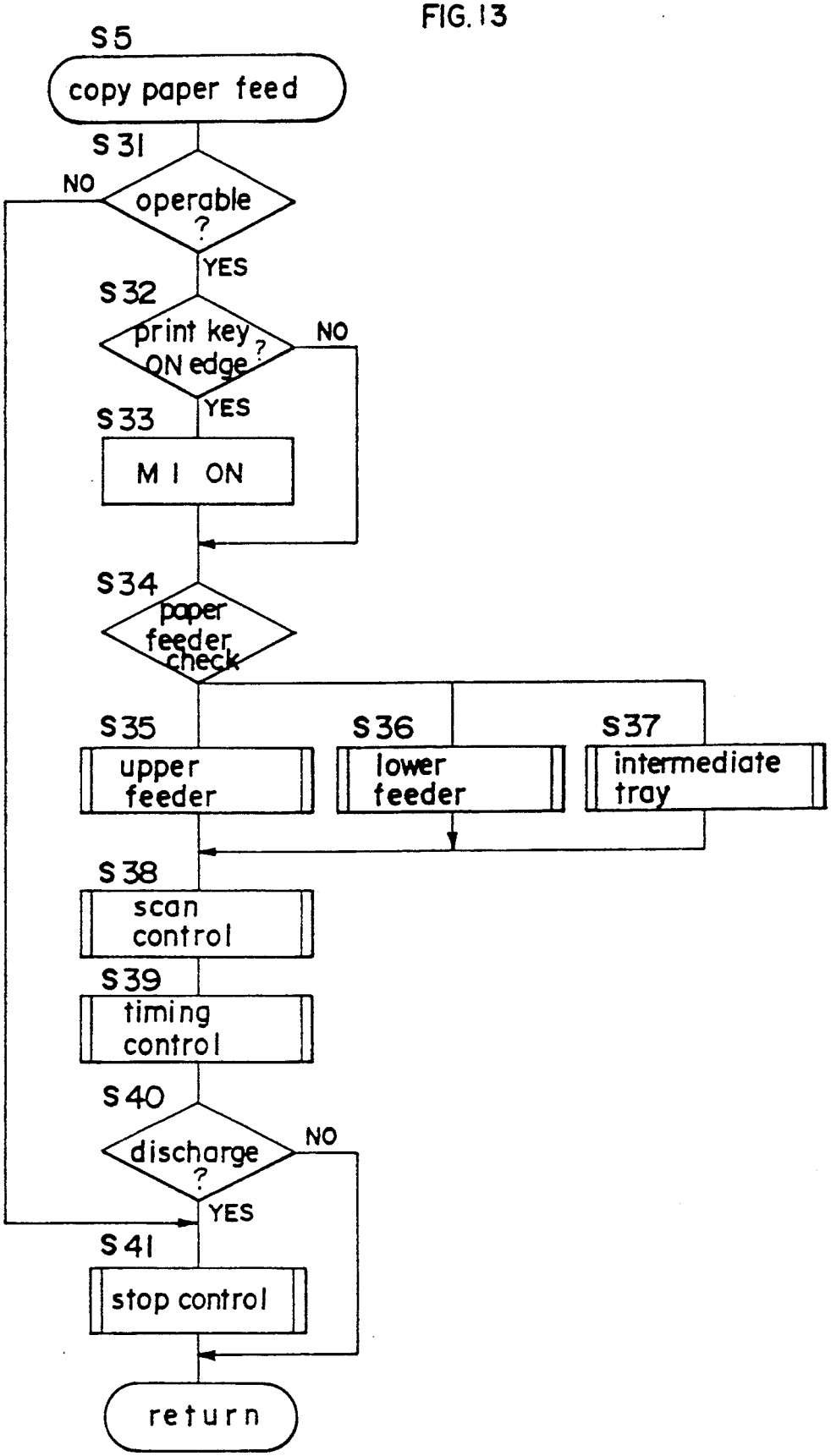

FIG. 13 shows the process of the copy paper feed subroutine executed in step S5.

In this subroutine, copy paper is actually fed based on the specifications of the copy paper feed flag, and image scanned via the optical unit 20.

First, determinations are made in step S31 as to whether or not the copying apparatus main unit 1 and the sorter 90 are operational. Mainly, a check is made to determine whether or not there is a paper jam; if the main unit 1 and sorter 90 are found to be operational, a check is made in step S32 to determine whether or not the print key is ON edge. If the print key is found to be ON edge, the main motor M1 is turned ON in step S33.

In step S34, the currently selected feed opening is checked. The copy paper feed process of step S35 is executed if the upper feeder 31 has been selected, the copy paper feed process of step S36 is executed if the lower feeder 31 has been selected, and the copy paper feed process of step S37 is executed if the intermediate tray (re-feed) has been selected.

Thereafter, in step S38, the scan control process is executed for the optical unit 20, the feed control process is executed in step S39 to feed copy paper from the timing roller 38 to the transfer portion, and when the discharge of the copy paper from the main unit 1 is confirmed in step S40, the operation of the main unit 1 is stopped in step S41.

Figure 14:
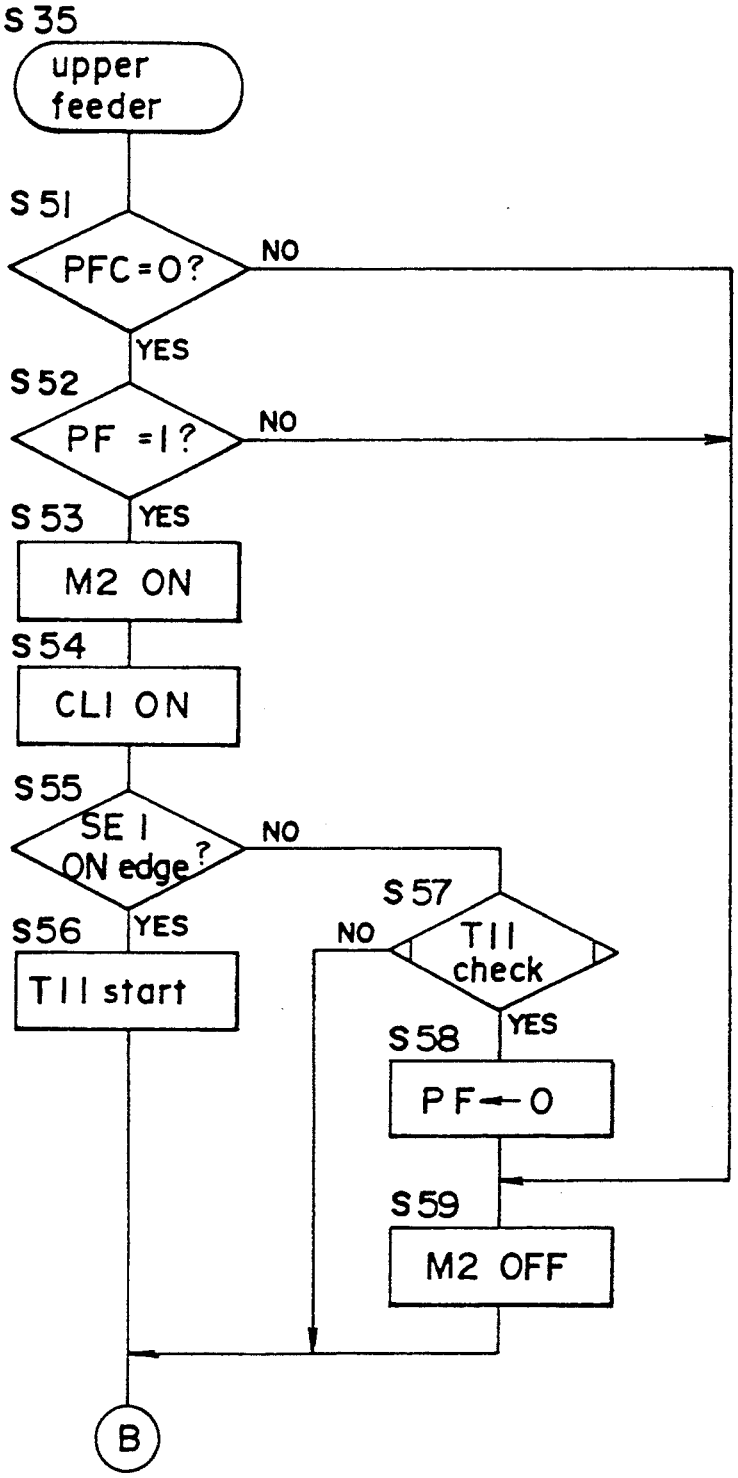
Figure 15:
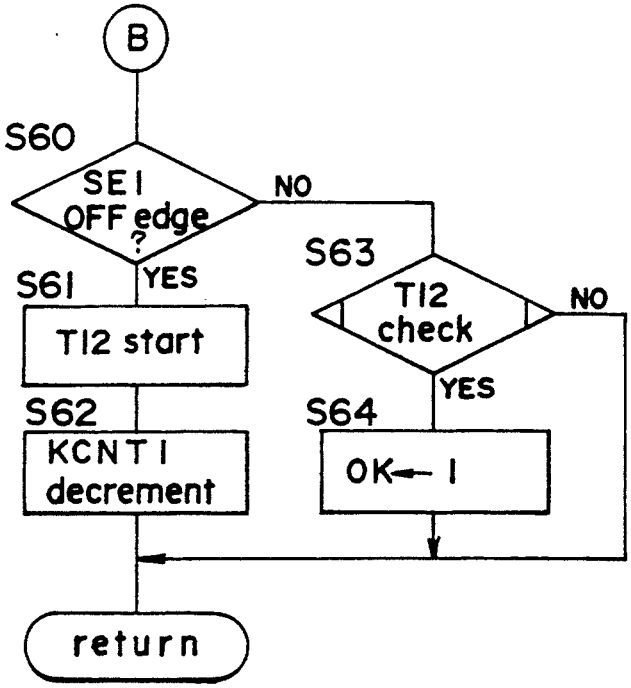

FIGS. 14 and 15 show upper feeder subroutine executed in step S35. The subroutine for the lower feeder executed in step S36, and the subroutine for the re-feed process from the intermediate tray 47 executed in step S37 are essentially the same.

First, a check is made in step S51 to determine whether or not the paper feed completion flag is set at 0. The paper feed complete flag is set at 1 after a predetermined time elapses following the detection of the copy paper by the sensor SE4 (refer to step S87), which indicates the copy paper is on standby at the timing roller 38. If the paper feed complete flag is reset at 0, the setting of the paper feed flag at 1 is confirmed in step S52, and thereafter the paper feed motor M2 is turned ON in step S53 and the clutch CL1 is turned ON in step S54. Thus, the feed roller 32 and the handling roller 33 are rotatably driven, and the transport rollers **37*a*, 37*b*, and 37*c* are rotatably driven so as to feed the copy paper from the upper feeder 31. On the other hand, if the reply to the queries of steps S51 and S52 are NO, the feed motor M2 is turned OFF in step S59**.

Figure 16:
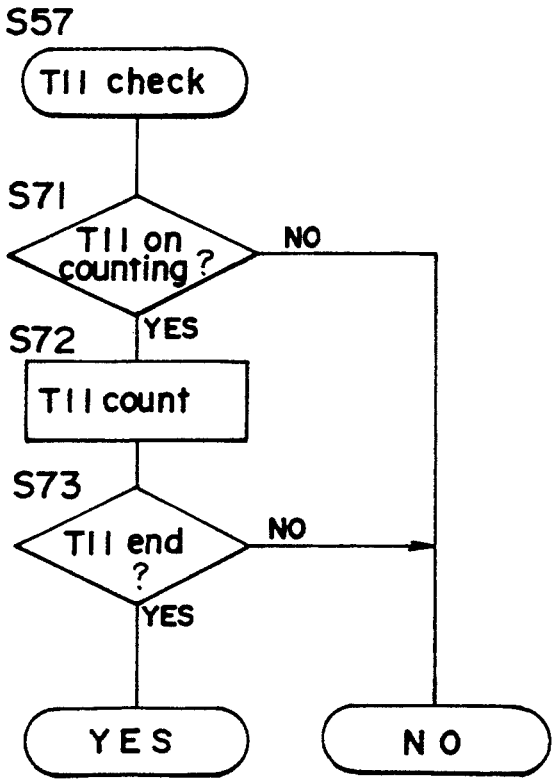

Next, a check is made in step S55 to determine whether or not the sensor SE1 is ON edge. If the sensor SE1 is found to be ON edge, i.e., if the leading end of the copy sheet has arrived at the SE1 detection point, the timer T11 is started in step S56. The timer T11 sets the timing for turning OFF the feed motor M2; after the timer T11 is started, a check is made in step S57 to determine whether or not said timer T11 has ended. As shown in FIG. 16, when it is determined in step S71 that the counter T11 is currently on-going, the timer count continues in step S72, and a check is made in step S73 to determine whether or not the count has ended. When the timer T11 count has ended, the paper feed flag is reset at 0 in step S58, and the feed motor M2 is turned OFF in step S59.

Then, a check is made in step S60 to determine whether or not the sensor SE1 is OFF edge. If the sensor SE1 is found to be OFF edge, i.e., if the trailing end of the copy paper has passed the SE1 detection point, the timer T22 is started in step S61, and the counter KCNT1 is decremented in step S62. The timer T22 sets the timing for enabling the feeding of the next copy paper; after the timer T22 is started, a check is made in step S63 to determine whether or not said timer T22 has ended. The process of step S63 is the identical subroutine shown in FIG. 16, such that when the timer T22 count has ended, the OK flag is set at 1 in step S64 to enable the feeding of the next copy paper.

Figure 17:
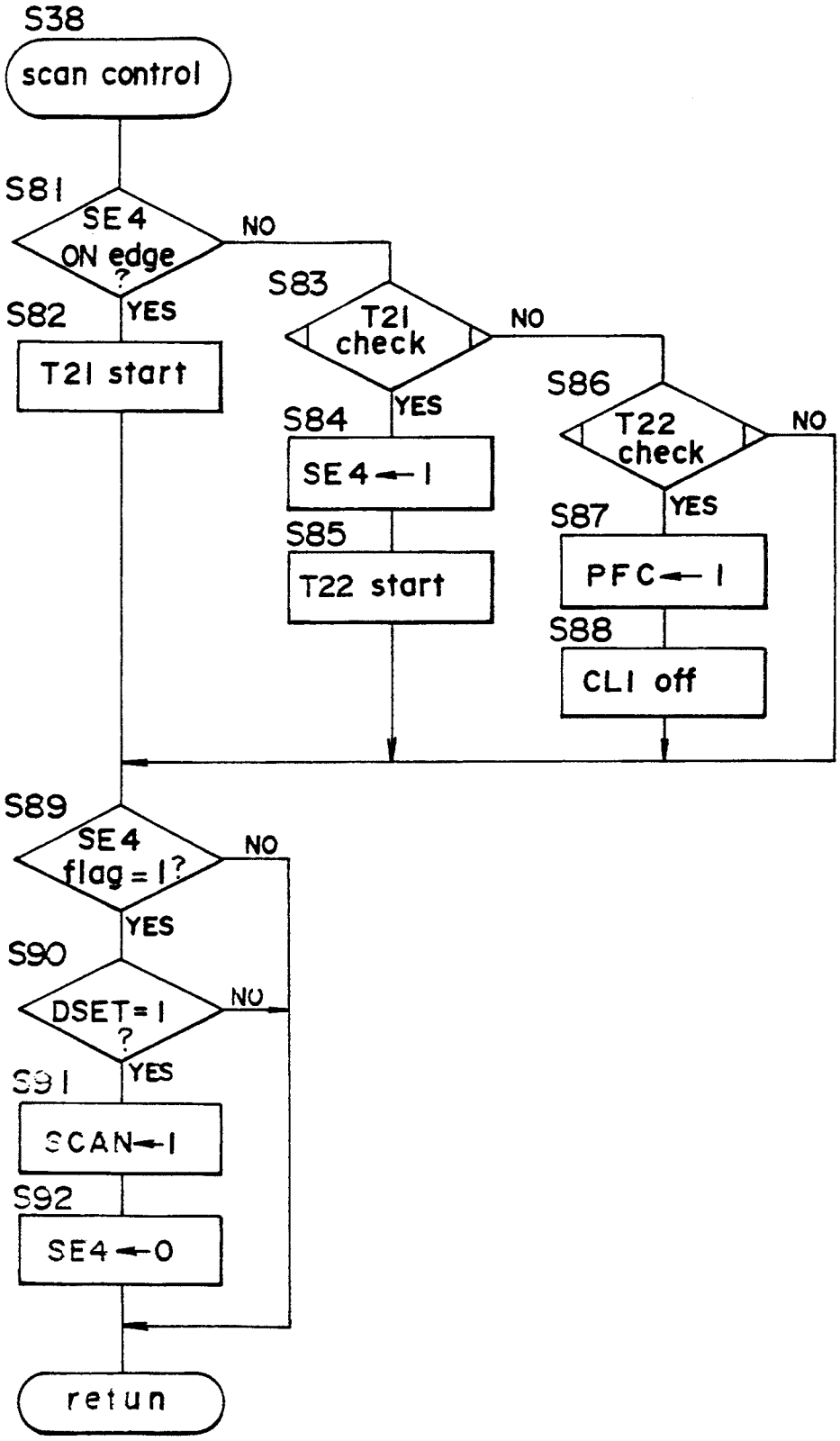

FIG. 17 shows the scan control subroutine executed in step S38.

This subroutine sets the timing for starting the image scanning operation by the optical unit 20.

First, a check is made in step S81 to determine whether or not the sensor SE4 is ON edge. If the sensor SE4 is found to be ON edge, i.e., if the leading end of the copy paper has arrived at the sensor SE4 detection point, the timer T21 is started in step S82. The timer T21 sets the timing for starting the scan by the optical unit 20; after the timer T21 has started, a check is made in step S83 to determine whether or not said timer T21 has ended. The process of step S83 is identical to the subroutine shown in FIG. 16, such that when the timer T21 count has ended, the SE4 flag is set at 1 in step S84 to enable the scanning operation. The timer T22 is started in step S85. The timer T22 counts the time until the copy paper arrives at the timing roller 38; after the timer T22 has started, a check is made in step S86 to determine whether or not said timer T22 has ended. The process of step S86 is identical to the subroutine shown in FIG. 16, such that when the timer T22 count has ended, the paper feed complete flag is set at 1 in step S87, the clutch CL1 is turned OFF and the rotation of the transport rollers 37*a*, 37*b* and 37*c* is stopped in step S88.

Then, a check is made in step S89 to determine whether or not the SE4 flag is set at 1. If the SE4 flag is set at 1 (i.e., if the scan enable timing is set), a check is made in step S90 to determine whether or not the DSET flag is set at 1. When the DSET flag is set at 1, it indicates that an original document is set at the standard position 0 on the platen glass 29. Accordingly, if the reply to the query in step S90 is YES, the SCAN flag is set at 1 in step S91 and the SE4 flag is reset at 0 in step S92. The SCAN flag communicates with the CPU controlling the optical unit 20; when the SCAN flag is set at 1, the scanning operation of the optical unit 20 is started.

Figure 18:
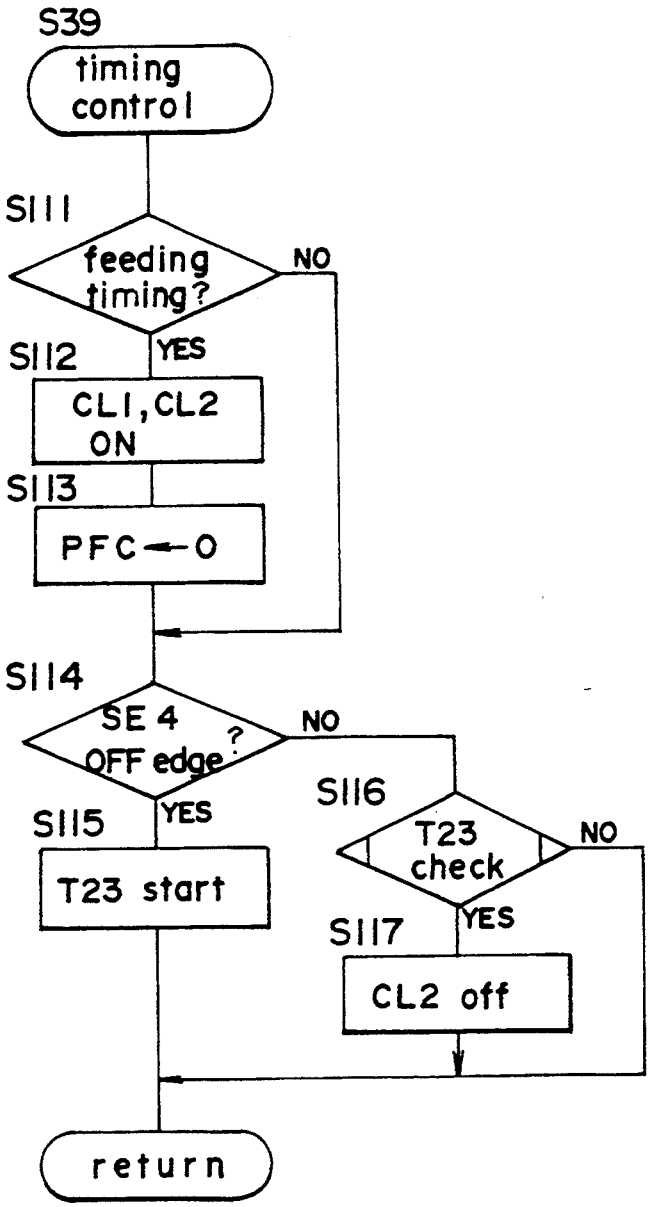

FIG. 18 shows the timing control subroutine executed in step S39.

In this subroutine, the copy paper is fed to the transfer portion by the timing roller 38 with a predetermined timing.

First, a check is made in step S111 to determine whether or not the copy paper feed timing has been set. This timing starts the scanning operation of the optical unit 20, and synchronizes the arrival of the toner image formed on the surface of the photosensitive drum 10 with the arrival of the copy paper at the transfer portion, and is transmitted from the CPU for controlling the optical unit 20 to the CPU1. If the copy paper feed timing has been set, the clutches CL1 and CL2 are turned ON and the transport rollers 37*a*, 37*b*, 37*c* and timing roller 38 are rotated in step S112. Then, the paper feed complete flag is reset at 0 in step S113.

Next, a check is made in step S114 to determine whether or not the sensor SE4 is OFF edge. If the sensor SE4 is OFF edge, i.e., if the trailing end of the copy sheet has passed the sensor SE4 detection point, the timer T23 is started in step S115. The timer T23 counts the time until the trailing end of the copy paper passes the timing roller 38; After the timer T23 is started, a check is made in step S116 to determine whether or not said timer T23 has ended. The process of step S116 is identical to the subroutine shown in FIG. 16, such that when the timer T23 count has ended, the clutch CL2 is turned off and the rotation of the timing roller 38 is stopped in step S117.

The control sequence of the ADF 50 is described hereinafter with reference to FIGS. 19–34.

Figure 19:
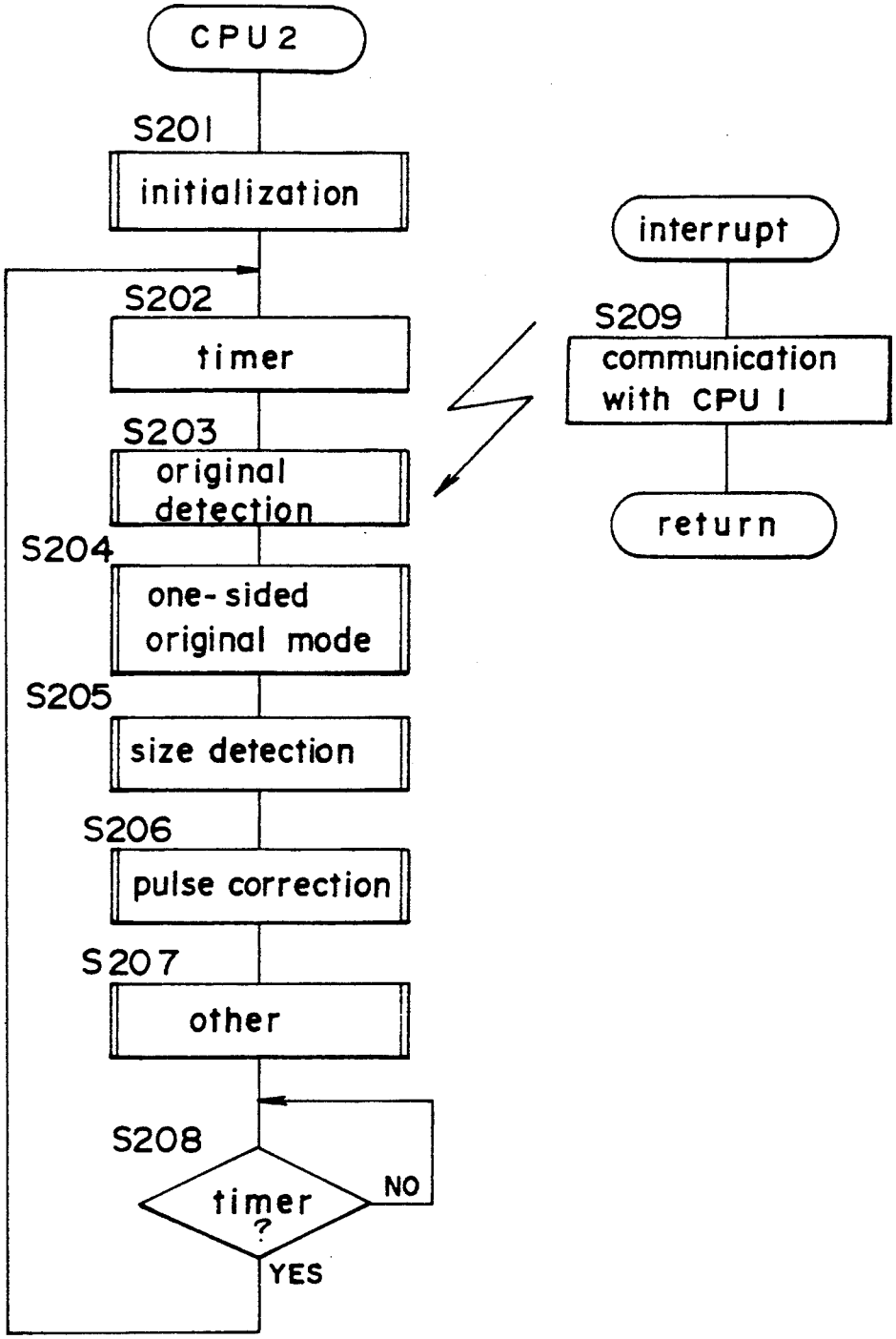

FIG. 19 shows the main routine of the CPU2.

When the power source is turned ON, the CPU2 is reset and the program starts, and in step S201 the random access memory (RAM) is cleared, various registers are reset, and initialization is executed to set the initial modes for the various types of components. An internal timer determines the time required for one routine of the main routine, and the value set in said timer is set in step S201. Furthermore, the aforesaid internal timer sets the counting standard for the various timers described in the various subroutines hereinafter.

Next, the various subroutines in steps S203 through S207 are sequentially called, the required processes are executed, and in step S208 the end of the internal timer is awaited, whereupon the routine returns to step S202. Step S203 is the subroutine for detecting the original document, step S204 is the subroutine for the single-side process, step S205 is the subroutine for detecting the size of the original document, and step S206 is the subroutine for correcting the pulse number used to stop the original documents. The aforesaid subroutines are described later. Step S207 executes various other processes, e.g., the input/display process for the control panel, original feed process for the duplex mode and original jam detection process and the like.

Communication with the CPU1 is executed in step S209 in the interrupt process.

Figure 20:
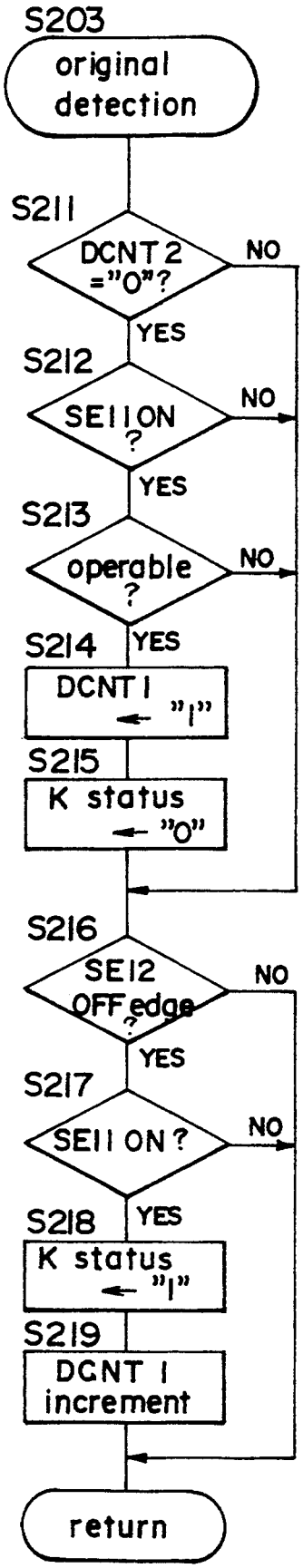

FIG. 20 shows the original detection subroutine executed in step S203.

The CPU2 has three counters to store the number of pages of the original document. The counter DCNT1 is first set at 1 if the sensor SE11 is turned ON and, thereafter, the counter DCNT1 is incremented when the original passes the sensor SE12 detection point if the sensor SE11 is turned ON (refer to step S219), and the counter DCNT1 is decremented when the CPU1 specifies an exchange of the originals (refer to step S234). The counter DCNT2 is incremented at the start of the copy paper feed (refer to step S244), and decremented at the completion of the discharge (refer to step S377). The counter DCNT3 is incremented at the completion of the copy paper feed (refer to step S270), and decremented when the sheet is completely set at the standard position 0 (refer to step S315).

First, the counter DCNT2 is checked in step S211, and a check is made in step S212 to determine whether or not the sensor SE11 is ON, then in step S213 the operational status of the ADF 50 is checked. When the ADF 50 is operational, it is properly set on the platen glass 29, no paper jams exist within the ADF 50 and it is in the normal standby state. If the reply to any of the queries in steps S211, S212 and S213 is YES, i.e., the counter DCNT2 is in the initialized state, the presence of an original on the tray 52 is confirmed by the sensor SE11, and if the ADF 50 is operational, the value of the DCNT1 is set at 1 in step S214, and the value of the K-status counter is reset at 0 in step S215. The K-status is the counter used to control the feeding of the original document.

Next, a check is made in step S216 to determine whether or not the sensor SE12 is OFF edge, and the sensor SE11 is checked in step S217 to determine whether or not it is ON edge. If the reply to either query is YES, i.e., if the trailing end of the original has passed the sensor SE12 detection point, then when the next original is detected by the sensor SE11, the K-status counter is set at 1 in step S218, and the DCNT1 is incremented in step S219.

Figure 21:
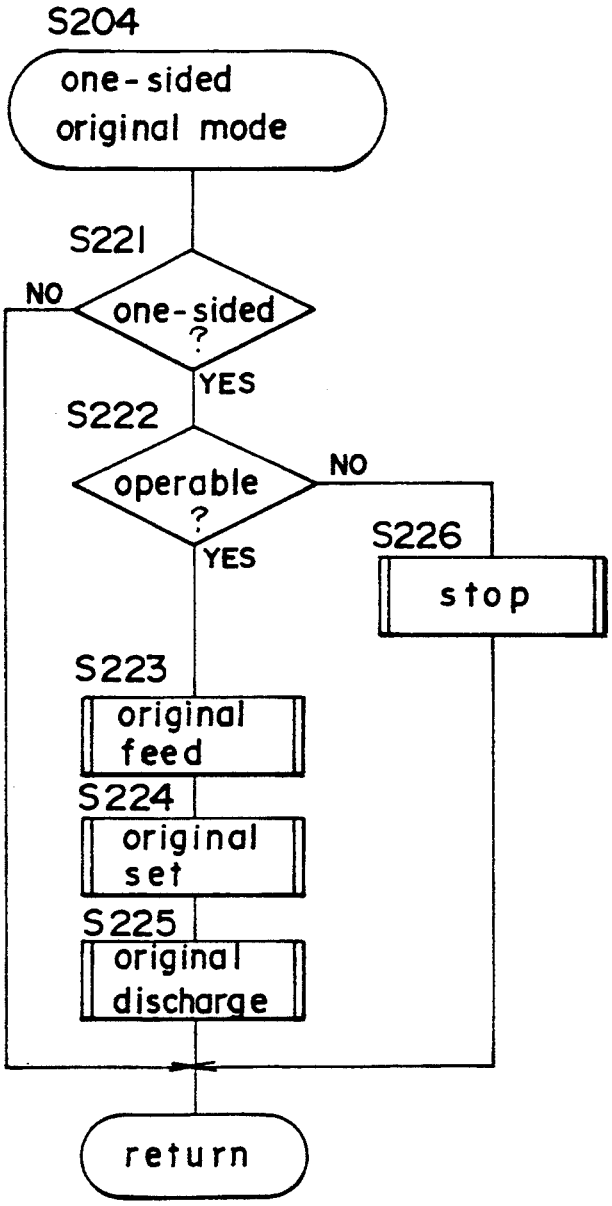

FIG. 21 shows the one-sided original mode subroutine executed in step S204.

This subroutine executes the process for discharging the original to the tray 69 immediately after said original has been fed, stopped and the scan completed.

First, when it is determined that the one-sided original mode has been selected in step S222, it is confirmed that the ADF 50 is operational in step S222, whereupon the original is fed in step S223, set in the standard position 0 in step S224, and discharged in step S225. The aforesaid processes are fully described hereinafter with reference to the flow charts of FIGS. 22–30.

On the other hand, when it is determined that the ADF 50 is inoperable, the operation of said ADF 50 is stopped in step S226.

Figure 22:
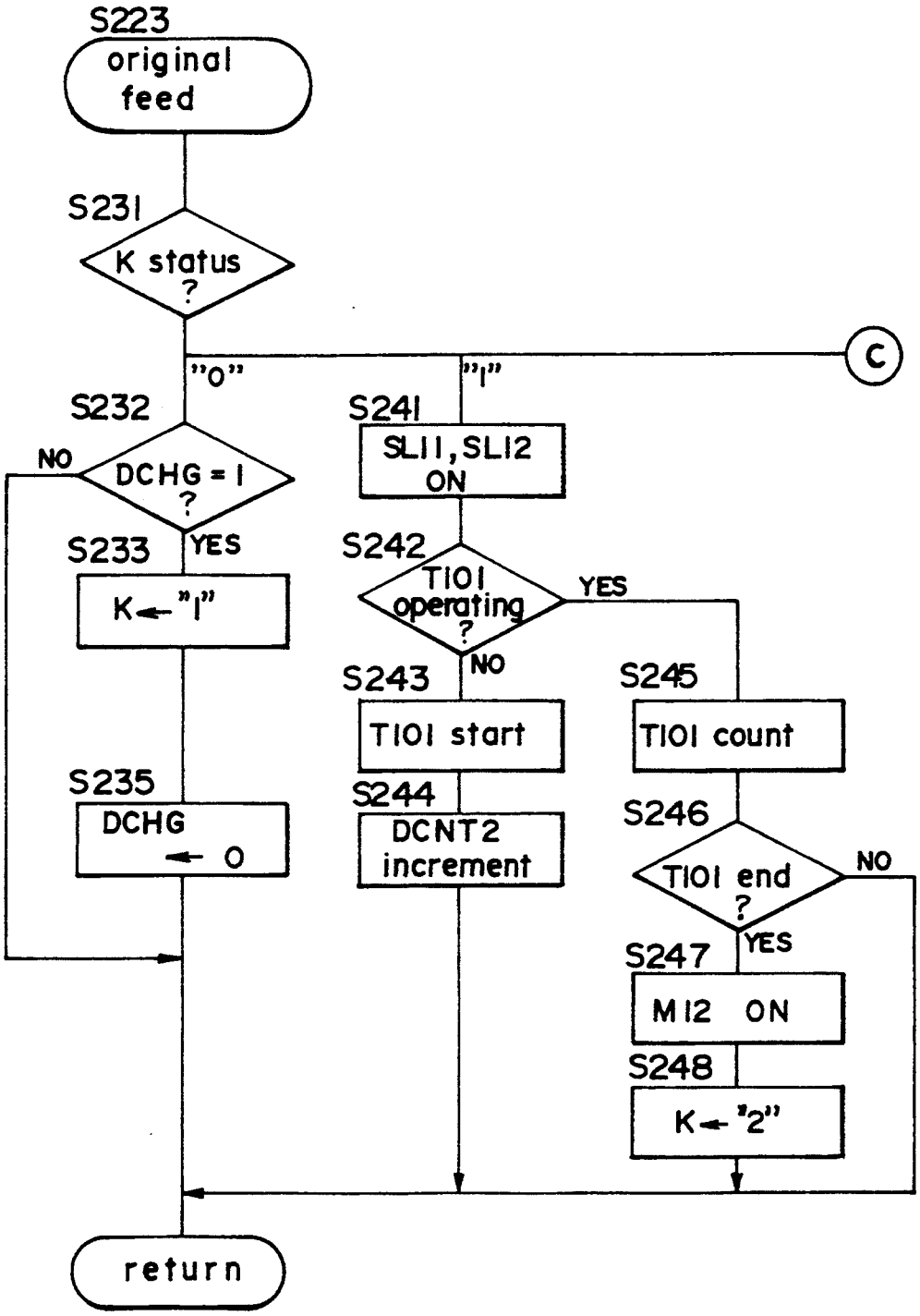
Figure 23:
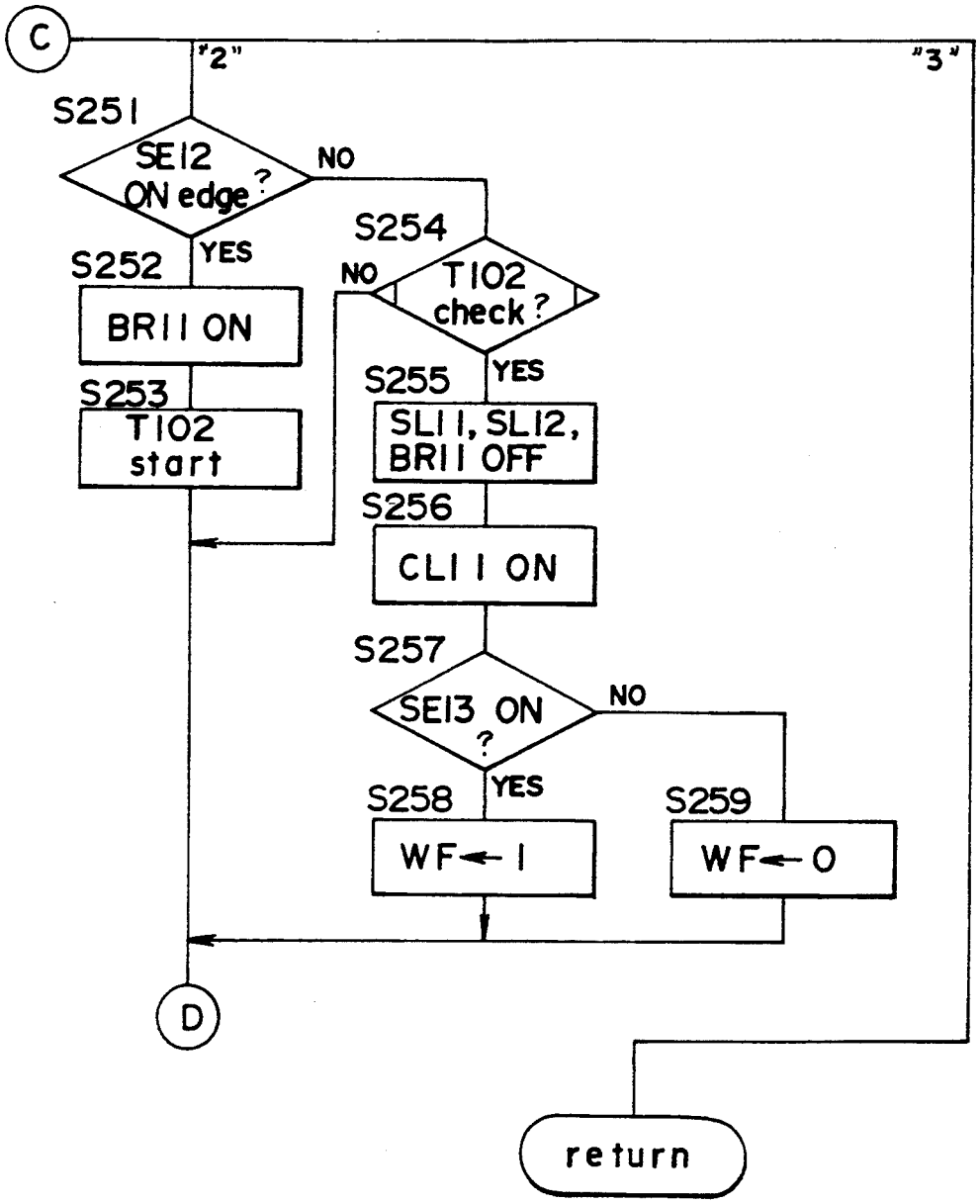
Figure 24:
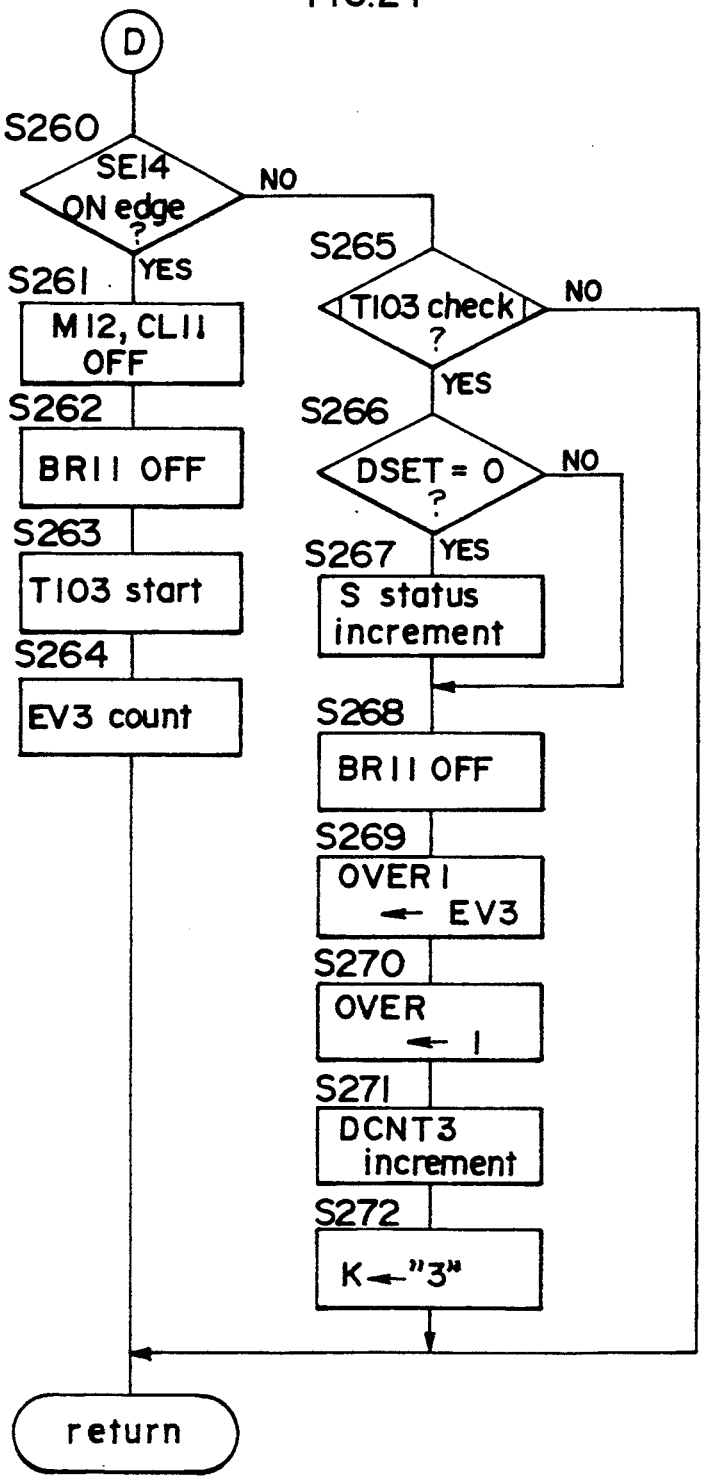
Figure 25:
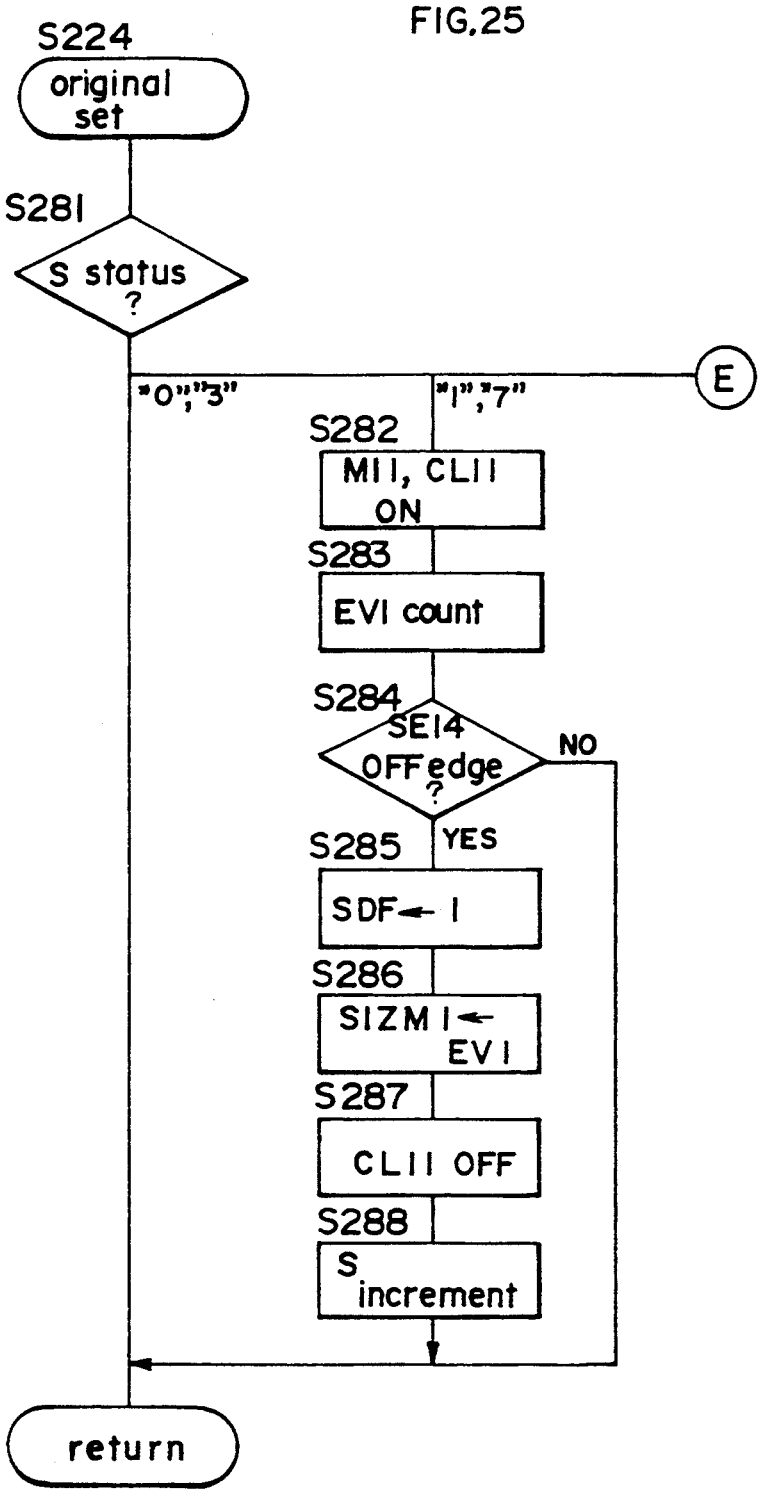
Figure 26:
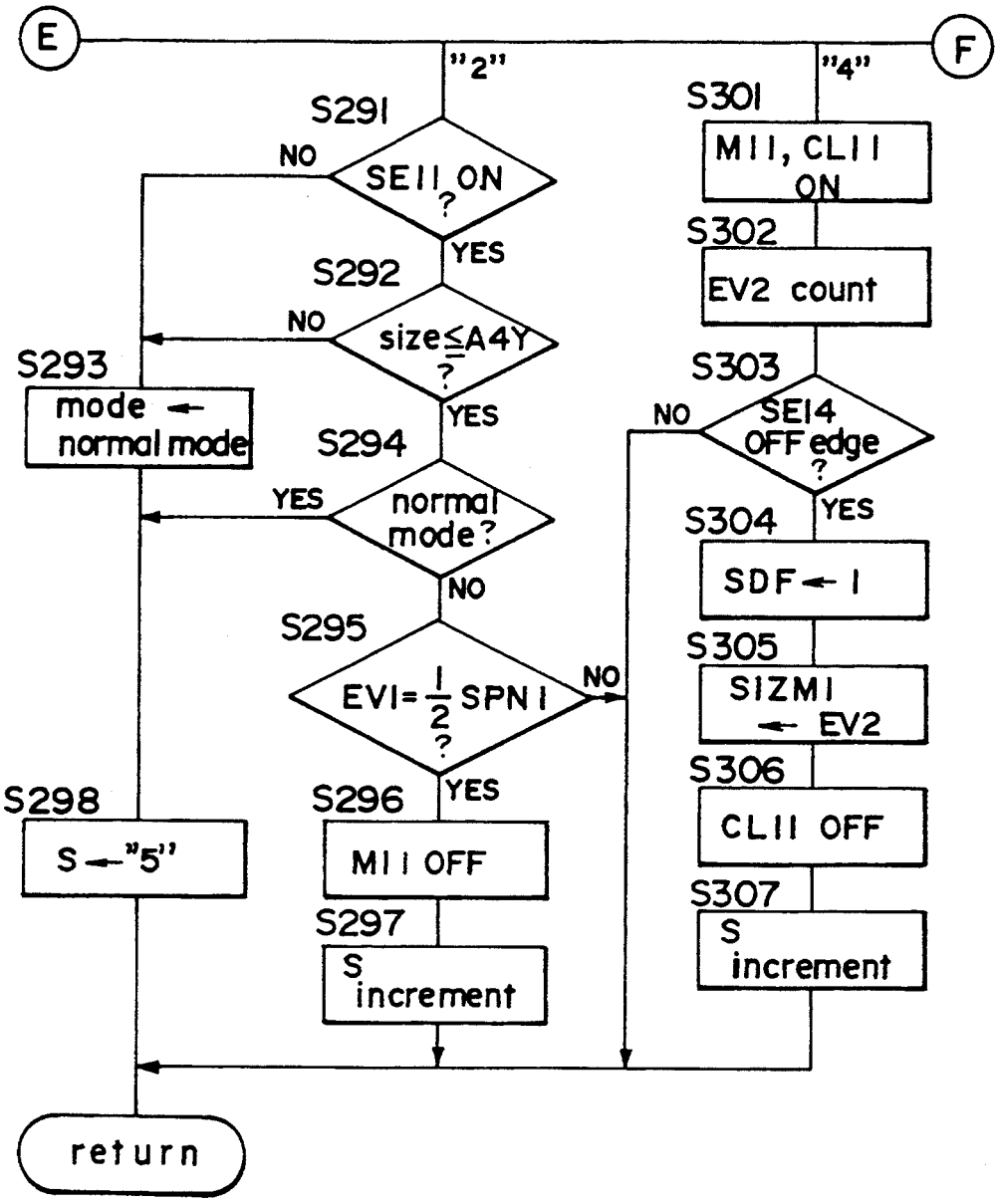
Figure 27:
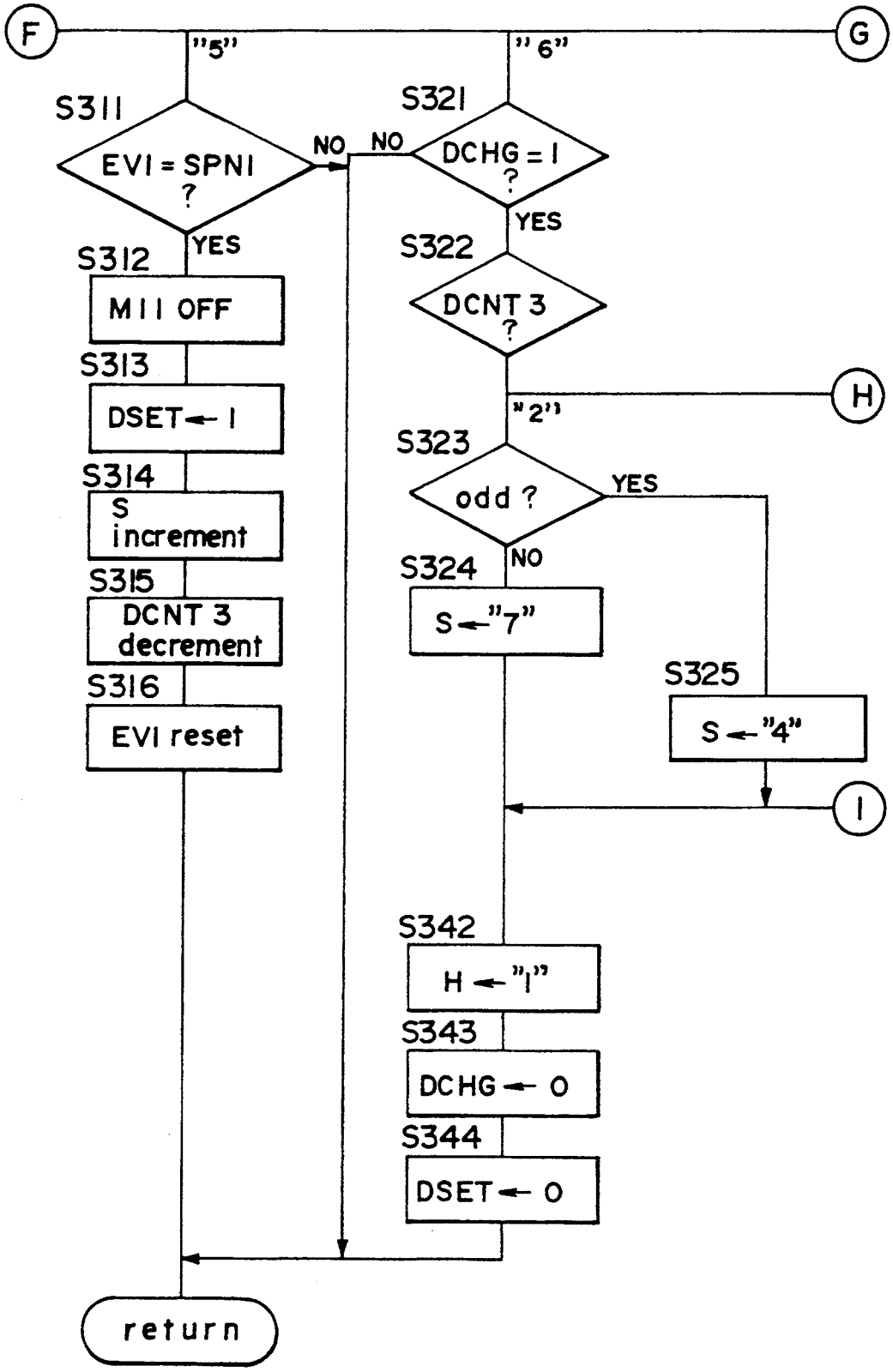
Figure 28:
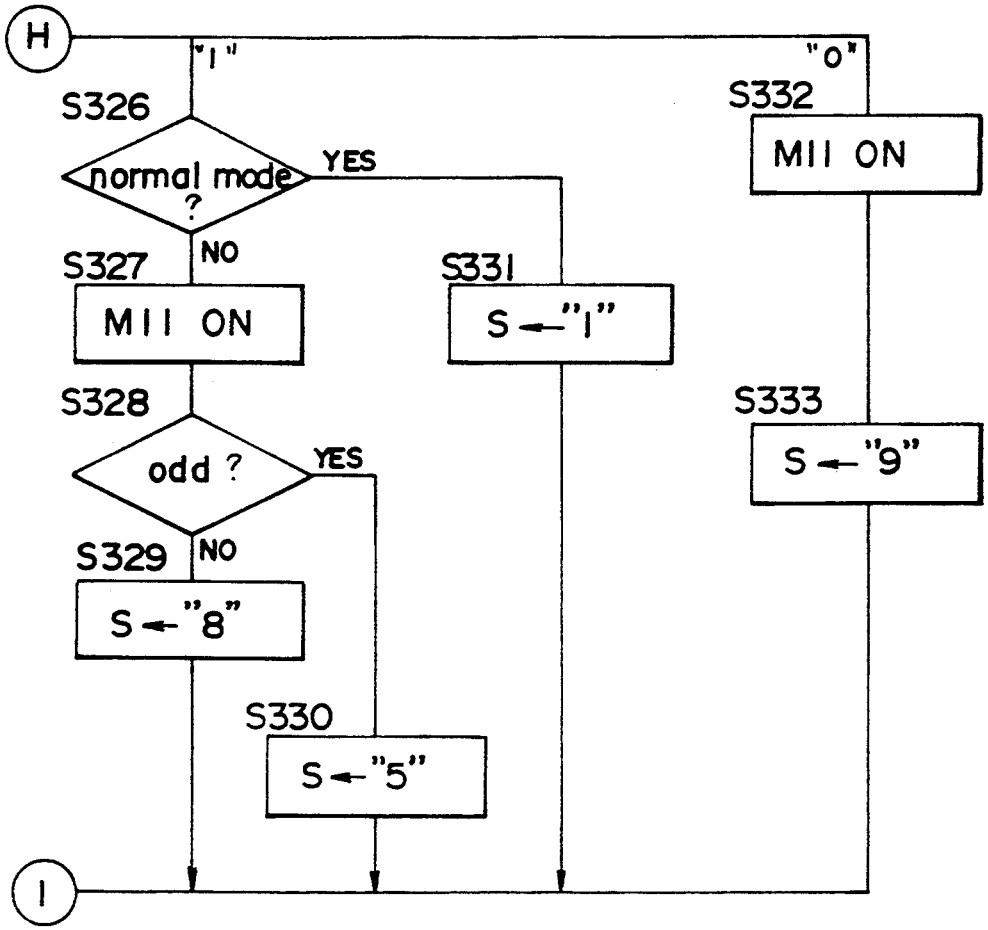
Figure 29:
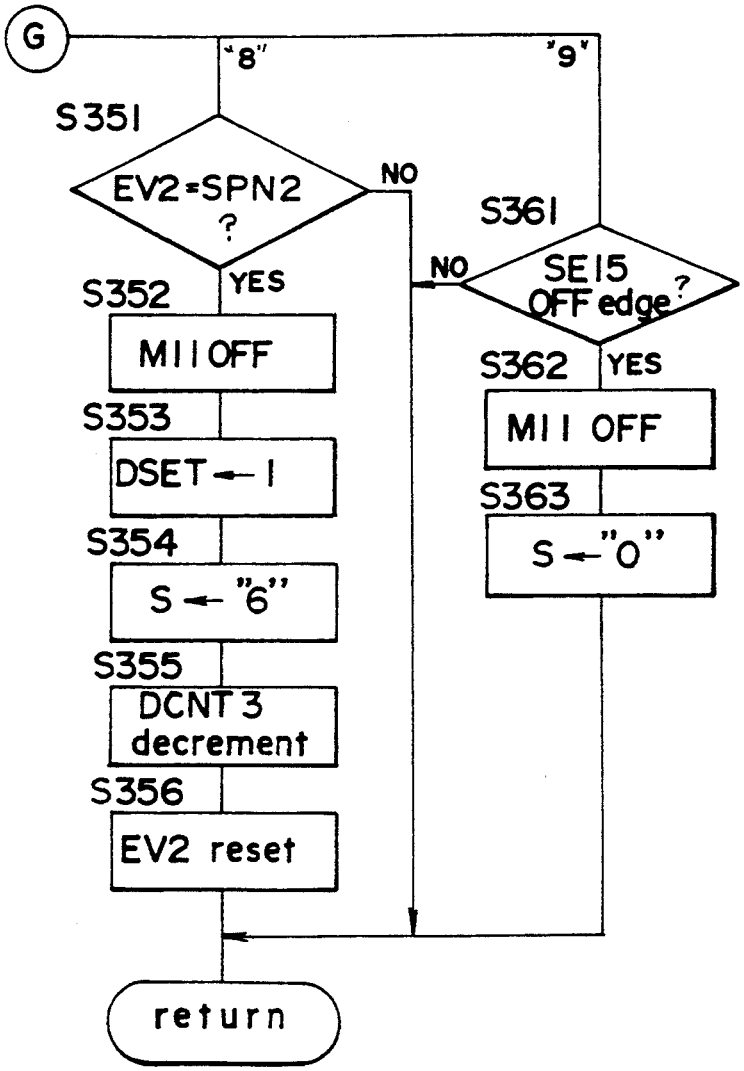

FIGS. 22–24 show the original feed subroutine executed in step S223.

This subroutine checks the value of the K-status counter in step S231, and executes the processes below in accordance with said counter value.

First, when the K-status counter value is 0, a the DCHG flag is checked in step S232 to determine whether or not it is set at 1. If the DCHG flag is set at 1, the K-status counter is set at 1 in step S233 because an original document exchange is requested, and the DCHG flag is reset at 0 in step S235.

When the K-status counter is set at 1, the original feeding process is started. That is, the solenoids SL11 and SL12 are turned ON in step S241, which causes the pick-up roller 54 to be lowered and the front end stopper 53 to be retracted, and the reverse handling roller 56 applies a required pressure on the forward handling roller 55. Then, a check is made in step S242 to determine whether or not the timer T101 is currently operating. If the timer T101 is not currently operating, the timer T101 is started in step S243, and the DCNT2 is incremented in step S244. The timer T101 determines the timing for switching ON the pick-up motor M12; after the timer T101 is started, the it counts in step S245, and a check is made in step S246 to determine whether or not the timer T101 is completed in step S246. If the timer T101 is completed, the pick-up motor M12 is turned ON in step S247, and the K-status counter is set at 2 in step S248. Thus, the original document is fed from the rollers 54, 55 and 56 to the register roller 58.

When the K-status counter is set at 2, the original is advanced after a temporary standby at the register roller 58 and stopped when the leading end of said original is detected by the sensor SE14. That is, a check is made in step S251 to determine whether or not the sensor SE12 is ON edge. If the sensor SE12 is found to be ON edge, the electromagnetic brake BR11 is turned ON and the register roller 58 is locked in step S252, and the timer T102 is started in step S253. The timer T102 determines the timing for returning the front end stopper 53; after being started, a check is made in step S254 to determine whether or not the timer T12 has ended. This process is identical to the subroutine shown in FIG. 16, such that when the timer T102 count has ended, the solenoids SL11 and SL12 are turned OFF, and the electromagnetic brake BR11 is turned OFF in step S255. Until this time the leading end of the original remains in contact with the nip portion of the register roller 58 and pinch roller 59a, thereby forming somewhat of a loop.

Next, the clutch CL11 is turned ON in step S256, which causes the register roller 58 to be rotatably driven by the pick-up motor M12 so as to feed the original to the vicinity of the register roller 58. Then, a check is made in step S257 to determine whether or not the sensor SE13 is turned ON. The sensor SE13 detects the width of the original, and when SE13 is turned ON, the width flag is set at 1 in step S258, whereas when said SE13 is turned OFF, the width flag is set at 0 in step S259. The aforesaid width flag is used in the subsequent size detection process (refer to step S205).

Then, a check is made in step S260 to determine whether or not the sensor SE14 is ON edge. If the sensor SE14 is found to be ON edge, the pick-up motor M12 and clutch CL11 are turned OFF in step S261, and the electromagnetic brake BR11 is turned OFF in step S262, which causes the original document to be stopped at a position such that the leading end of said original is detected by the sensor SE14. Next, the timer T103 is started in step S263, and the EV3 counting is permitted via the interrupt process in step S264. The EV3 detects the time from the detection of the leading end of the original by the sensor SE14 until the rotation of the register roller 58 actually stops, i.e., the amount of overrun of the original at the prefeed position, as the number of rotation pulses of the pick-up motor M12. When the timer T103 has started, a check is made in step S265 to determine whether or not the count of said timer T103 has ended. This process is identical to the subroutine shown in FIG. 16. When the timer T103 count has ended, a check is made in step S266 to determine whether or not the DSET flag is set at 0. When the DSET flag is set at 1, it indicates that the original is disposed at the center position 0' or the standard position 0 (refer to steps S313, S353). Accordingly, if the DSET flag is set at 0, the S-status counter is incremented in step S267. The S-status counter is use in controlling the setting of the original document at the standard position 0.

Next, the electromagnetic brake BR11 is turned OFF in step S268, and the counter value of the EV3 (amount of overrun) is set at OVER-1, and the OVER flag is set at 1 in step S270. Then, the DCNT3 counter is incremented in step S271, and the K-status is set at "3" in step S272.

Special processing is not executed when the K-status is "3." The original is in standby in a state of having completed the prefeed process.

FIGS. 25–29 show the original document setting subroutine executed in step S224.

This subroutine checks the S-status count value in step S281, and sets the pre-fed original at either the center position 0′ or the standard position 0 in accordance with said count value.

When the S-status value is "0" or "3," special processing is not executed, and the subroutine ends. When the S-status is "0," it indicates an original has not yet been fed, and when the S-status is "3," it indicates an original is temporarily stopped at the center position 0′.

When the S-status is "1" or "7," i.e., an odd-numbered original has been pre-fed, the main motor M11 and the clutch CL11 are turned ON in step S282, and the EV1 count is permitted via the interrupt process in step S283. Thus, the transport belt 60 and register roller 58 are rotated so as to start advancing the original toward onto the platen glass 29, while at the same time the amount of transport of said original is detected as the number of rotation pulses of the main motor M11.

Next, when the OFF edge state of the sensor SE14 is confirmed in step S284, i.e., when the trailing end of the original passes the SE14 detection point, the size detection flag SDF is set at 1 in step S285, and the EV1 count value (original document length) is set at SIZM1 in step S287. Then, the clutch CL11 is turned OFF and the rotation of the register roller 58 is stopped in step S287, and the S-status is incremented in step S288.

When the S-status is "2," i.e., when the trailing end of the original has passed the sensor SE14 detection point, a check is made in step S291 to determine whether or not the sensor SE11 is turned ON. If the sensor SE11 is OFF, the step feed mode is not required because there is not a next original document. Therefore, the normal mode is set as the processing mode for the ADF 50 in step S293, and the S-status is set at "5" in step S298. If the sensor SE11 is ON and the size of the original currently fed onto the platen glass 29 is larger than A4Y (Y indicates horizontal feed wherein the short side of the original is parallel to the transport direction) in step S292, the step feed mode is impossible because the ADF 50 is currently set for size A3T (T indicates vertical feed wherein the long side of the original is parallel to the transport direction), and therefore the routine moves to step S293.

If the size of the original is A4Y or less, a check is made in step S294 to determine whether or not the normal mode is selected. If the normal mode has been selected, the routine advances to step S298, whereas if the normal mode has not been selected, the step feed mode process is executed. That is, a check is made in step S295 to determine whether or not EV1 pulse count value has reached ½ the stop pulse number 1 (SPN1). The stop pulse number 1 is the number of rotation pulses of the main motor M11 equivalent to transporting the original from the sensor SE14 detection point to the standard position 0, and is a value corrected by the prefeed process overrun amount (refer to step S206). If the reply to the query in step S295 is YES, it indicates the leading end of the original has arrived at the center position 0′ and, therefore, the main motor M11 is turned OFF and the rotation of the transport belt 60 is stopped in step S296, and the S-status is incremented in step S297.

When the S-status is "4," i.e., when an even-numbered original has been pre-fed, the main motor M11 and the clutch CL11 are turned OFF i step S301, and the EV2 count is permitted via the interrupt process in step S302.

Thus, the transport belt 60 and the register roller 58 are rotated to start feeding the original onto the platen glass 29, and at the same time the amount of said original movement is detected as the number of rotation pulses of the main motor M11.

Next, when the sensor SE14 OFF edge state is confirmed in step S303, i.e., when the trailing end of the original passes the sensor SE14 detection point, the size detection flag is set at 1 in step S304, and the EV2 count value (original document length) is set at SIZM1 in step S305. Then, in step S306, the clutch CL11 is turned OFF and the rotation of the register roller is stopped, and in step S307 the S-status is incremented.

When the S-status is "5," i.e., when an odd-numbered original is fed from the center position 0′ to the standard position 0, a check is made in step S311 to determine whether or not the EV1 pulse count value has reached the stop pulse number 1. If the reply to the aforesaid query is YES, the main motor M11 is turned OFF and the rotation of the transport belt 60 is stopped in step S312. Then, the DSET flag is set at 1 in step S313, and the S-status is incremented in step S314. Thereafter, the counter DCNT3 is decremented in step S315, and the EV1 is reset in step S316.

When the S-status is "6," a check is made in step S321 to determine whether or not the DCHG flag is set at 1. If the DCHG flag is found to be set at 1, i.e., if an original document exchange is requested, the DCNT3 count is checked in step S322.

When the DCNT3 count value is "2," i.e., when two originals are placed on the platen glass 29 and a third original is pre-fed, the number of times the DCHG flag is set at 1 is checked in step S323. If said DCHG flag is set an odd number of times, the S-status is set at "4" in step S325, whereas if the DCHG flag is set an even number of times, the S-status is set at "7" in step S324.

Next, the DCNT1 is decremented in step S341, and the H-status is set at "1" in step S342. The H-status is used to control the discharge of the original from the platen glass 29. Then, the DCHG flag is reset at 0 in step S343, and the DSET flag is reset at 0 in step S344.

When the DCNT3 count value is "1," i.e., when two originals are disposed on the platen glass 29 but there is no third original, or when a single original is placed n the platen glass 29 in the normal mode, a check is made in step S326 to determine whether or not the normal mode has been selected. If the normal mode has been selected, the S-status is set at "1" in step S331, and the processes of steps S341–344 are executed. If the step feed mode has been selected, the main motor M11 is turned ON in step S327, and the number of times the DCHG flag is set at 1 is checked in step S328. If the DCHG flag is set an odd number of times, the S-status is set at "5" in step S330, whereas if the DCHG flag is set an even number of times, the S-status is set at "8" in step S329. Thereafter, the processes of the aforesaid steps S341–344 are executed.

When the DCNT3 count value is "0," i.e., when only a single original is set on the platen glass 29, the main motor M11 is turned ON in step S332, and the S-status is set at "9" in step S333. Hereafter, the processes of the aforesaid steps S341–344 are executed.

When the S-status is "8," i.e., when an even-numbered original is fed from the center position 0′ to the standard position 0, a check is made in step S351 to determine whether or not the EV2 pulse count value has reached the stop pulse number 2 (SPN2). If the reply to the query is YES, the main motor M11 is turned OFF and the rotation of the transport belt 60 is stopped in step S352, then, the DSET flag is set at 1 in step S353, and the S-status is set at "6" in step S354. Thereafter, the DCNT3 count is decremented in step S355, and the EV2 is reset in step S356.

When the S-status is "9," i.e., for the final original, and the OFF edge state of the sensor SE15 is confirmed, the main motor M11 is turned OFF in step S362, and the S-status is reset at 0 in step S363.

Figure 30:
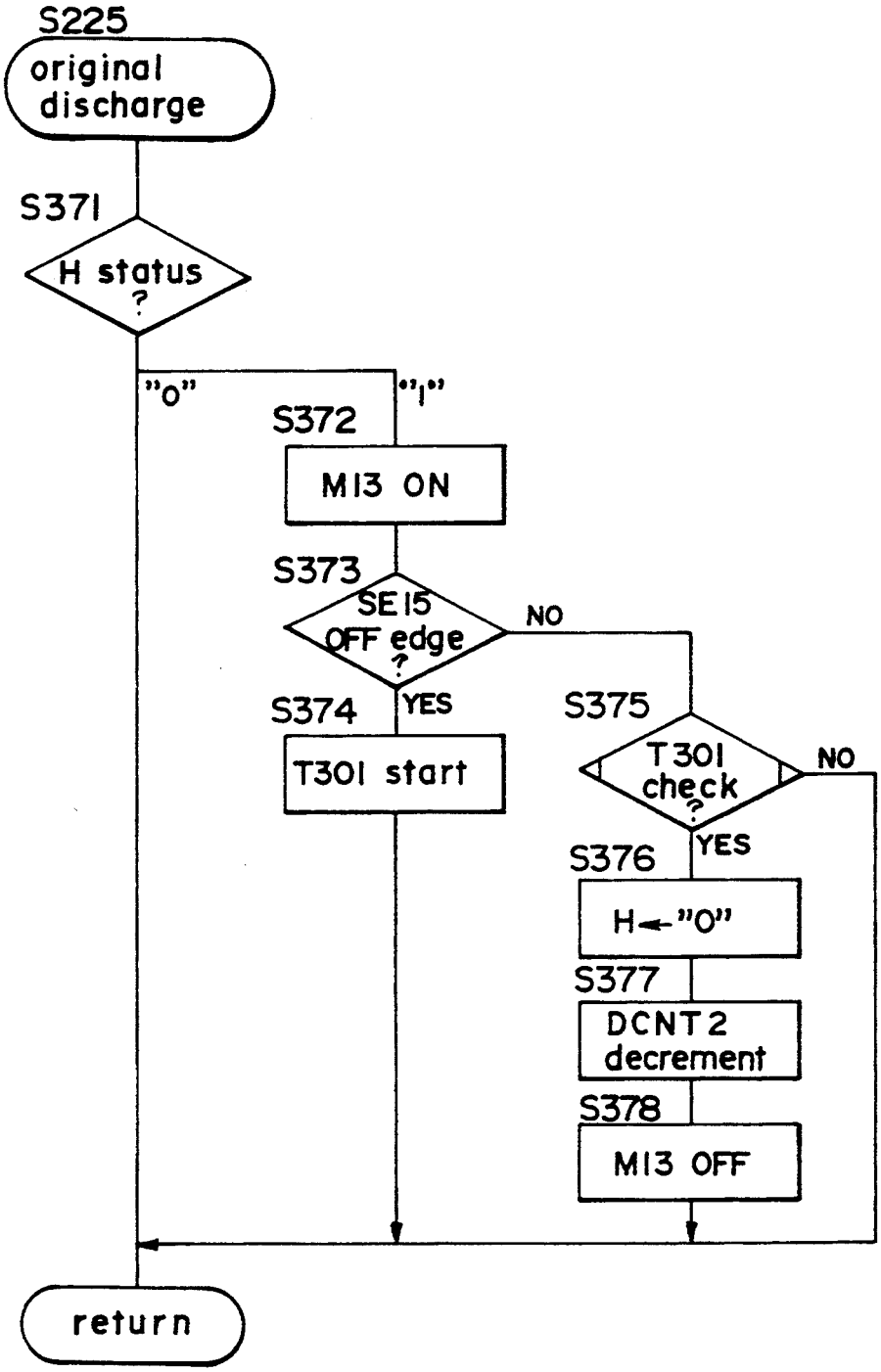

FIG. 30 shows the original document discharge subroutine executed in step S225.

This subroutine discharges the original to the tray 69 after said original set at the standard position 0 is transported from the platen glass 29 by the transport belt 60.

First, the H-status count value is checked in step S371, and subsequent processing is executed in accordance with said count value.

When the H-status is "0," the subroutine is immediately terminated.

When the H-status is "1" (refer to step S342), the inverting/discharge motor M13 is turned ON in step S372, and a check is made to determine whether or not the sensor SE15 is OFF edge in step S373. If the sensor SE15 is OFF edge, i.e., if trailing end of the original has passes the SE15 detection point, the timer T103 is started in step S374. The timer T103 sets the timing for turning OFF the inverting/discharge motor M13, and after said timer is started, a check is made in step S375 to determine whether or not said timer has ended. This process is identical to the subroutine shown in FIG. 16. When the timer T103 count has ended, the H-status is reset at 0 in step S376, and the DCNT2 is decremented in step S377. Then, the inverting/discharge motor M13 is turned OFF in step S378, thereby completing this subroutine.

Figure 31:
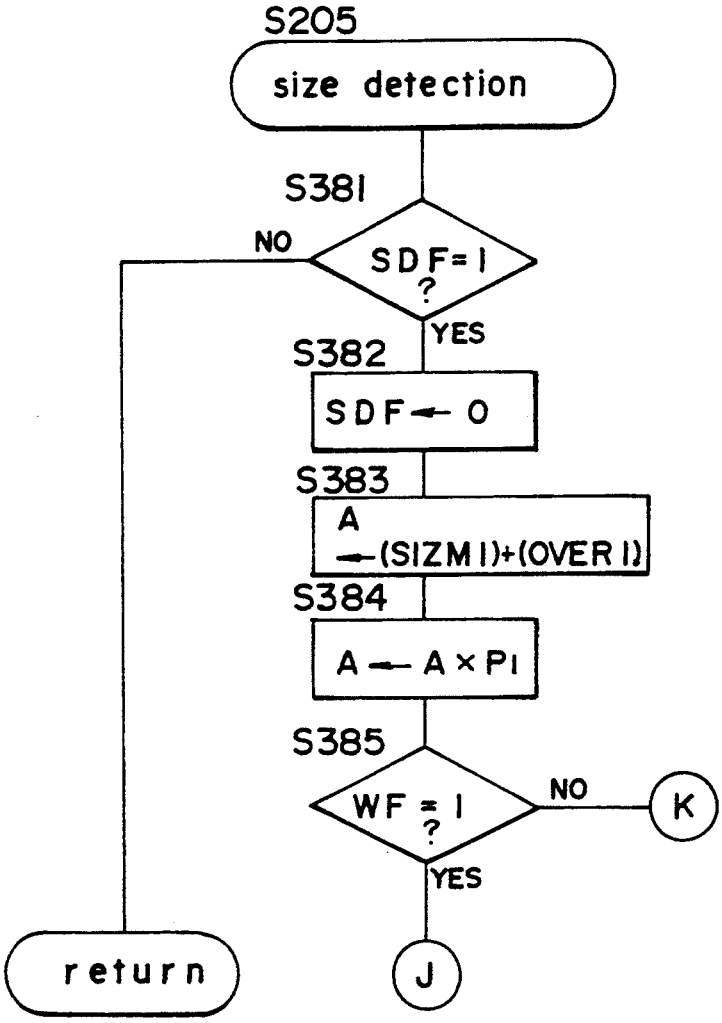
Figure 32:
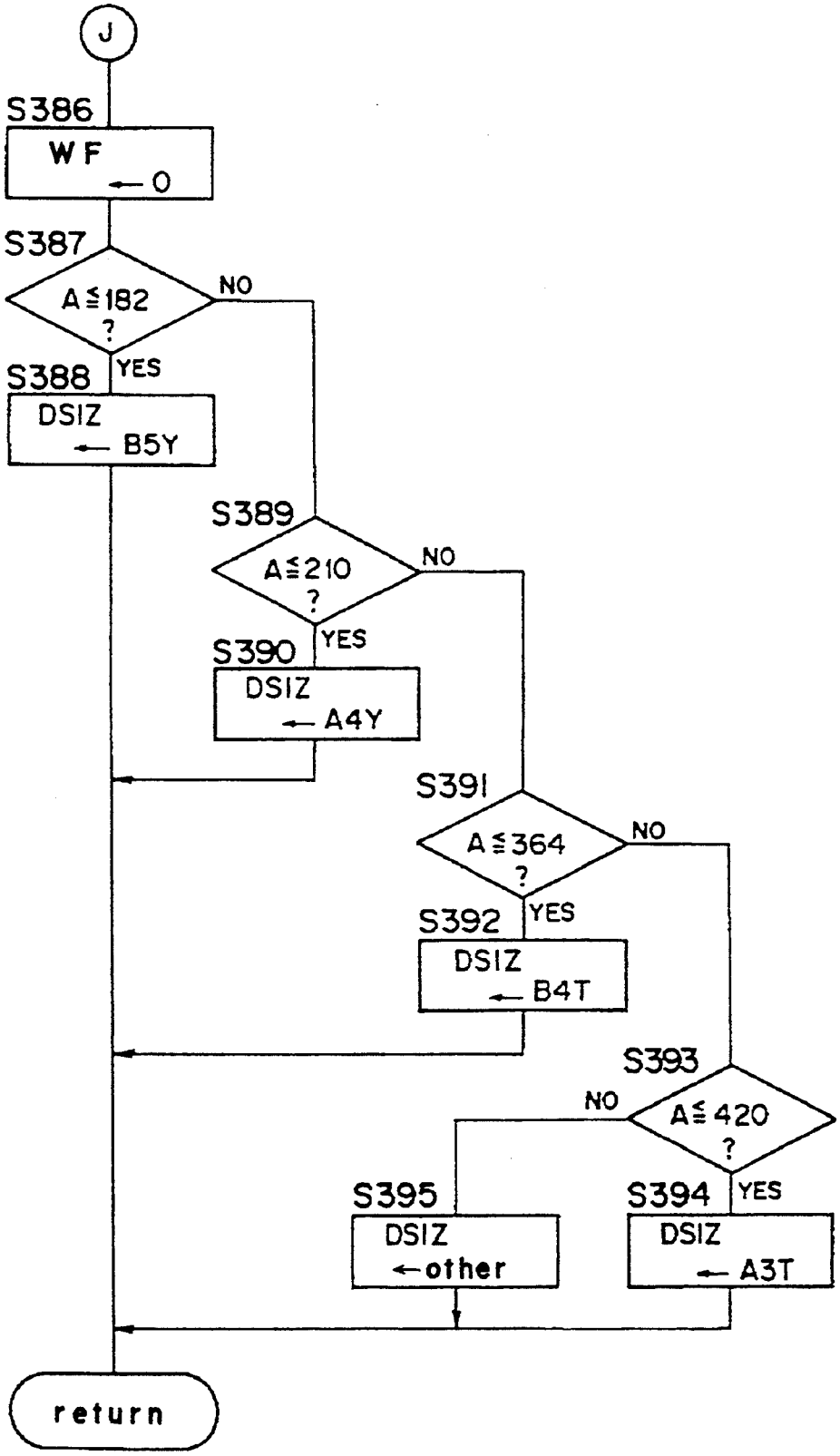
Figure 33:
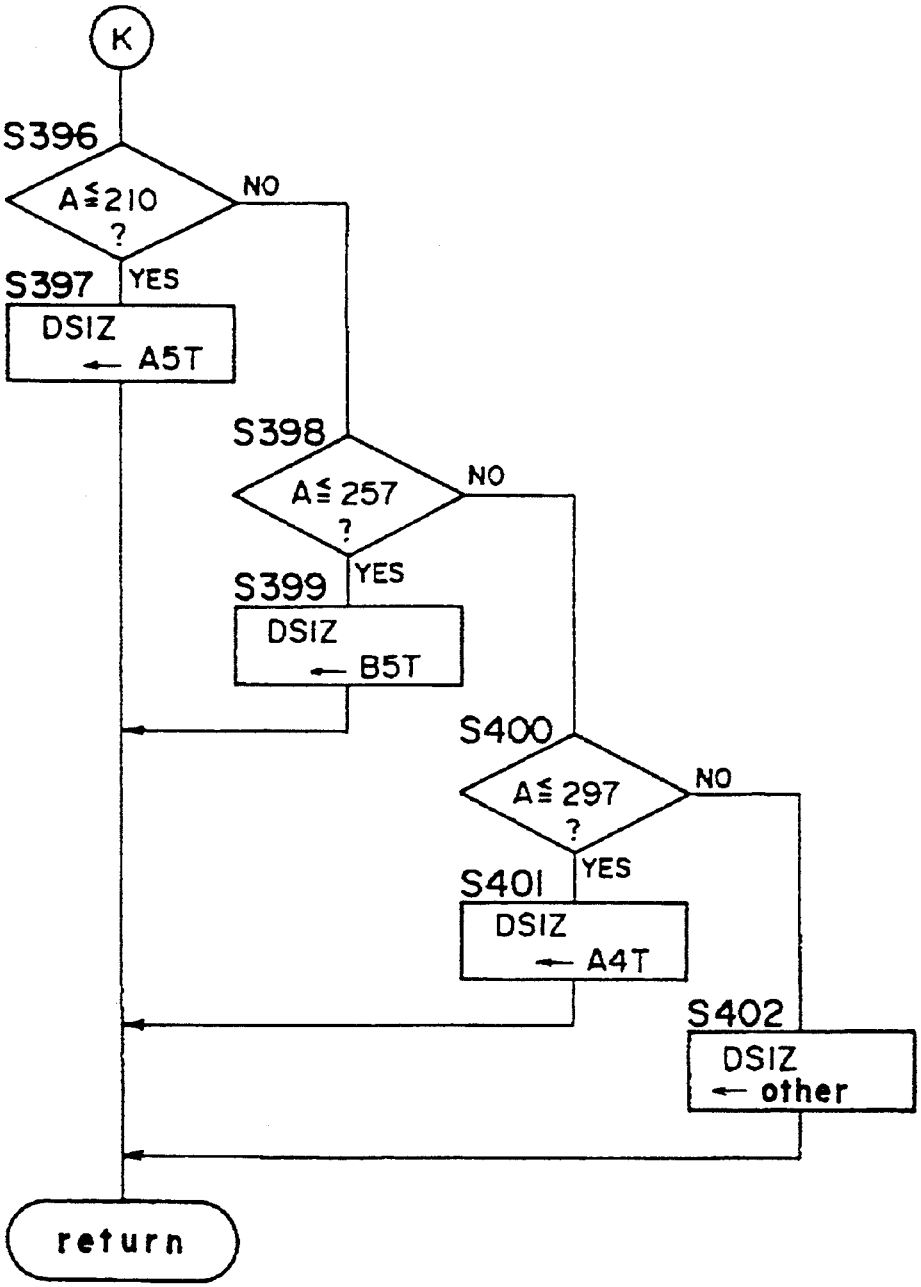

FIGS. 31–33 show the original document size detection subroutine executed in step S205.

In this subroutine, the size of the original document is determined based on the detection of the width of the original via the ON/OFF switching of the sensor SE13 and the detection of the length of the original via the ON/OFF switching of the sensor SE14. The sensor SE13 is positioned so as to detect originals which are B5Y, A4Y, B4T and A3T in size, but does not detect originals A5T, B5T and A4T in size.

First, a check is made in step S381 to determine whether or not the size detection flag (SDF) is set at 1. If the SDF has been reset at 0, the subroutine is immediately terminated. If the SDF is set at 1 (refer to steps S285, S304), the size detection flag is reset at 0 in step S382, and the sum of the SIZM1 and OVER1 values is set in the counter A in step S383. Then, the amount of movement $P_1$ per 1 pulse of the main motor M11 is multiplied by the value of counter A in step S384, and the new value is set in counter A. In this case, $AxP_1$ is equivalent to the length of the original document.

Next, the width flag (WF) is checked in step S385 to determine whether or not it is set at 1. If the width flag (WF) is set at 1 (refer to step S258), the routine moves to steps S386–S395, whereas if the WF is reset at 0 (refer to step S259), the routine advances to steps S396–S402, wherein the size of the original is respectively determined.

If the width flag is set at 1, the width flag is reset at 0 in step S386, and a check is made to determine whether or not the length of the original is a specific copy paper size in steps S387, S389, S391 and S393, respectively. That is, if the counter A value is 182 or less, A5Y is set as the size of the original in DSIZ in step S388. If the counter A value is 210 or less, A4Y is set as the size of the original in DSIZ in step S390. If the counter A value is 364 or less, B4T is set at the size of the original in DSIZ in step S392. If the counter A value is 420 or less, A3T is set at the size of the original in DSIZ in step S394. If the counter A value is larger than 420, "other" is set at the size of the original in DSIZ in step S395.

On the other hand, if the width flag has been reset at 0, a check is made to determine whether or not the length of the original is a specific copy paper size in steps S396, S398, and S400, respectively. That is, if the counter A value is 210 or less, A5T is set as the size of the original in DSIZ in step S397. If the counter A value is 257 or less, B5T is set as the size of the original in DSIZ in step S399. If the counter A value is 297 or less, A4T is set at the size of the original in DSIZ in step S401. If the counter A value is larger than 297, "other" is set at the size of the original in DSIZ in step S402.

Figure 34:
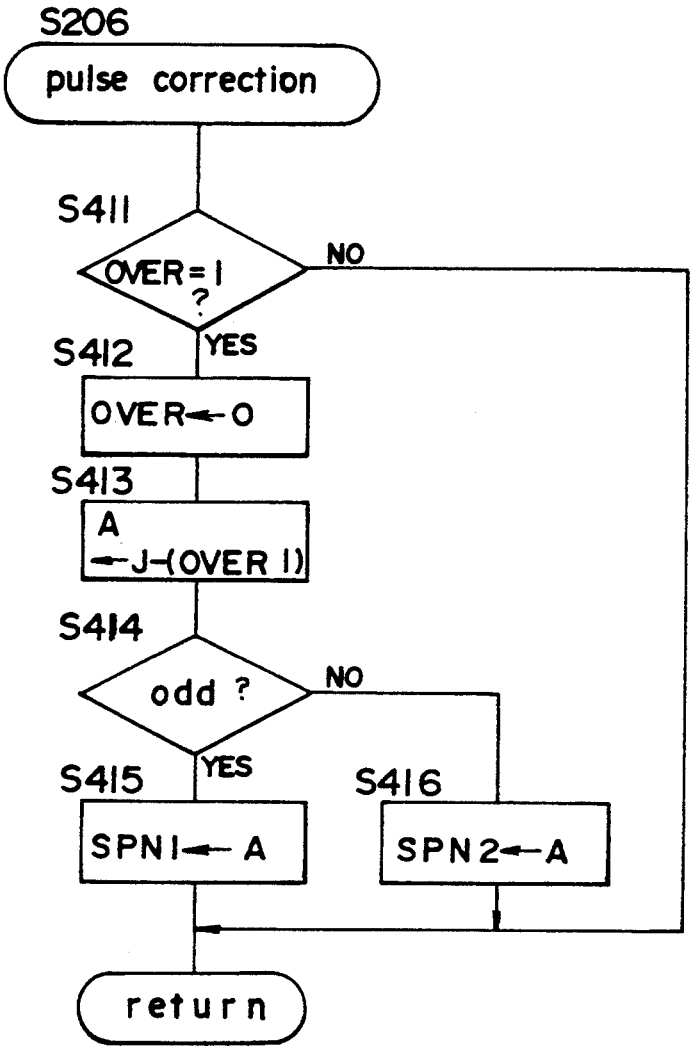

FIG. 34 shows the stop pulse correction subroutine executed in step S206.

This subroutine corrects the stop pulse number J with the amount of overrun (OVER1) to transport the original from the sensor SE14 detection point to the standard position 0.

First, a check is made in step S411 to determine whether or not the OVER flag is set at 1. If the OVER flag has been reset at 0, the subroutine is immediately terminated. If the OVER flag is set at 1 (refer to step S270), the OVER flag is reset at 0 in step S412, and the value OVER1 is subtracted from the predetermined pulse number J and set in the counter A in step S413. Thus, the stop pulse number J is corrected so as to stop the original at the standard position 0.

Then, a check is made to determine whether or not the original is an odd number in step S414. If it is an odd-numbered original, the counter A value is set as the stop pulse number 1 in step S415, whereas if it is an even-numbered original, the counter A value is set as the stop pulse number 2 in step S416.

Second Embodiment

Figure 35:
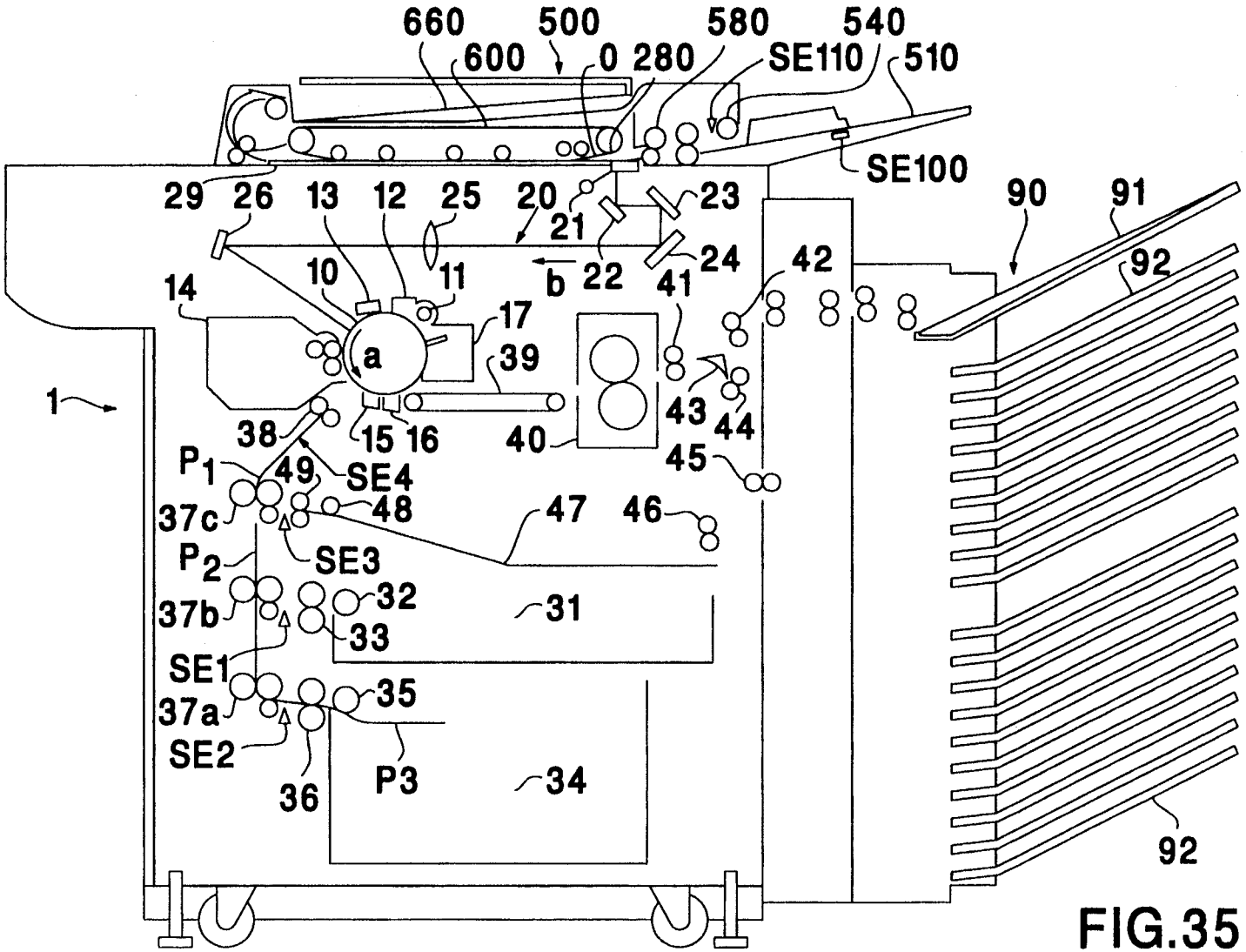

The copying apparatus shown in FIG. 35 comprises a main unit 1 and a sorter 90 which are identical to those of the first embodiment, and an ADF 500 which is of a different type than described in the first embodiment. Accordingly, the main unit 1 and the sorter 90 are omitted from the following description.

The ADF 500 is described hereinafter with reference to FIGS. 36–44.

Figure 36:
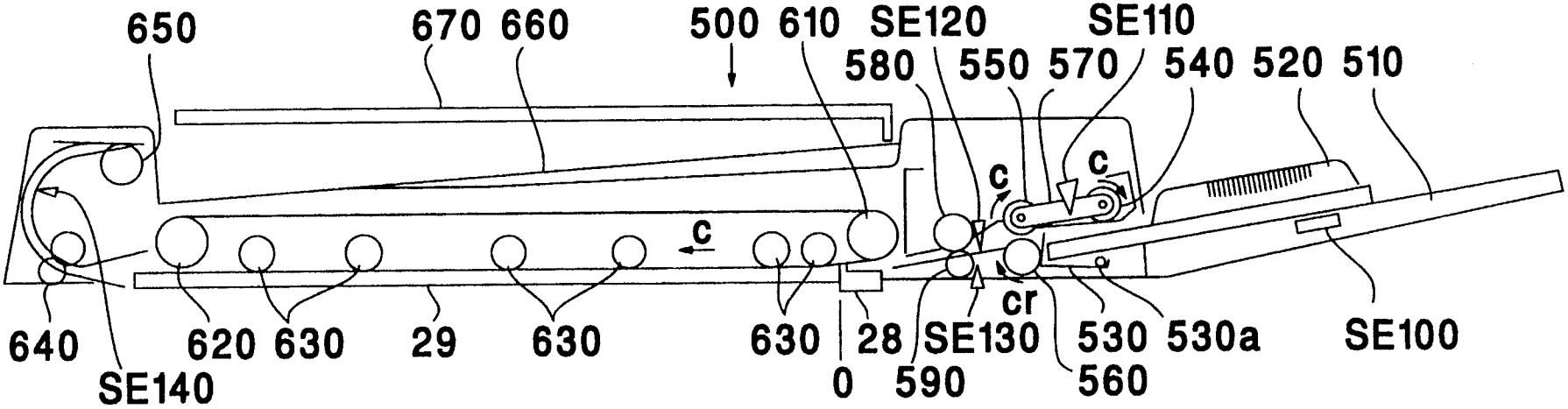

In FIG. 36, the ADF 500 briefly comprises an original document tray 510, pick-up roller 540, register rollers 580 and 590, transport belt 600, discharge rollers 640 and 650, and discharge tray 660. The ADF 500 is provided on the top surface of the copying apparatus main unit 1 such that the transport belt 600 is positioned above the platen glass 29, and is openable via an internal hinge fitting not shown in the drawing so as to expose the platen glass. The ADF 500 is raised upward whenever an operator manually places an original document on the platen glass 29. The opening/closing operation of the ADF 500 is detected by means of a magnetic sensor not shown in the drawing; the ADF 500 first becomes operable when its proper closure is detected by the aforesaid sensor.

The original document tray 510 is provided with a pair of side regulating panels 520 and a front end stopper 530. An original document is placed with the first page facing up on the tray 510. The front end stopper 530 swings downwardly on a pin 530*a* during the paper feeding operation so as to be retracted from the regulating position. The pick-up roller 540 is mounted at the front end of the rotatable lever 570 supported on the shaft of the forward handling roller 550, and during the feeding operation is lowered so as to press on the top surface of the original document. The reverse handling roller 560 applies a uniform contact force from below on the forward handling roller 550.

The register rollers 580 and 590 temporarily hold the fed original at the nip portion therebetween, and after a predetermined time transport the original to the entrance to the platen glass 29 by rotatably driving the top roller 580 in the arrow c direction. The bottom roller 590 is driven by the top roller 580.

The transport belt 600 is an endless belt stretched between the drive roller 610 and the driven roller 620 so as to cover the entire surface of the platen glass 29. A plurality of back-up rollers 630 are rotatably provided on the inner side of the transport belt 600 so as to press the belt 600 against the platen glass 29. The transport belt 600 is rotatably driven in the arrow c direction, and sets the original document so that the leading edge of said original document is aligned with the standard position 0 at the boundary of the scale 28 and the platen glass 29.

The platen glass 29 is of a sufficient size to allow two A4-size original documents to be placed side by side. Furthermore, the transport belt 60 is also of a sufficient size to allow simultaneous transporting of two A4-size original documents.

The discharge tray 660 is provided with an openable cover 670. An original disposed on the platen glass 29 is discharged form the platen glass 29 by the transport belt 600 which rotates in the arrow c direction, passes the discharge roller 640, and is deposited on the discharge tray 660 via the discharge roller 650.

The original document prefeed process of the ADF 500 is simply described hereinafter. The uppermost sheets in a stack of originals is fed via the pick-up roller 540, and separated one by one by the handling rollers 550 and 560 until the leading edge of the original abuts the nip portion of the register rollers 580 and 590, where said original waits in the aforesaid state. This process is termed the prefeed process. The prefeed process is executed immediately when an original is fed onto the platen glass 29 and set at a home position so as to reduce the time for exchanging originals.

The ADF 500 is provided with the original document detection sensors described hereinafter. The sensor SE100 is provided on the surface of the original document tray 510, and detects the presence of an original from below. The sensor SE110 is provided between the pick-up roller 540 and the forward handling roller 550, and detects the presence of an original on the tray 510 from above the front end of the tray 510. The sensor SE100 is provided to detect a third original for the purpose of increasing the copy speed equal to the multi-copy mode when the ADF 500 is used for copying in the single copy mode.

In the previously described copying apparatus main unit 1, three copy papers $P_1$, $P_2$ and $P_3$ can be fed to the feed path if the copy paper fed from the lower feeder 34 is A4Y size (Y indicates horizontal feed wherein the short side of the original is parallel to the transport direction) or B5Y size. Therefore, it is necessary to detect not only a first original set at the standard position on the platen glass 29 and a pre-fed second original, but also a third original disposed on the tray 510. The second original is detected by the sensor SE110. In the present embodiment, the sensor SE100 is provided on the tray 510 to detect a third original.

Figure 37:
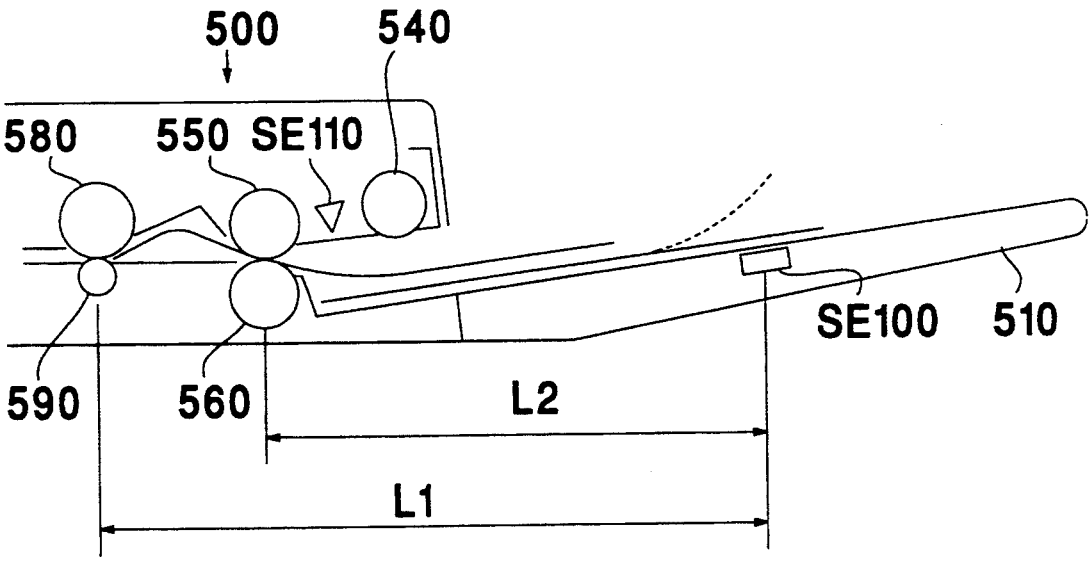

The state of the original document set on the tray 510 is not necessarily limited to a normal state, inasmuch as a curled state and folded state as indicated by the dashed line in FIG. 37 may be anticipated. In the case where abnormal originals are placed on the tray 510, they may not be detected by the sensor SE100. When the copy paper prefeed process is controlled by the main unit 1 using only the detection signals from the sensor SE100, the copy paper prefeed process may not be executed due to erroneous operation (when a present original is undetectable) of the sensor SE100, thereby causing the copy process to end. In spite of the presence of the original, however, a copy operation for said original is not subsequently executed, which is a decided disadvantage. In the present embodiment, even if the sensor SE100 fails, an original detection signal is generated by the sensor SE110, and the copy paper prefeed process is started by the main unit 1 immediately thereafter so as to continue the copying process. The disadvantage of a terminated copy process caused by a failure of the third sheet detecting sensor SE100 is eliminated by the aforesaid control.

Furthermore, even when an original document is not placed on the sensor SE100, said sensor SE100 may determine that an original is present due to the placement of a paper fragment, an operator's hand, external optical influences or the like. The aforesaid type of detection error by the sensor SE100 causes a copy paper to be fed for said nonexistent original, such that a copy paper sheet is lodged in the main paper feed path. A disadvantageous result of this situation is that the paper jam detecting means is caused to operate, thereby stopping the copy operation.

In the present embodiment, if and original disposed on the tray 510 is pre-fed to the register rollers 580 and 590 and detected at that moment by the sensor SE100, i.e., if the feeding of a copy paper (prefeed process) for said original is possible, a copy paper is fed. If the sensor SE110 does not detect an original while a pre-fed original is being fed to the home position on the platen glass 29, and if a copy paper has already been fed, the copy paper is discharged to the tray 91 of the sorter 90 without undergoing the copying operation. The paper feed operation is controlled such that if a copy paper is not still being fed, a paper feed operation is not executed.

The aforesaid control allows for an uninterrupted copy process and efficient use even if the sensor SE100 produces a detection error and a third original is not present.

The sensor SE100 is desirably provided at a position fulfilling the conditions below, so as to reliably detect a third original. When, as shown in FIG. 37, the distance from the sensor SE100 detection point to the nip portion of the register rollers 580 and 590 is $L_1$, the distance from the sensor SE100 detection point to the nip portion of the register rollers 550 and 560 is $L_2$, and among the original document sizes that are transportable two or more simultaneously by the transport belt 600, the length in the transport direction of the maximum size is $l_1$, and the length in the transport direction of the minimum size is $l_2$, the following conditions are required:

$$L_1 < l_1$$

$$L_2 < l_2$$

The maximum and minimum sizes of an original document is equivalent to the maximum and minimum sizes of paper that can be used in the prefeed process for the third sheet $P_3$ fed from the lower feeder 34 to the copy paper feed path. The aforesaid paper sizes are equivalent to the maximum and minimum sizes for paper that can be used in the prefeed process for the second sheet $P_2$ fed from the upper feeder 31 to the copy paper feed path.

In the present embodiment, $l_1$ is the length of the short side of an A4Y size sheet (Y indicates horizontal feed wherein the short side of the original is parallel to the transport direction), and $l_2$ is equivalent to the short side of a B5Y size sheet. Accordingly, the sensor SE100 can detect the original when an A4Y or B5Y size original is set on the tray 510, and can detect the presence of a next original when an A4Y or B5Y original has been prefeed to the nip portion of the register rollers 580 and 590.

If A4Y or B5Y size paper is fed from the upper feeder 31, two sheets can be fed to the paper feed path.

The upper feeder 31 and the lower feeder 34 determine whether or not copy paper shall be pre-fed in accordance with the detection state of the sensors SE100 and SE110. For example, in the state described in FIG. 41c, a first copy paper is fed by the timing roller 38 so as to be synchronized with the image exposure of the first original. At this time, a second original is already detected by the sensor SE110, and a third original is detected by the sensor SE100. Either the upper feeder 31 or the lower feeder 34 prefeeds a copy paper for the second original to the position of the timing roller 38, then prefeeds a copy paper for the third original.

When N copies are made of a plurality of originals, the upper feeder 31 feeds N copy sheets for the first original. The $(N+1)^{th}$ copy sheet, i.e., the first copy sheet corresponding to the second original, is pre-fed while the $N^{th}$ copy sheet is waiting at the timing roller 38 because the presence of a second original is already detected. Thus, an interruption of the copying process is prevented between the copy operation for the first original and the copy operation for the second original. Furthermore, the $(2N+1)^{th}$ copy sheet, i.e, the first copy sheet corresponding to the third original, is pre-fed while the $2N^{th}$ copy sheet is waiting at the timing roller 38 because the presence of a third original is already detected. Thus, an interruption of the copying process is prevented between the copy operation for the second original and the copy operation for the third original. The method described above is even more remarkably effective when the originals are exchanged frequently, i.e, when $N=1$. Furthermore, when the lower feeder 34 is selected and the $(2N-1)^{th}$ copy sheet and the $2N^{th}$ copy sheet are pre-fed, the $(2N+1)^{th}$ copy sheet is also pre-fed.

The sensor SE120 is positioned immediately in front of the nip portion of the register rollers 580 and 590. The sensor SE120 is turned ON by the leading end and turned OFF by the trailing end of the original, and has the role of detecting the length of the original as described below.

The sensor SE130 has the role of detecting the size of the original in the width direction.

The sensor SE140 is positioned in the original discharge path and detects the originals discharged from the platen glass 29.

In the ADF 500, the drive force is accomplished via a single motor, solenoids and clutches.

That is, the pick-up roller 540, handling rollers 550 and 560, register roller 580, and transport belt 600 are driven by a main motor M110 which is capable of forward and reverse rotation, whereas the discharge rollers 640 and 650 are driven by the discharge motor M120. While paper is fed, the pick-up roller 540 and handling rollers 550 and 560 driven in forward rotation by the main motor M110. On the other hand, the register roller 580 and transport belt 600 are driven in reverse rotation by the main motor M110 each time an original is fed onto the platen glass 29. The drive system will be fully described later.

The pick-up roller 540 and the front end stopper 530 are constructed so as to be linkable via the ON/OFF switching of the solenoid SL110. That is, when the solenoid SL110 is turned ON, the pick-up roller 540 is lowered so as to press against the original, and the front end stopper 530 swings downwardly on a shaft **530*a* so as to permit the passage of the original. Conversely, when the solenoid Sl110 is turned OFF, the pick-up roller 540 is raised to release the pressure on the original, and the front end stopper 530** is returned to the standard position.

The main motor M110 is provided with a decoder that generates a rotation pulse signal used in detecting the number of rotations of said motor. The pulse signal is input to the EV1 of the microcomputer CPU2. The pulse signal is used to detect the length of the original and in the process for setting the original at the standard position. Furthermore, the OFF edge signal of the sensor SE120 is input to the INT1 of the CPU2 for the interrupt process.

Figure 38:
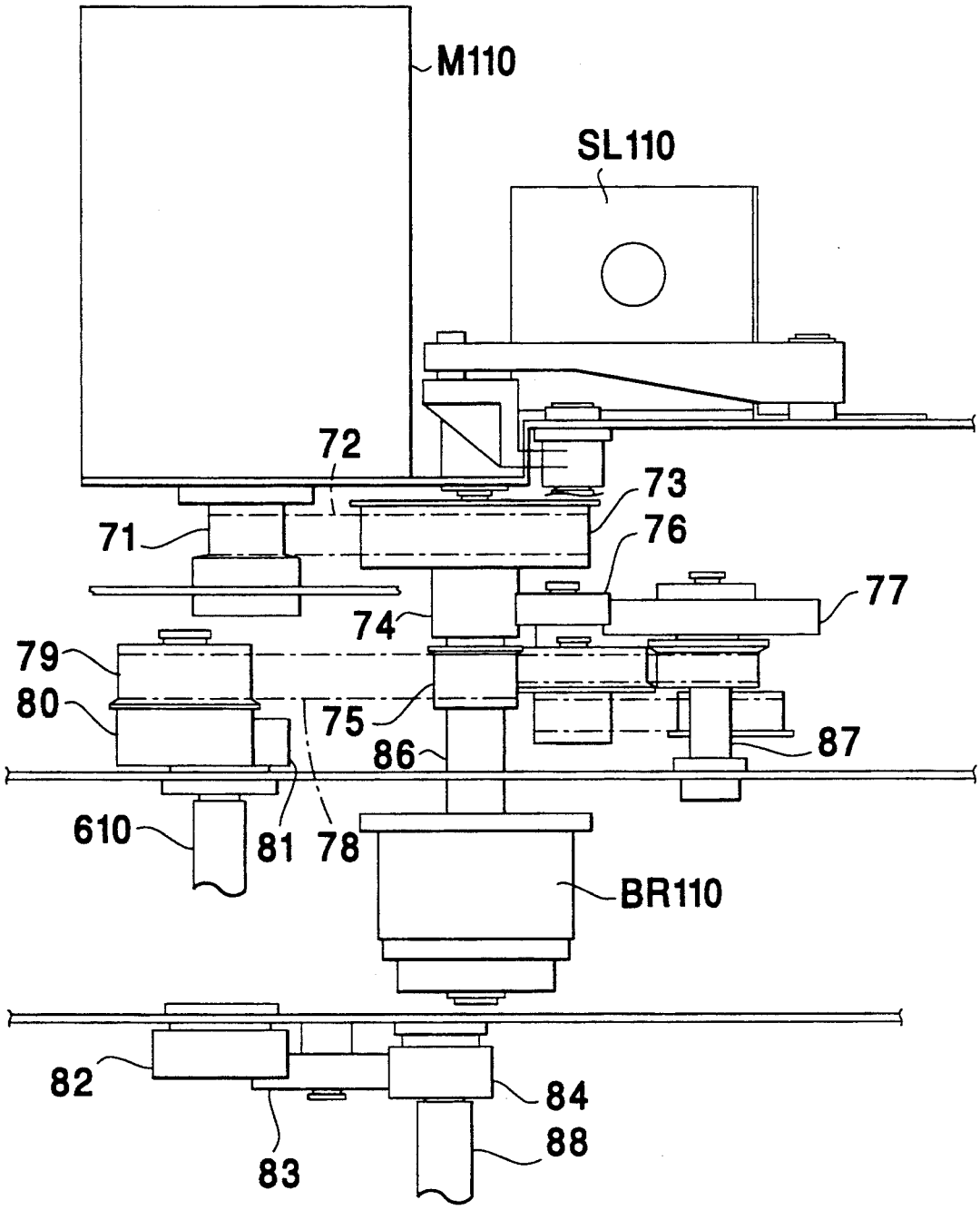
Figure 39A:
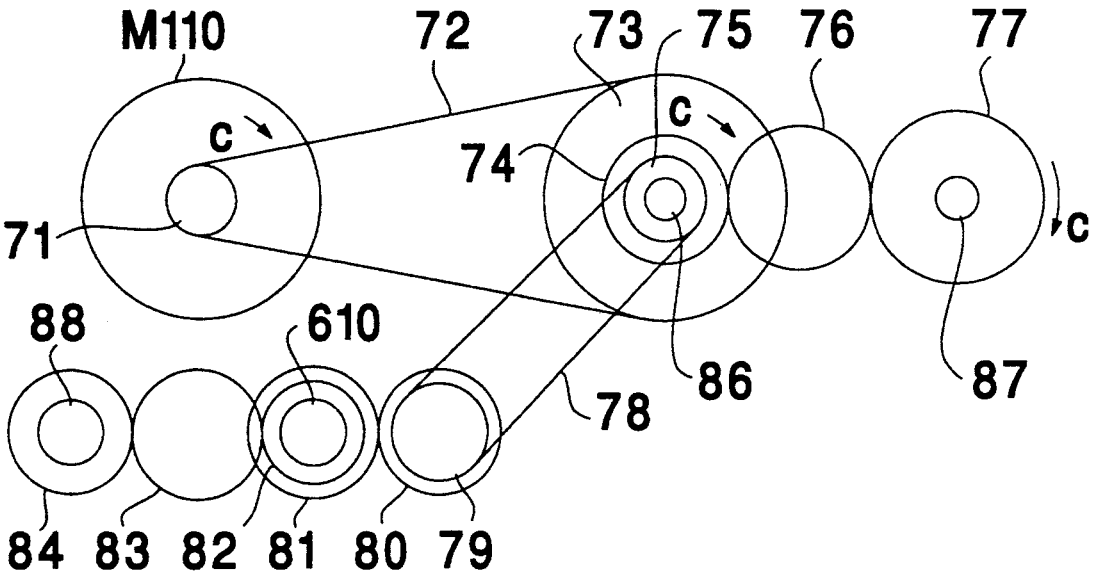

The drive system of the main motor M110 is described hereinafter with reference to FIGS. 38 and 39.

The output pulley 71 of the main motor M110 is connected to the pulley 73 attached to the shaft 86 via a timing belt 72. A gear 74, which is integratedly formed with the pulley 73, is connected to the gear 77 via a gear 76, said gear 77 being attached to a shaft 87. The gear 77 forward rotates the pick-up roller 540, and forward and reverse rotates the forward handling roller 550 and reverse handling roller, respectively. A pulley 75 is fixedly mounted to the shaft 86, said pulley 75 being connected to a pulley 79 via a timing belt 78. The pulley 79 is integratedly formed with a gear 80, said gear 80 being connected to a gear 81 fixedly mounted on a drive shaft 610. A gear 82 is fixedly attached to the belt drive shaft 610, said gear 82 being connected to a gear 84 mounted on a shaft 88 of the register roller 580 via a gear 83.

One-way clutches are interposed between the pulley 73 and shaft 86 and between the gear 77 and shaft 87, so as to regulate the ON/OFF application of the drive force as described below.

That is, when feeding an original, the main motor M110 is rotatably driven in the forward direction, i.e., the arrow c direction, as shown in FIG. **39*a*. The aforesaid rotation of the main motor M110 causes the pulley 73 to rotate in the arrow c direction via the timing belt 72, and causes the gear 77 to rotate in the arrow c direction via the gears 74 and 76, and further causes the shaft 87 and pick-up roller 540 to rotate in the arrow c direction, and causes the forward handling roller 550 and reverse handling roller 560 be forward rotated and reverse rotated, respectively. The one-way clutch, which is built in the pulley 73, allows free rotation of the pulley 73 of the shaft 86 in the arrow c direction. Accordingly, the rotation of the pulley 73 in the arrow c direction is not transmitted to the shaft 86 and, therefore, does not rotatably drive the register roller 580 and the transport belt 600** during the feeding operation.

Figure 39B:
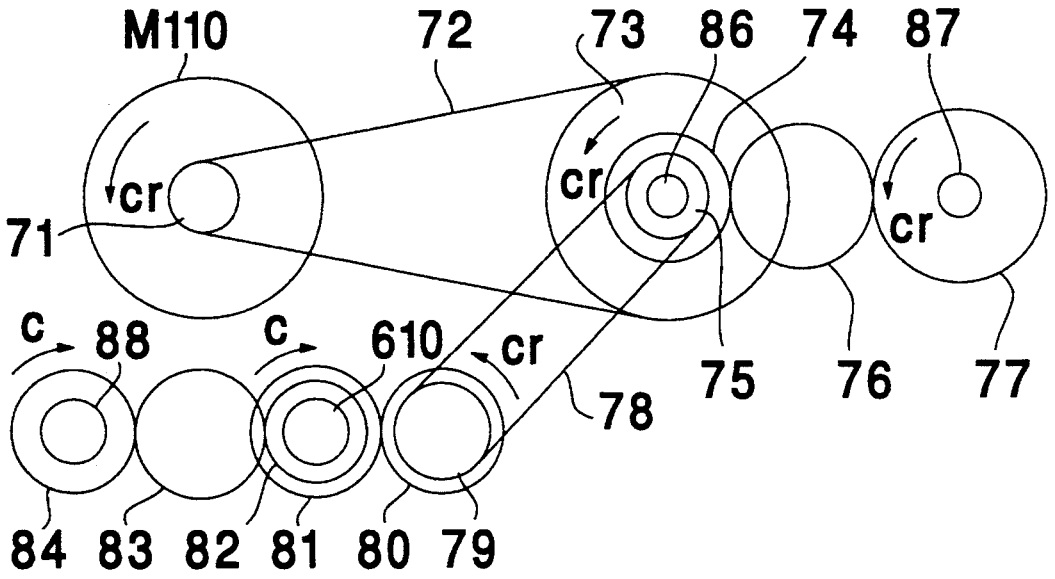

On the other hand, when an original is transported onto the platen glass 29, the main motor M110 is reversely rotated in the arrow cr direction, as shown in FIG. 39b. This rotation is transmitted through the pulley 75 and the timing belt 78 to the pulley 79, then is transmitted to the belt drive shaft 61 through the gears 80 and 81 to forward rotate the transport belt 600 in the arrow c direction, then is transmitted to the shaft 88 through the gears 82, 83 and 84 to forward rotate the register roller 580 in the arrow c direction. The rotation of the pulley 73 in the arrow cr direction is transmitted through the gear 76 and causes the gear 77 to rotate in the arrow cr direction. However, the one-way clutch built in the gear 77 allows free rotation of the gear 77 of shaft 87 in the arrow cr direction. Accordingly, the rotation of the gear 77 in the arrow cr direction is not transmitted to the shaft 87 and, therefore, does not rotatably drive the pick-up roller 540 and handling rollers 550 and 560 during original transport.

The original document feeding and transporting process of the ADF 500 are described hereinafter.

Original documents are placed face downward on the tray 510, both sides of the originals are regulated by the side regulating panels 520, and the leading end of the original is regulated by the stopper 530. The originals are a set of four sheets, designated as $D_1$, $D_2$, $D_3$, and $D_4$, listed from the top downward (refer to FIG. 41*a*. When the originals are detected by the sensor SE100, the copy process (original document feed process) is enabled. When an operator turns ON the print key, the solenoid SL110 is turned ON, the pick-up roller 540 is lowered onto the original $D_1$, and the stopper 530 is retracted. At the same time, the main motor M110 is forward rotated in the arrow c direction, and a first original $D_1$ is separated from the stack via the rotation of the rollers 550 and 560, such that said original is fed between said rollers 550 and 560 until the leading end of said original abuts the nip portion of the register rollers 580 and 590. A fixed time after the leading end of the original $D_1$ is detected by the sensor SE120, the leading end of the original $D_1$ forms somewhat of a loop just in front of the register rollers 58 and 59 (refer to FIG. 41*b*), the main motor M110 is turned OFF and the rotation of the rollers 540, 550 and 560 stops. At the same time, the solenoid SL110 is turned OFF, the pick-up roller 540 is raised and the stopper 530 is returned to the regulating position.

Then, the main motor M110 is reversely rotated in the arrow cr direction, the original $D_1$ begins to be advanced to the entrance to the platen glass 29 in conjunction with the rotation of the register rollers 580 and 590. Although the handling roller 550 applies some resistance on the transport of the original $D_1$, such feed resistance is reduced by the free rotation of the handling roller 550 in the arrow c direction via the operation of the one-way clutch built in the aforesaid gear 77 as previously described. The transport belt 600 is rotated in the arrow c direction via the reverse rotation of the main motor M110, and the original $D_1$ is advanced from the register rollers 580 and 590 onto the platen glass 29.

The main motor M110 is turned OFF a fixed time after the trailing end of the original $D_1$ has been detected by the sensor SE120, i.e., when the trailing end of the original $D_1$ has reached the standard position 0. Thus, the original $D_1$ is set at the standard position 0. During the time an original is being fed, the pulse signal generated by the main motor M110 is input to the CPU2, and the length of the original $D_1$ is detected by the number of pulses generated from the start of reverse rotation of the main motor M110 until the trailing end of the original $D_1$ is detected by the sensor SE120. Furthermore, the width of the original $D_1$ is detected by the original passing the detection point of the sensor SE130. Thus, the size of the original $D_1$ is determined by combining both the aforesaid detection results. The stopping of the original $D_1$ at the standard position is also controlled by controlling the number of drive pulses of the main motor M110.

The optical unit 20 executes an image scan of the aforesaid original $D_1$. During the aforesaid scan, the main motor M110 is forward rotated, and the second original $D_2$ is pre-fed to the nip portion of the register rollers 580 and 590 (refer to FIG. 41*c*).

When the leading end of the original $D_2$ impinges the register rollers 580 and 590, the register roller 580 is rotated in the arrow c direction, and there is concern that said rotation in the arrow c direction may be communicated to the transport belt 600 via the belt drive shaft 610 which is connected to the register roller 580 through the previously described gear group. A disadvantage in such a case is that the stopping position of the original $D_1$ is a position other than the standard position 0, and a copy is produced which lacks the leading end of the image. In order to prevent the aforesaid disadvantage in the present embodiment, an electromagnetic brake BR110 is provided on the shaft 86 so as to lock said shaft 86, as shown in FIG. 38. The result of the aforesaid arrangement is that there is no rotation of the register roller 580 or belt drive shaft 86 caused by the impact with the leading end of the pre-fed original, thereby preventing any dislocation of the original during the scanning operation.

Figure 40:
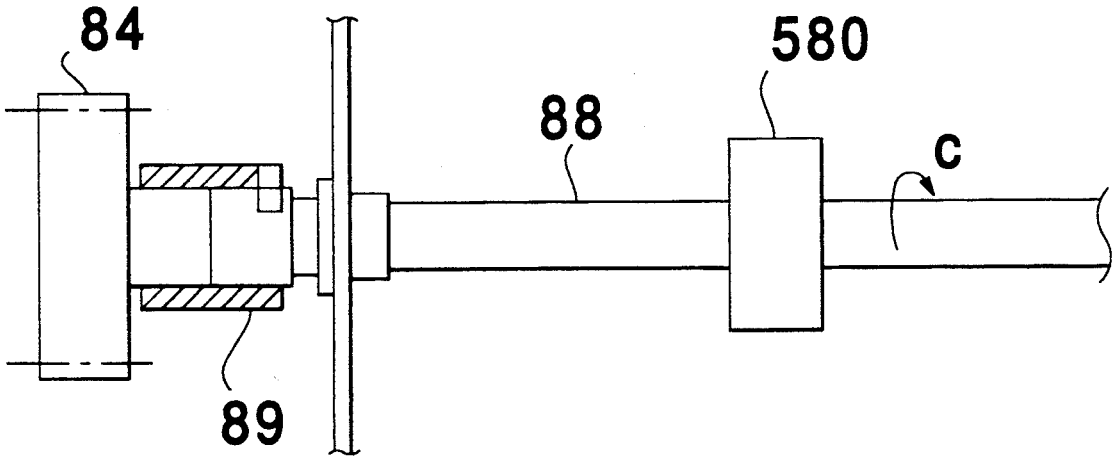
Figure 41A:
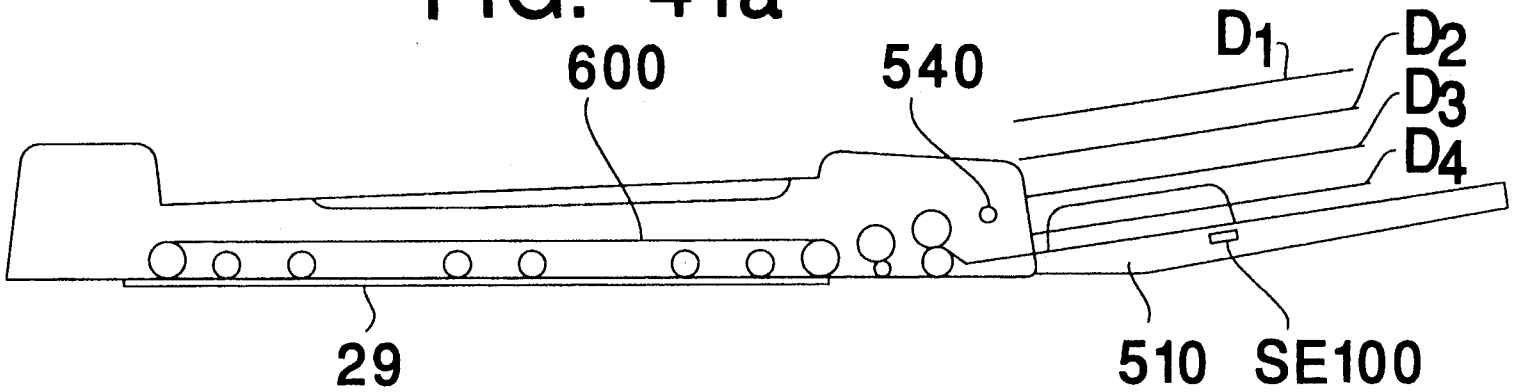
FIGS. 41*a–d* are illustrations showing the step feed mode operation of the ADF.
Figure 41B:
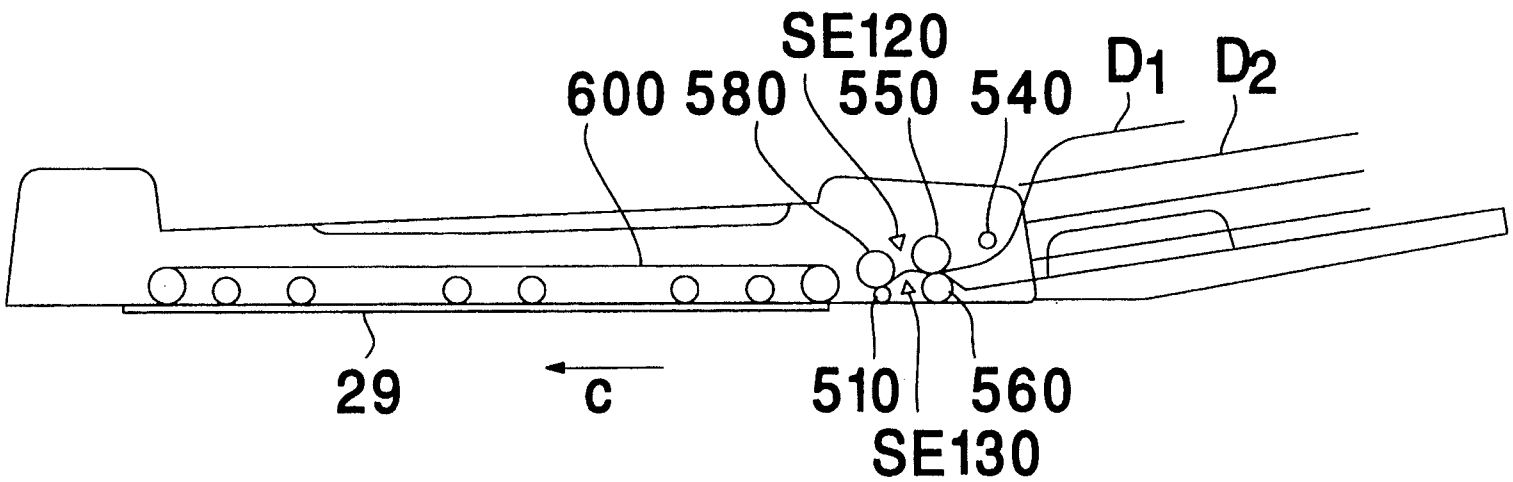
Figure 41C:
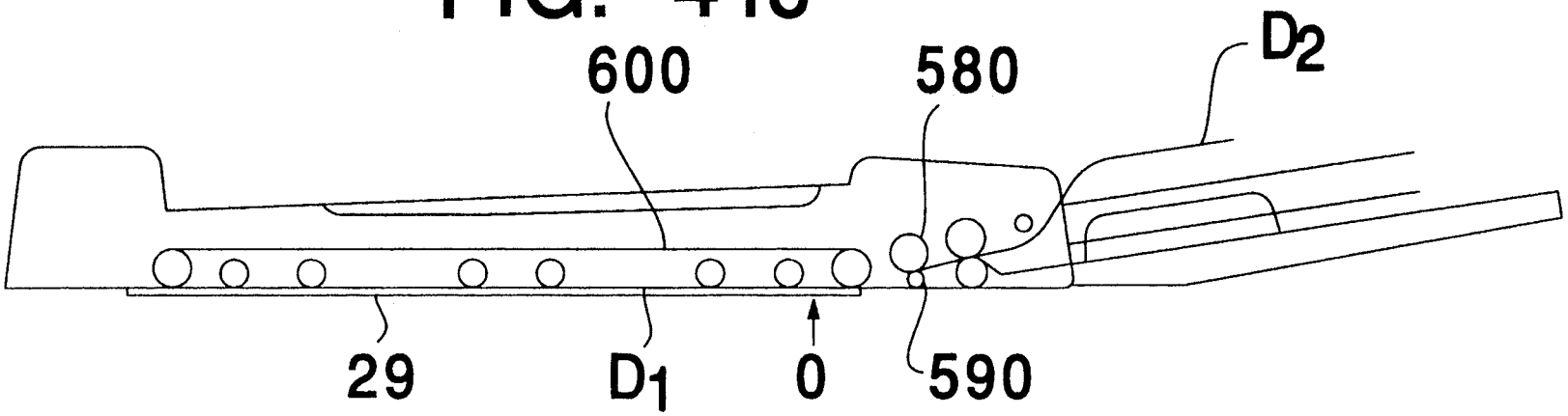
Figure 41D:
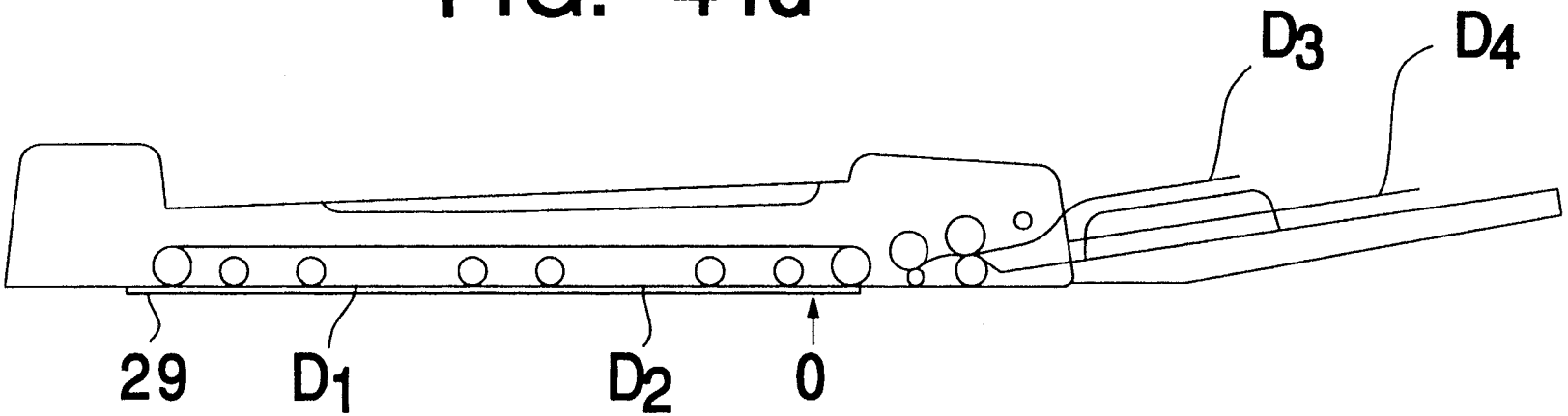

The mechanism for preventing the aforesaid disadvantage alternatively may provide a kickspring 89 medially between the shaft 88 of the register roller 580 and the gear 84, as shown in FIG. 40, instead of the electromagnetic brake BR110 provided on the shaft 86. The kickspring 89 transmits the rotational force to the shaft 88 when the gear 84 is rotated in the arrow c direction, and said shaft 88 independently idles when rotation is in the arrow c direction. Accordingly, when the leading end of an original impinges the nip portion between the register rollers 580 and 590, the rotation of the shaft 88 in the arrow c direction is absorbed by the kickspring 89, such that the belt drive shaft 610 and the transport belt 600 are not rotated.

When the image scan of the original $D_1$ is completed, the main motor M110 is reversely driven so as to feed the original $D_1$ to the downstream side of the platen glass 29. The original $D_2$ is fed onto the platen 29 synchronously with the aforesaid movement of the original $D_1$, and the main motor M110 is turned OFF at the moment the trailing end of the original $D_2$ reaches the standard position 0. Then, the image scan of the original $D_2$ is started, and the third original $D_3$ is pre-fed (refer to FIG. 41*d*). The platen glass 29 is equivalent to size A3T. Therefore, when the size of an original is 210 mm or less in the feed direction (A4Y size), the original $D_1$ os positioned on the downstream side of the platen glass 29 when the original $D_1$ is set at the standard position 0. Then, the original $D_1$ is gripped by the discharge rollers 640 when the original $D_3$ is fed onto the platen glass 29, and said original $D_1$ passes the rollers 640 and 650 to be discharge to the tray 660. The discharge motor M120 is controlled independently of the main motor M110, and is turned OFF a fixed time after the trailing end of the original $D_1$ is detected by the sensor SE140. During the original discharge, the discharge motor M120 is slowed before the trailing end of the original passes through the discharge rollers 650. This arrangement allows the originals to be accommodated in the discharge tray 660 with better alignment.

Figure 42A:
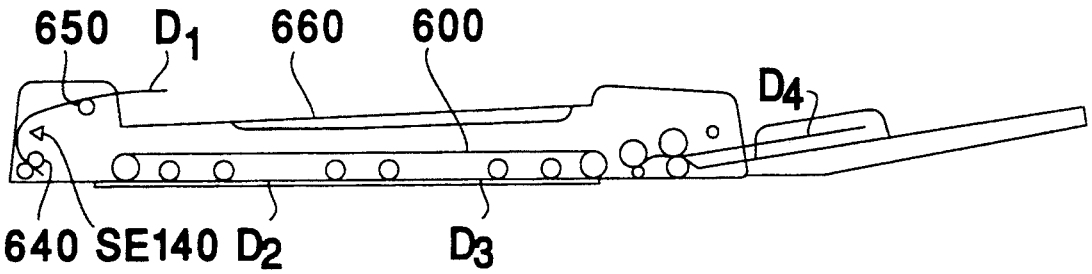
FIGS. 42*a–c* are continuations of FIGS. 41*a–d* showing the step feed mode operation of the ADF.
Figure 42B:
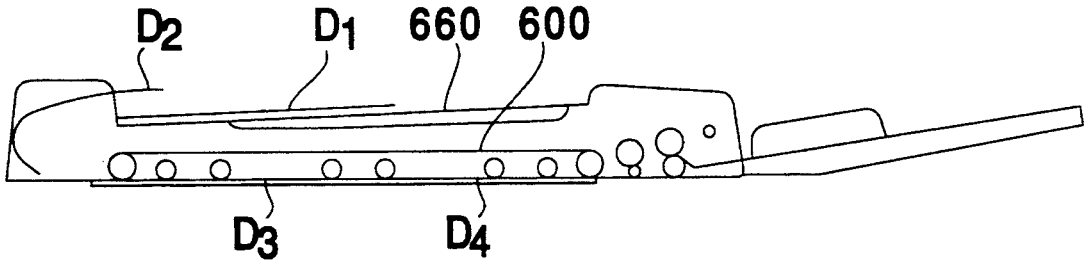
Figure 42C:
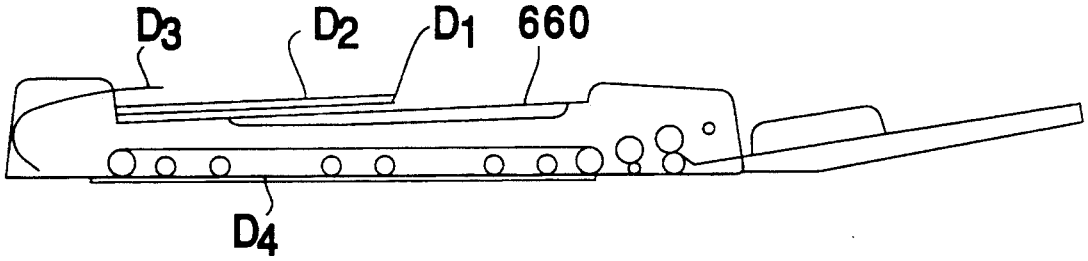

Thereafter, the original document feed, transport and discharge processes are repeated in the same manner as described above. FIG. 42*a* shows the state during the scanning of the original $D_3$, when the original $D_4$ is pre-fed. FIG. 42*b* shows the state during the scanning of the original $D_4$, and FIG. 42*c* shows the state of the discharged originals $D_3$ and $D_4$, when there are no subsequent originals.

On the other hand, when the size of the original is larger than 210 mm in the feed direction (larger than A4Y size), the leading end of the original $D_1$ arrives at the discharge roller 640 before the trailing end of the original $D_2$ arrives at the standard position 0, and the discharge motor M120 is driven to discharge the original $D_1$ as is to the tray 660. The aforesaid original transport process is termed the normal mode.

Figure 43A:
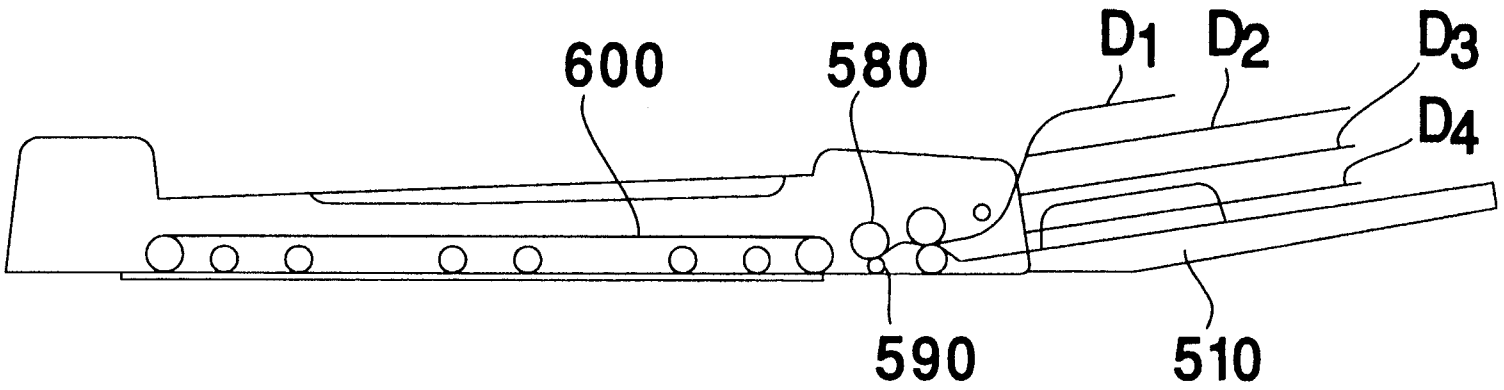
FIGS. 43*a–d* are illustrations showing the two-in-one mode of the ADF.
Figure 43B:
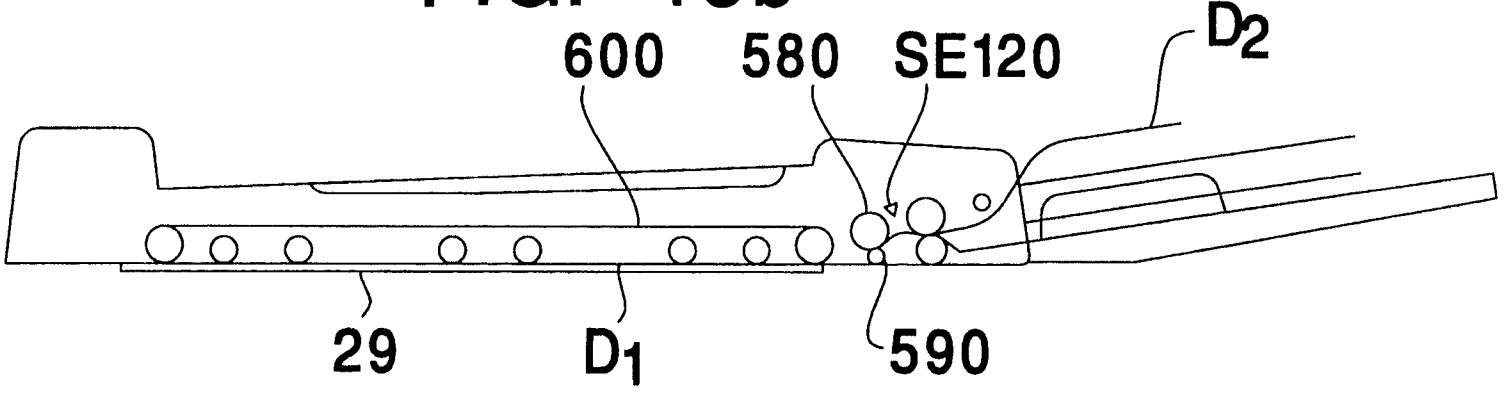
Figure 43C:
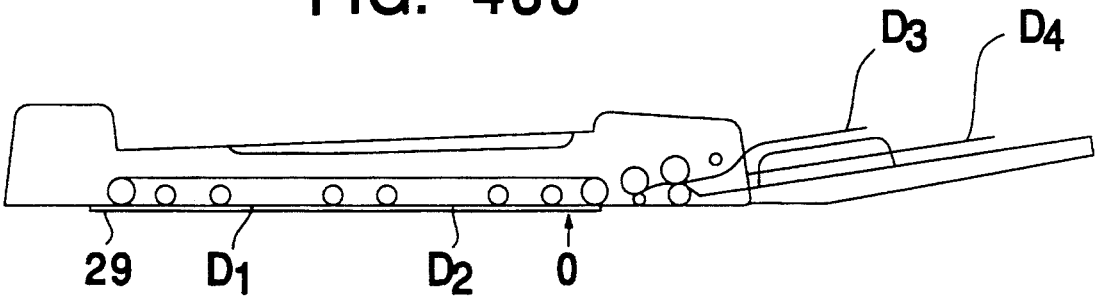
Figure 43D:
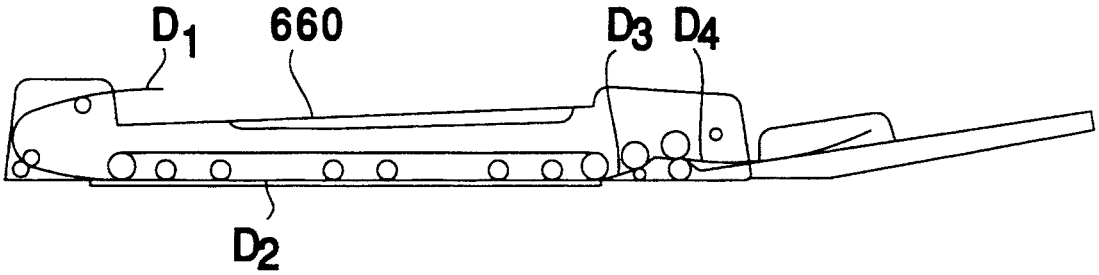
Figure 44A:
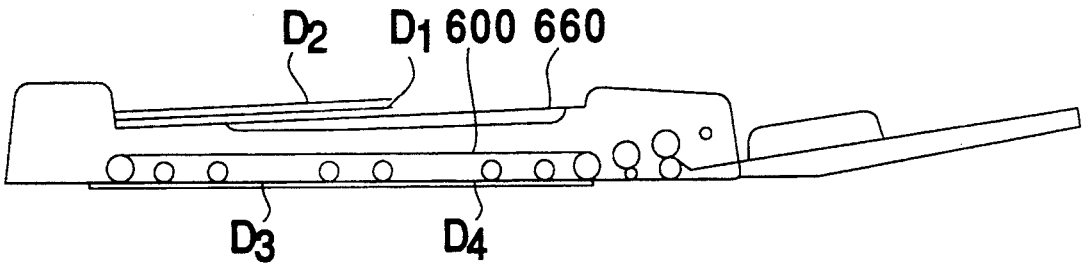
FIGS. 44*a–c* are continuations of FIGS. 43 showing the two-in-one mode of the ADF.
Figure 44B:
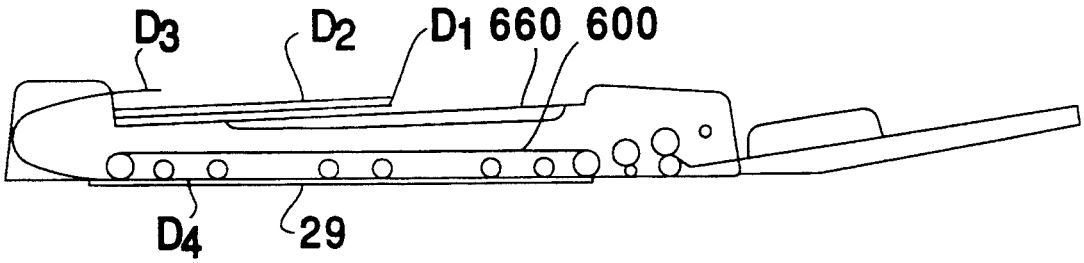
Figure 44C:
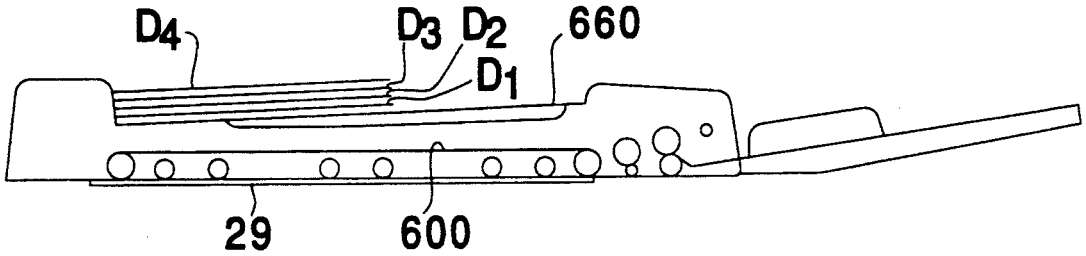
Figure 45:
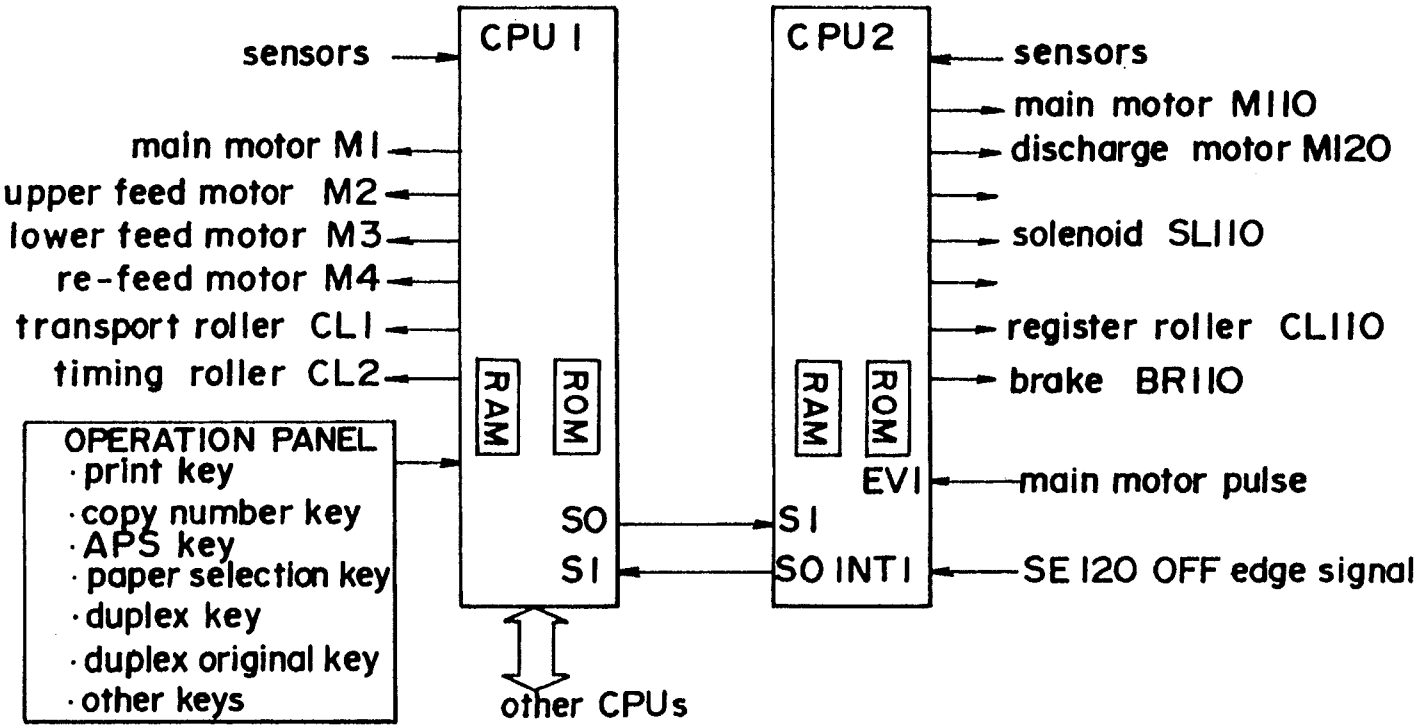

FIGS. 43 and 44 show the operation of the ADF 500 in the two-in-one mode.

The two-in-one mode is the original transport mode wherein two originals are fed simultaneously onto the platen glass 29 so as to be placed side by side thereon in the transport direction to copy the images of both originals onto a single copy paper.

First, the original $D_1$ is fed to the register rollers 580 and 590 via the forward rotation of the main motor M110, and said main motor M110 is turned OFF after the leading end of the original is properly aligned (refer to FIG. 43*a*). Thereafter, the main motor M110 is reversely rotated, then turned OFF a fixed time after the trailing end of the original $D_1$ is detected by the sensor SE120. At this time, the trailing end of the original $D_1$ is positioned at the exit side of the nip portion of register rollers 580 and 590.

Next, the main motor M110 is forward rotated to feed the original $D_2$, and the leading end of the original $D_2$ is properly aligned with the nip portion of the register rollers 580 and 590 (refer to FIG. 43*b*). Thus, the two originals $D_1$ and $D_2$ are arranged side by side between the register rollers 580 and 590. The main motor M110 is switched to reverse rotation, and the originals $D_1$ and $D_2$ are fed onto the platen glass 29. The main motor M110 is turned OFF a fixed time after the trailing end of the read original $D_2$ is detected by the sensor SE120. Therefore, the two originals $D_1$ and $D_2$ are properly aligned on the platen glass 29 so as to be in a state wherein the trailing end of the original $D_2$ is aligned with the standard position 0. In this state, the image scan is started, while a third original $D_3$ is simultaneously pre-fed (refer to FIG. 43*c*). The control for stopping the original $D_1$ immediately behind the nip portion of register rollers 580 and 590 and the control for stopping the originals $D_1$ and $D_2$ at the standard position 0 are accomplished by controlling the number of drive pulses of the main motor M110.

After the scanning of the originals $D_1$ and $D_2$ is completed, the main motor M110 is reversely rotated, and the original $D_1$ is discharged to the tray 660 while the original $D_3$ is fed immediately behind the register rollers 580 and 590. The feed process for the originals $D_3$ and $D_4$ is identical to that for the originals $D_1$ and $D_2$, and the originals $D_3$ and $D_4$ are arranged side by side at the nip portion of the register rollers 580 and 590 (refer to FIG. 43*d*). Then, the main motor M110 is switched to reverse rotation, and the originals $D_3$ and $D_4$ are properly aligned on the platen glass 29, and the original $D_2$ is discharged to tray 660 (refer to FIG. 42*c*).

Thereafter, the original document feed, transport and discharge processes for the remaining originals in tray 510 are repeated in the previously described manner. FIG. 44*b* shows the state wherein the original $D_3$ is discharged, and FIG. 44*b* shows the state wherein the original $D_4$ is discharged. In the case of an odd number of originals, the normal mode is executed for the single final original. Furthermore, when the originals are of mixed sizes with some larger than A4Y, the large size originals are placed singly on the platen glass 29.

In the previously described two-in-one mode, when two originals are set on the glass platen 29 and a subsequent original is detected, the main motor M110 is forward rotated and the subsequent original is pre-fed to the register rollers 580 and 590. Thus, the time is shorted during which a next original is fed onto the platen glass 29 after the end of scanning of a previous original without enlarging the feed spacing for originals, and copying speed is thereby improved. Furthermore, the time required for exchanging originals is shortened because subsequent originals are pre-fed onto the glass platen 29 at the same time the previously scanned originals are discharged (with timing simultaneous with the start of discharge or at least earlier than the completion of discharge), thereby improving copying speed.

The control sequence of the copying apparatus is described hereinafter.

The processes executed by the CPU1 and CPU2 in the present embodiment have many elements in common with the processes described in the first embodiment. Therefore, descriptions of the common elements are omitted from the following description.

Figure 46:
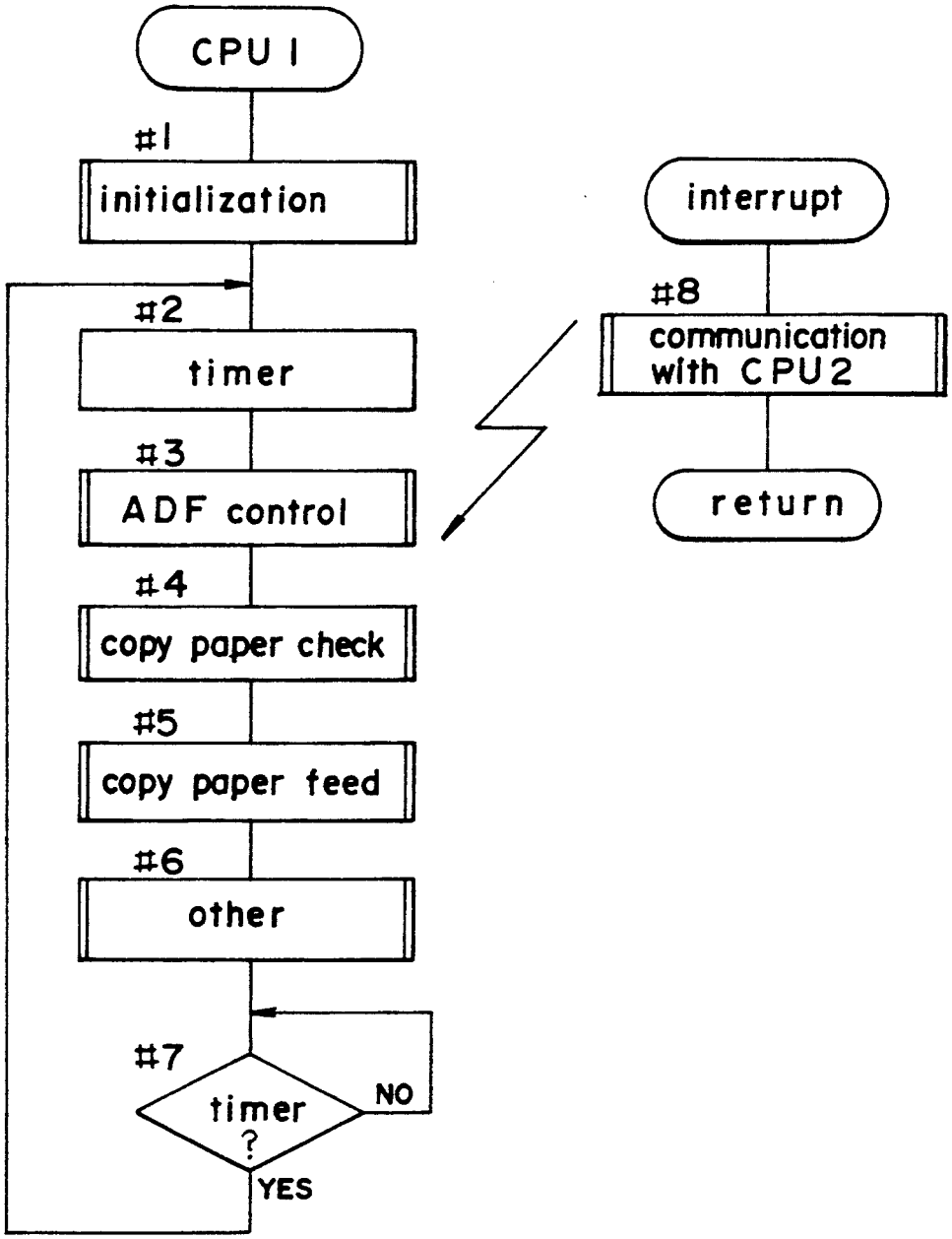

FIG. 46 shows the main routine of the CPU1.

When the power source is turned ON, the CPU1 is reset and the program starts, and in step #1 initialization is executed to clear the random access memory (RAM), reset the various registers, and set the initial modes for the various types of components. An internal timer determines the time required for one routine of the main routine, and the value set in said timer is set in step #1. Furthermore, the aforesaid internal timer sets the counting standard for the various timers described in the various subroutines hereinafter.

Next, the various subroutines in steps S3 through S6 are sequentially called, the required processes are executed, and in step #7 the end of the internal timer is awaited, whereupon the routine returns to step #2. Step #3 is the subroutine for instructing the exchange of the original documents in the ADF 50, step #4 is the subroutine checking the copy paper, and step #5 is the subroutine for feeding the copy paper from the selected feed opening. The aforesaid subroutines are described later. Step #6 executes various other processes, e.g., the input/display process for the control panel, copy paper feed opening and magnification setting processes, and charging, exposure, transfer, and fixing processes and the like.

The CPU1 is connected to the CPU2 via a serial communication line, said communication being executed in step #8 in the interrupt process.

Figure 47:
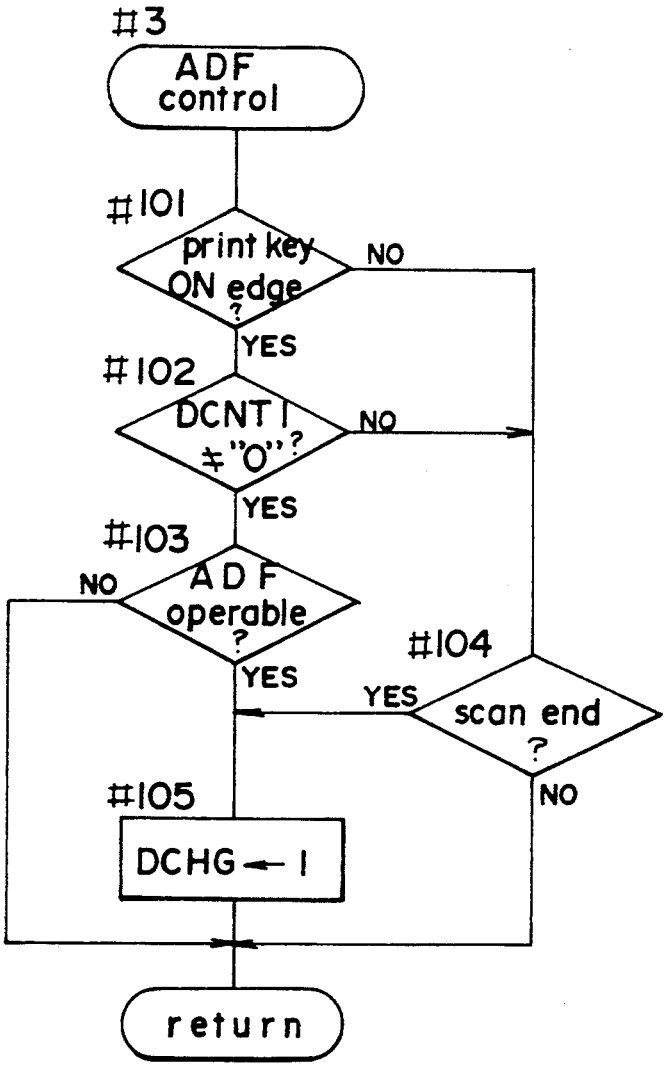

The ADF control subroutine executed in step #3 is shown in detail in FIG. 47. Since FIG. 47 is identical to FIG. 10 of the first embodiment, a description of the drawing is omitted.

Figure 48:
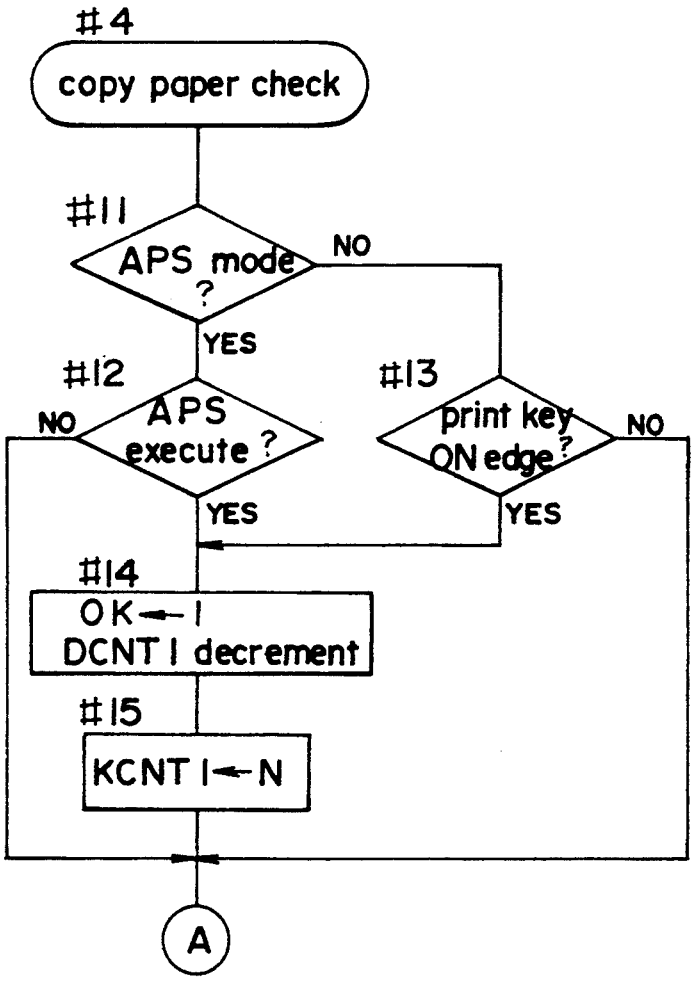
Figure 49:
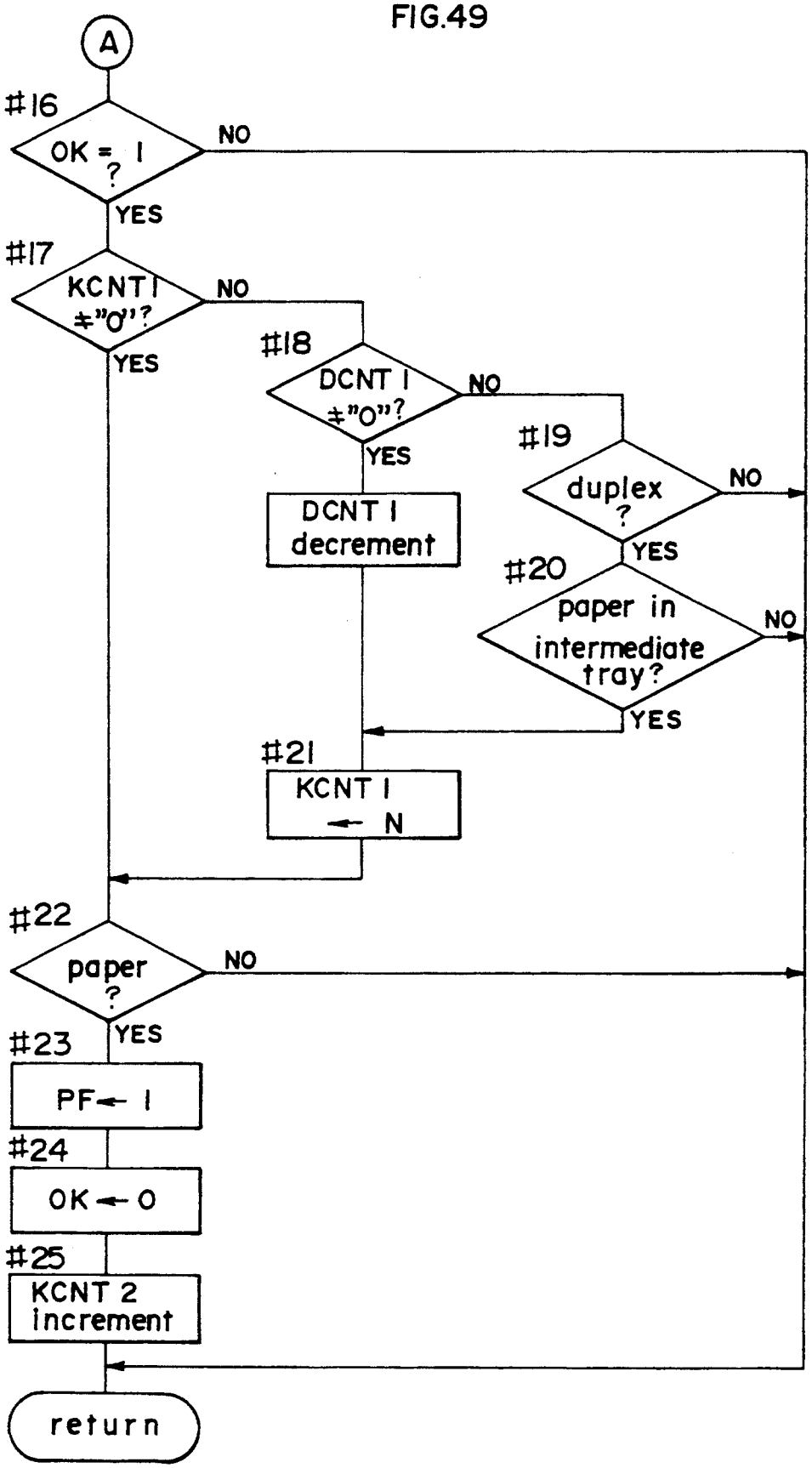

The copy paper feed check subroutine executed in step #4 is shown in detail in FIGS. 48 and 49. Since, however, FIGS. 48 and 49 are substantially similar to FIGS. 11 and 12 of the first embodiment and depart only insofar as the exception of step #25 wherein KCNT2 is incremented, a description of the drawings is omitted.

Figure 50:
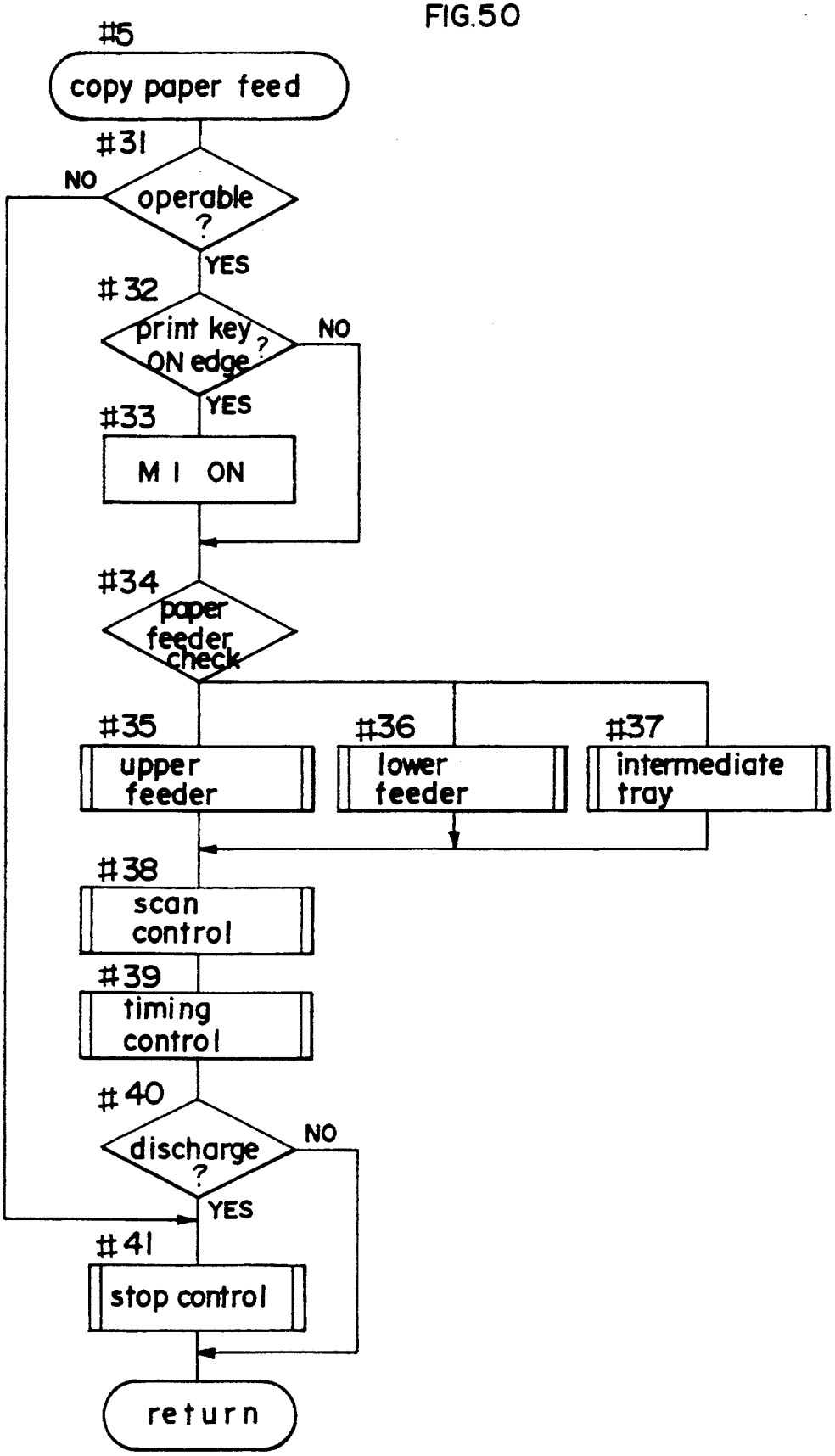

The copy paper feed subroutine executed in step #5 is shown in detail in FIG. 50. Since FIG. 50 is identical to FIG. 13 of the first embodiment, a description of the drawing is omitted.

Figure 51:
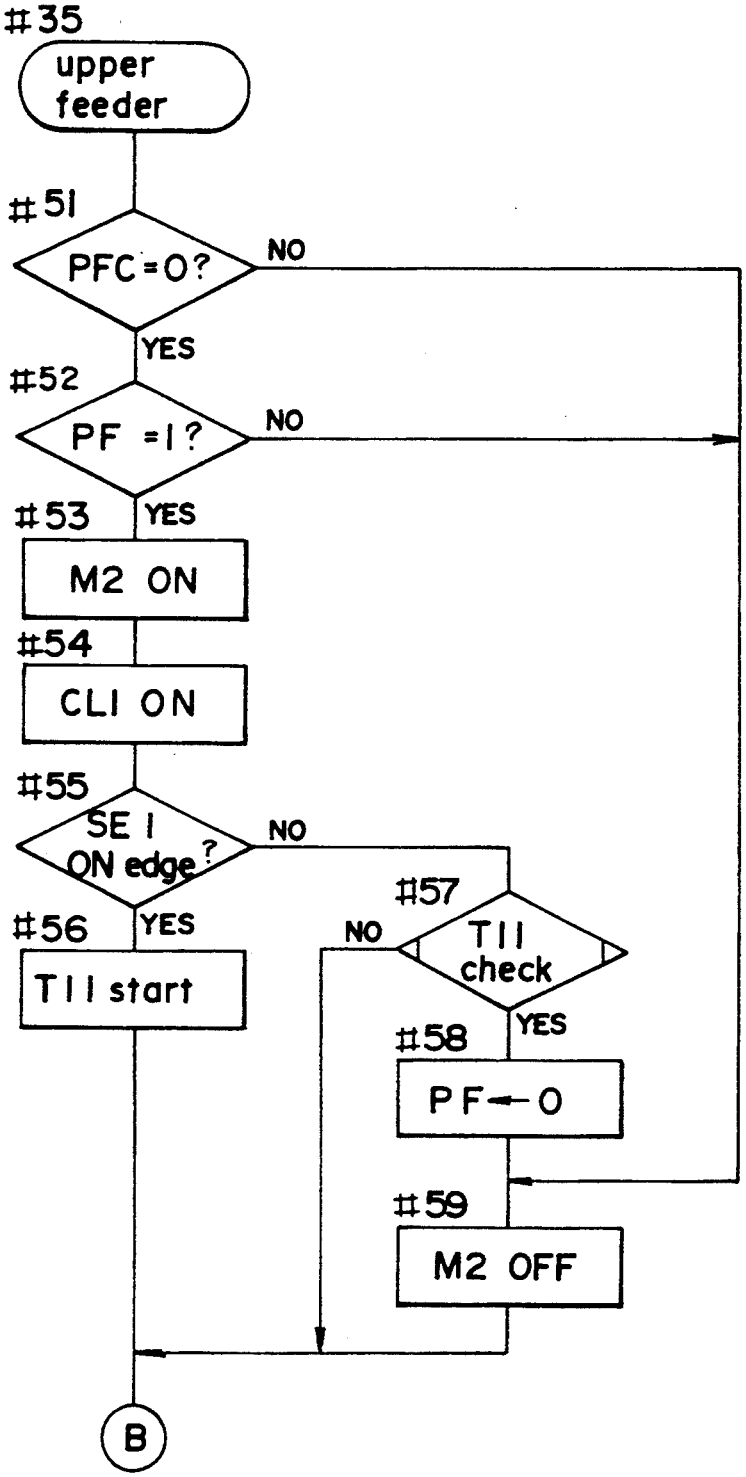
Figure 52:
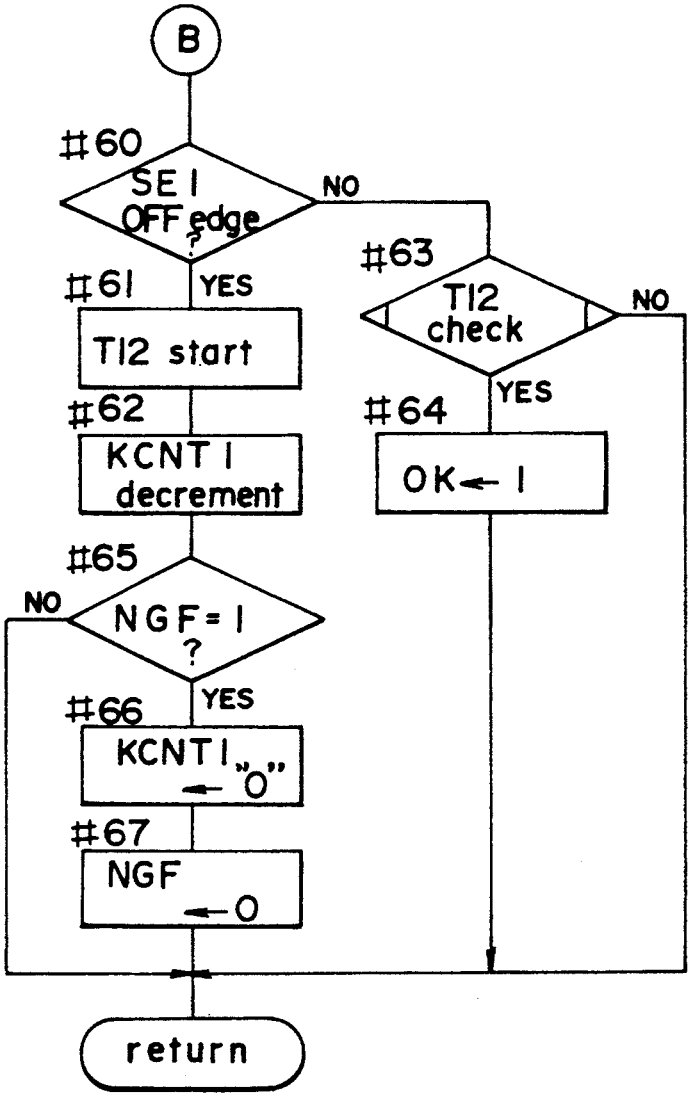
Figure 53:
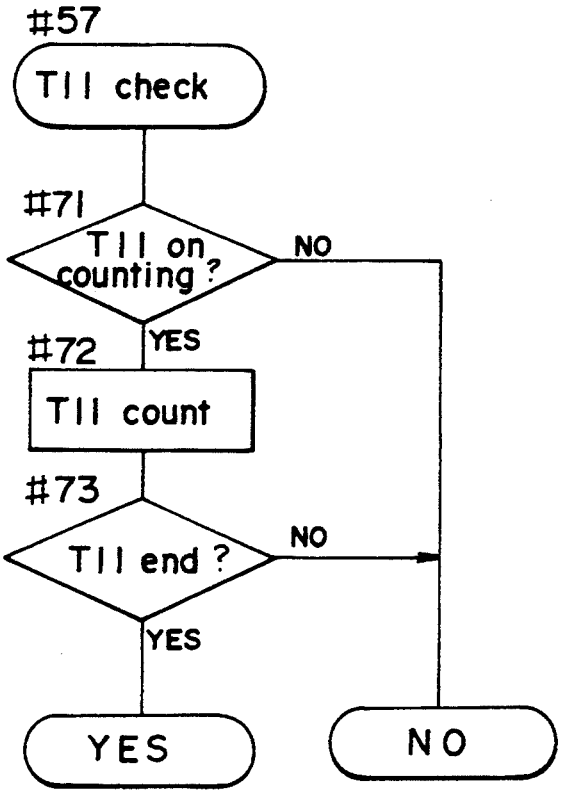

The upper feeder subroutine executed in step #35 is shown in detail in FIGS. 51 and 52. The FIGS. 51 and 51 are substantially similar to FIGS. 14 and 15 of the first embodiment. The characteristic control of the upper feeder subroutine of the second embodiment is described in FIG. 52, steps #65–67. That is, a check is made to determine whether or not the NG flag is set at 1. If the NG flag is set at 1, the KCNT1 is reset at 0 in step #66, and the NG flag is reset at 0 in step #67.

Figure 54:
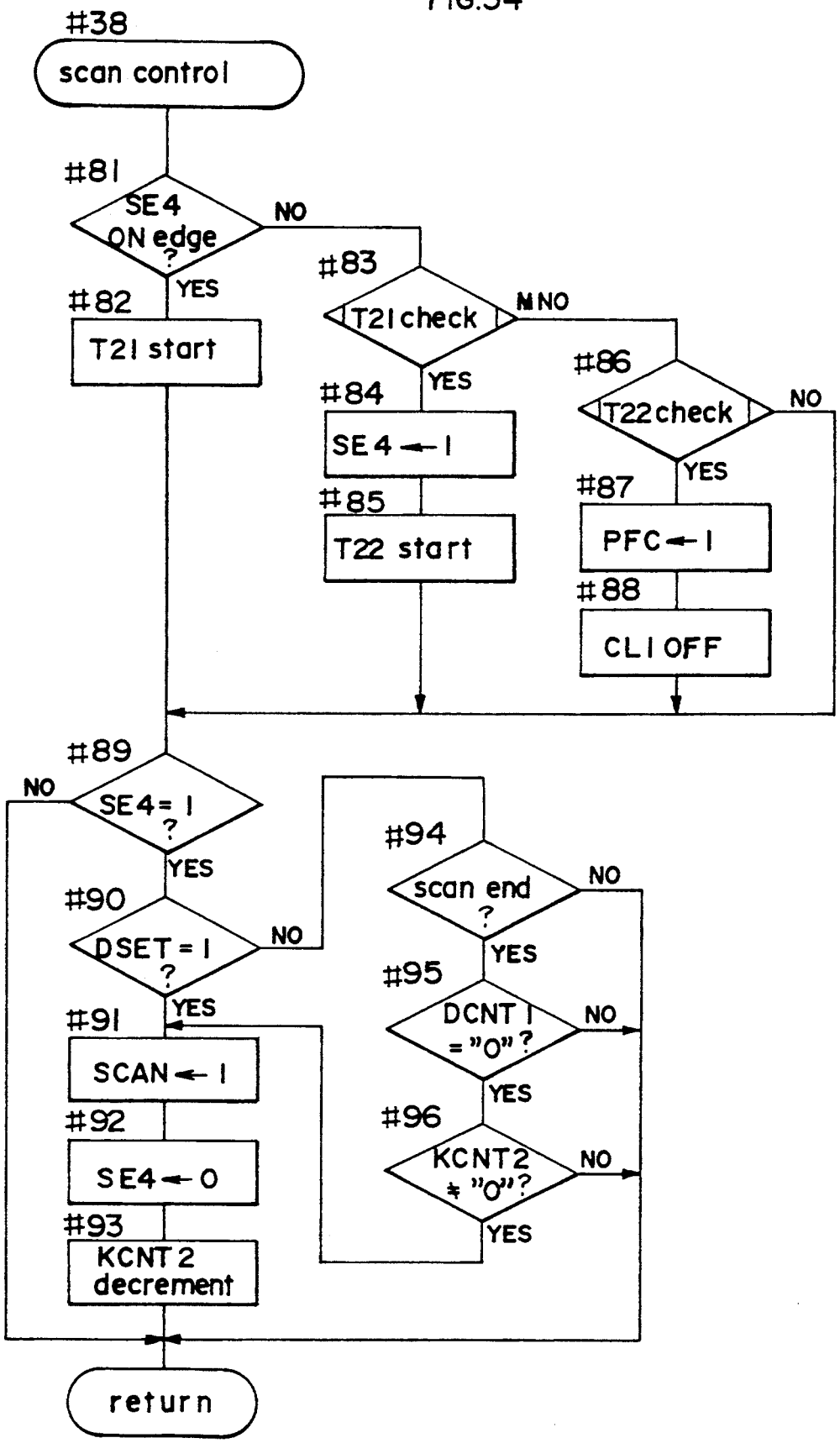

The scan control subroutine shown in FIG. 54 is identical to FIG. 17 of the first embodiment with the exception that the controls of steps #94–96 are eliminated. If the reply to the query in step #90 is NO, the routine continues to steps #91–96. When the operator set number N scans have been completed, steps #91–93 are executed when the DCNT1 is set at 0, i.e., when the counter KCNT2 is set at a value other than 0. In this process, a surplus copy paper fed in response to a detection error by the sensor SE100 is discharged to tray 91.

Figure 55:
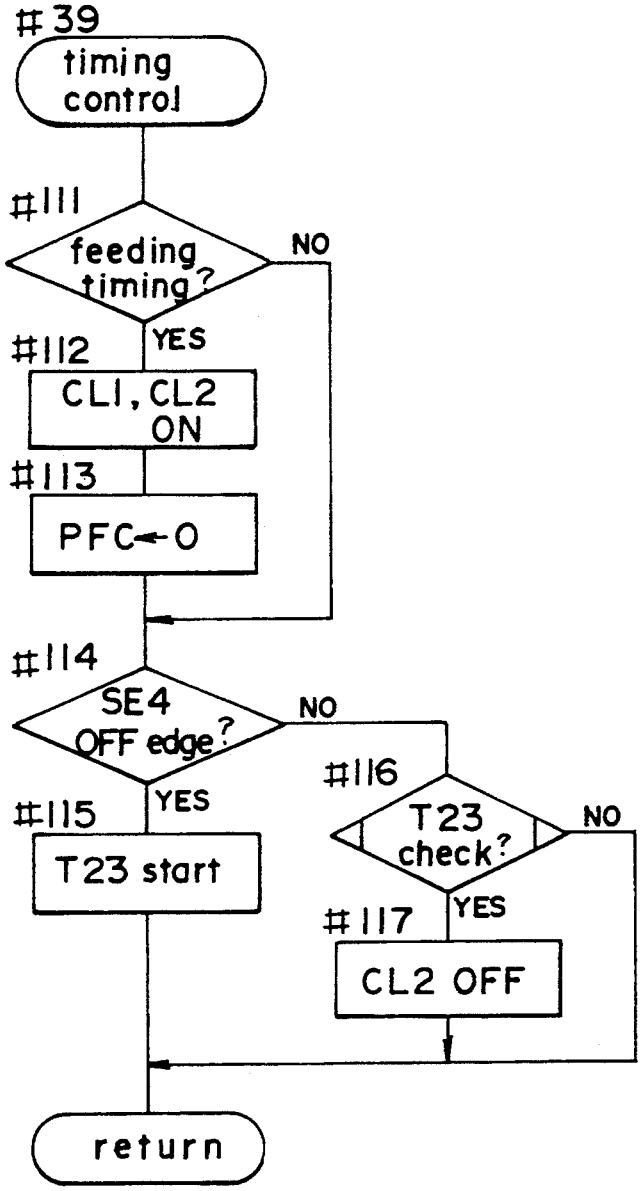

The timing control subroutine shown in FIG. 55 is identical to that of FIG. 18 of the first embodiment and, therefore, a description is omitted herefrom.

The control sequence of the ADF 500 is described hereinafter with reference to FIGS. 56–74.

Figure 56:
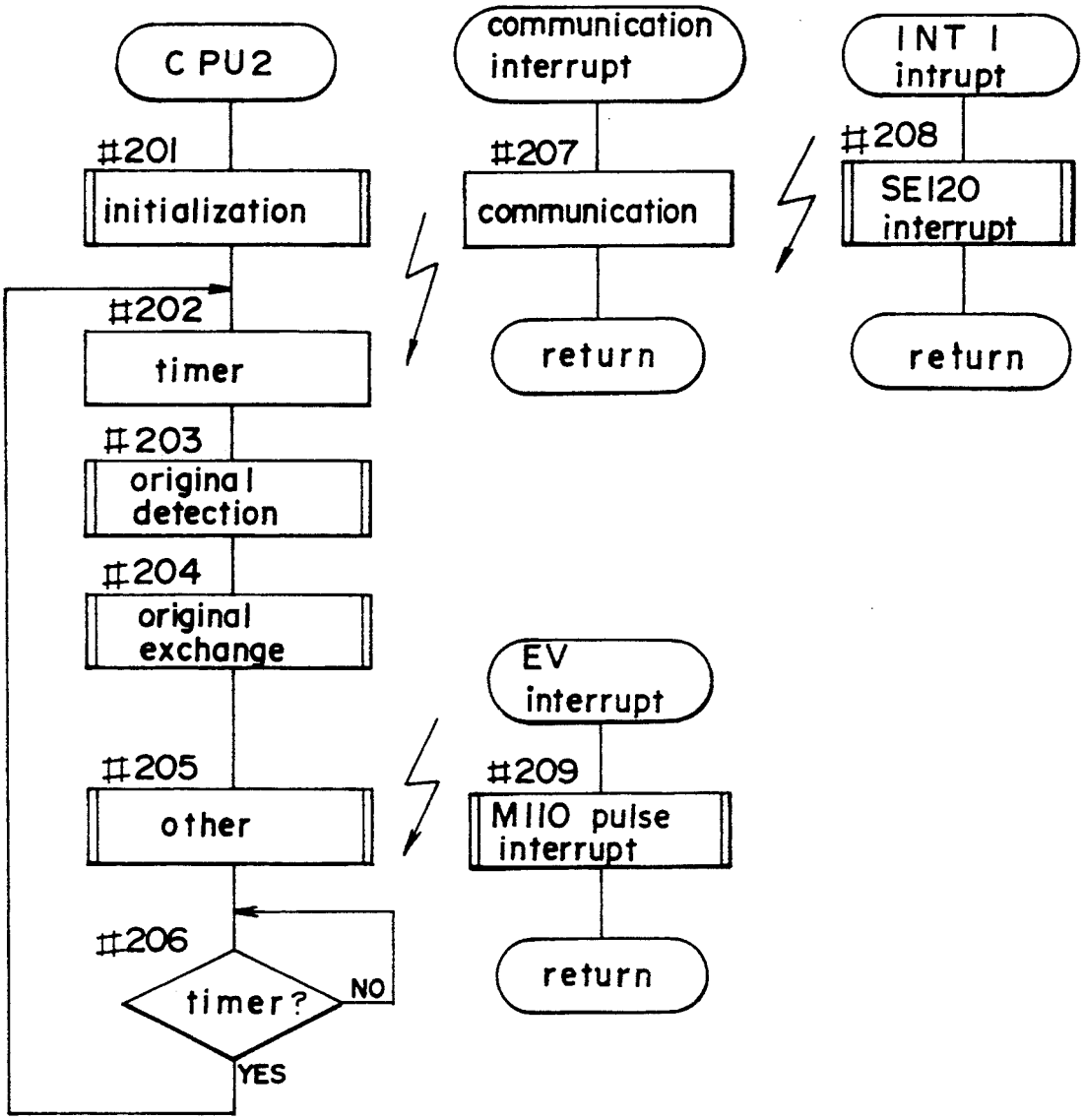

FIG. 56 shows the main routine of the CPU2.

When the power source is turned ON, the CPU2 is reset and the program starts, and in step #201 the random access memory (RAM) is cleared, various registers are reset, and initialization is executed to set the initial modes for the various types of components. An internal timer determines the time required for one routine of the main routine, and the value set in said timer is set in step #201. Furthermore, the aforesaid internal timer sets the counting standard for the various timers described in the various subroutines hereinafter.

Next, the various subroutines in steps #203 through #207 are sequentially called, the required processes are executed, and in step #208 the end of the internal timer is awaited, whereupon the routine returns to step #202. Step #203 is the subroutine for detecting the original document, and step #204 is the subroutine for exchanging originals and are described later. Step #205 executes various other processes, e.g., paper jam detection process and the like.

There are three types of interrupt process. The communication interrupt process for transmitting data to the CPU1 is executed in step #207. The INT1 interrupt process is executed by the OFF edge signal of the sensor SE120 in step #208, and detects the size of the original. The EV1 interrupt process is a pulse interrupt for main motor M110 executed in step #209.

Figure 57:
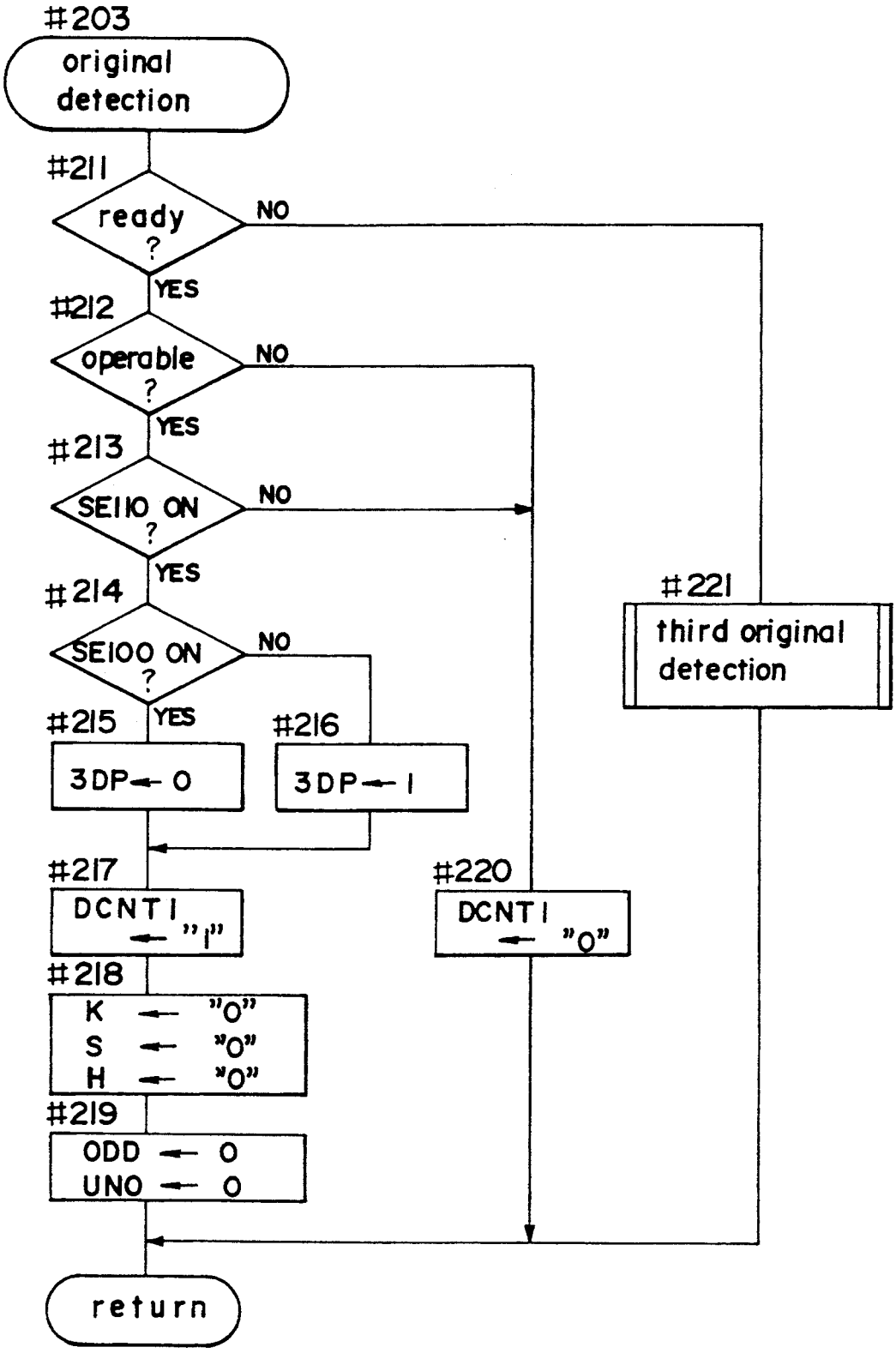

FIG. 57 shows the original document detection subroutine executed in step #203.

First, a check is made in step #211 to determine whether or not the ADF 500 is currently on standby. If the ADF 500 has already started operation, the third original detection subroutine is executed in step #221, and the program returns to the main routine. If the ADF 500 is on standby, a check is made in step #212 to determine whether or not ADF 500 is operational. If the ADF is operational, a check is made in step #213 to ascertain whether or not the sensor SE110 is ON, and a check is made in step #214 to ascertain whether or not the sensor SE100 is ON. If either sensor is ON, the third original detection prohibit flag (3DP) is set at 0 in step #215, and the routine advances to step #217. If the sensor SE100 is OFF, the original detection prohibit flag is set at 1 in step #216, and the routine advances to step #217.

Next, the counter DCNT1 is set at 1 in step #217, and K-status, S-status and H-status are respectively reset at "0" in step #218. The K-status is the counter used to control the feeding of the original documents. The S-status is the counter used to control the transporting of the original documents. The H-status is the counter used to discharge the original documents. In step #219, the odd number flag ODD and the last sheet flag UNO are respectively reset at 0. When the odd number flag ODD is set at 1, it indicates the start of feeding an original having an odd number of pages, and when set at 0, it indicates the start of feeding an original having an even number of pages (refer to steps #284, #285). When the last sheet flag UNO is set at 1, it indicates the final original in the two-in-one mode is a single sheet of size A4Y or less (refer to step #457).

If, on the other hand, the reply to the query in step #212 or #213 is NO, the counter DCNT1 is reset at 0 in step #220, and the program returns to the main routine.

Figure 58:
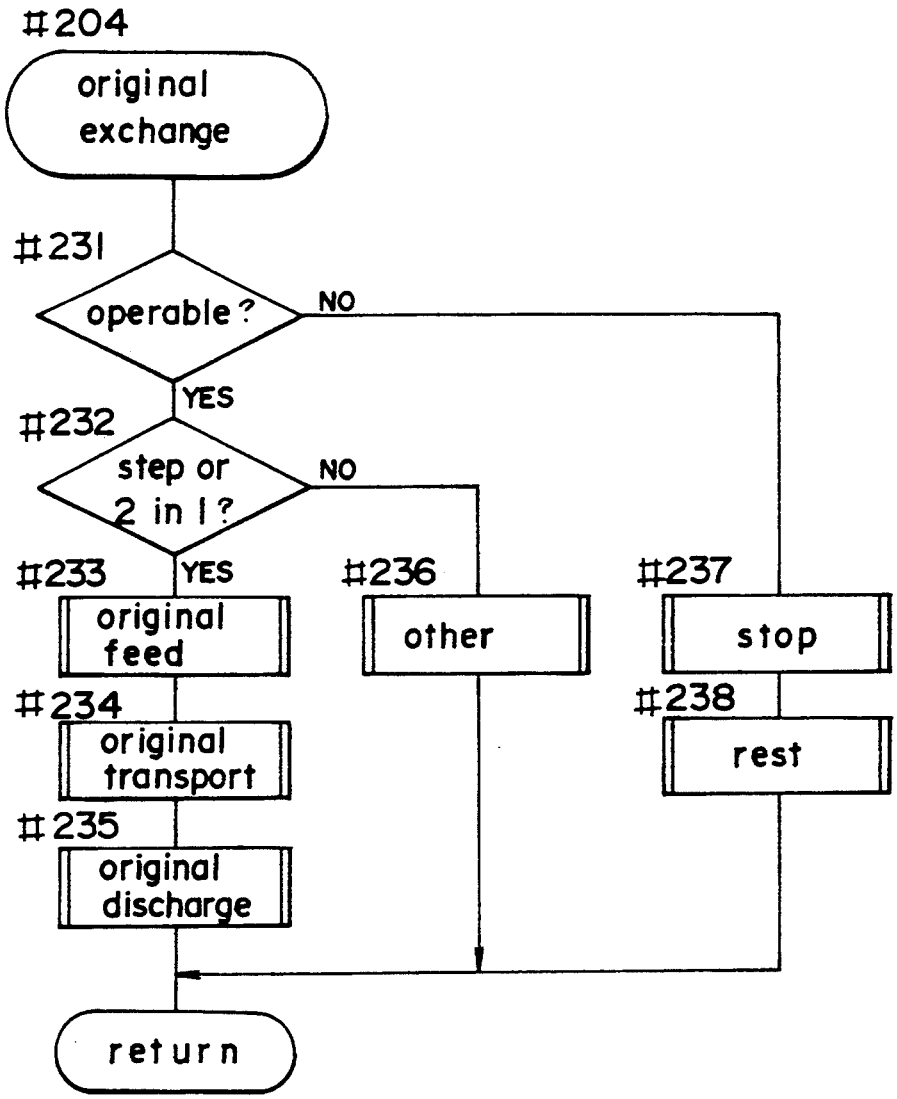

FIG. 58 shows the original document exchange subroutine executed in step #204.

This subroutine feeds and transports the original documents, stops originals at the standard position 0, and discharges the scanned originals to the tray 660.

First, after a check in step #231 confirms the ADF 500 is operational, a check is made in step #232 to determine whether or not the ADF 500 operation mode is the step feed mode, or the two-in-one mode. If either of the aforesaid modes has been selected, an original is fed in step #233, an original is transported in step #234, an dan original is discharged in step #235. The aforesaid processes are described hereinafter with reference to FIGS. 61–69.

When, on the other hand, the ADF 500 is found to be inoperable in step #231, the operation of the ADF 500 is stopped in step #237, and the various flags and memories are reset in step #238.

When it is determined in step #232 that another operating mode has been selected, the other operating mode is executed in step #236. Since the operating mode executed in step #236 is the normal mode in the second embodiment, details of said normal mode are omitted.

Detection of a second original and detection of a third original are described hereinafter. The second original detection process is executed in step #345 during the during step #234 of the original transport subroutine of described below. The third original detection process is executed in step #221 of the previously mentioned original detection subroutine.

Figure 59:
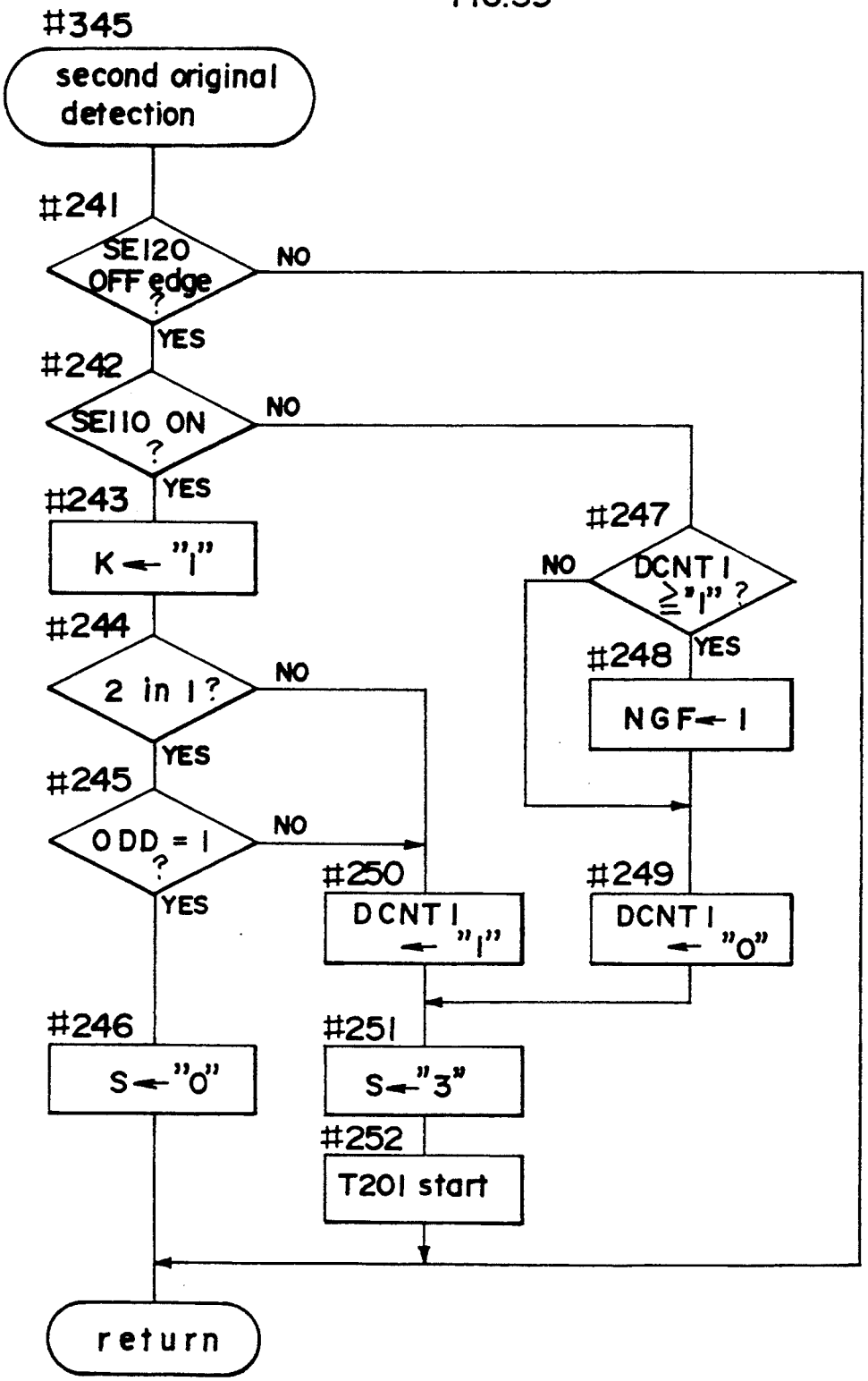

FIG. 59 shows the second original detection subroutine executed in step #345.

First, when it is determined in step #241 that the sensor SE120 is OFF edge, i.e., when the trailing end of the fed original passes the detection point of the sensor SE120, a check is made in step #242 to determine whether or not the sensor SE110 is ON. If the sensor SE110 is turned ON at this time, it indicates the presence of a second original on the tray 510, and the K-status is set at "1" in step #243 in preparation for feeding the next original.

Then, a check is made in step #244 to determine whether or not the two-in-one mode has been selected. If the reply to the query is YES, a check is made in step #245 to determine whether or not the odd number flag ODD is set at 1. If the flag ODD is set at 1, the S-status is reset at "0" in step #246.

When a next original is detected and the two-in-one mode has not been selected, or said next original is an even numbered page in the two-in-one mode, the counter DCNT1 is set at 1 in step #250, and the S-status is set at "3" in step #251, then, the timer T201 is started in step #252. The timer T201 is used to set the DSET flag at 1 in the original transport process (refer to FIG. 352).

If, on the other hand, the sensor SE110 is turned OFF (step #242: NO), i.e., if an original is not present on the tray 510, a check is made in step #247 to determine whether or not the counter DCNT1 is set at 1. If the DCNT1 is set at a value other than 1, the NG flag is set at 1 in step #248. Thereafter, the counter DCNT1 is reset at 0 in step #249, and the processes of steps #251 and #252 are executed.

Figure 60:
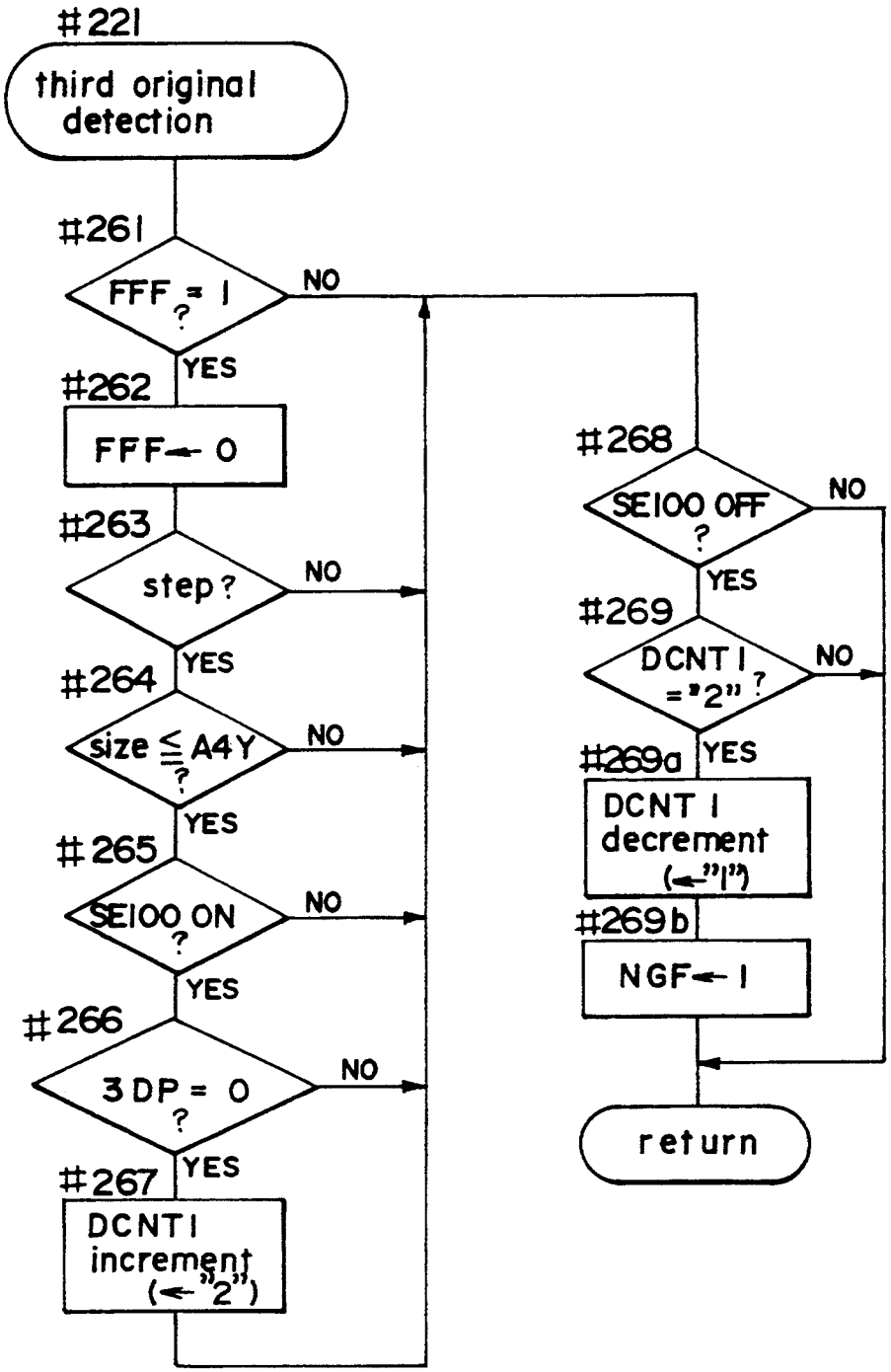

FIG. 60 shows the third original detection subroutine executed in step #221.

First, a check is made in step #261 to determine whether or not the prefeed flag FFF is set at 1. When the prefeed flag FFF is set at 1, it indicates that the original prefeed process is completed (refer to step #325). If the prefeed flag FFF is set at 1, said prefeed flag is reset at 0 in step #262, and a check is made in step #263 to ascertain if the step feed mode is selected, a check is made in step #264 to ascertain if the size of the original is A4Y or less, a check is made in step #265 to ascertain if the sensor SE110 is turned ON, and a check is made in step #266 to ascertain if the third original detection prohibit flag 3DP is set at 0. The counter DCNT1 is incremented (in this case, set at 2 ) in step #267 if the reply to any of the aforesaid queries is YES, i.e., if the step feed mode is selected, the original size is A4Y or less, a third original is present on the tray 510, or the third original detection flag is reset at 0. Then, a check is made in step #268 to determine whether or not the sensor SE110 is OFF. If the sensor SE110 is turned OFF and the value of the counter DCNT1 is found to be 2 in step #269, said DCNT1 is decremented (set at 1) in step #269*a*, and the NG flag is set at 1 in step #269*b*. When the query of step #261, or any of the steps #263–#269 is NO, the processes of step #268 and subsequent steps are executed. If the reply to the query of either step #268 or #269 is NO, the subroutine ends.

Figure 61:
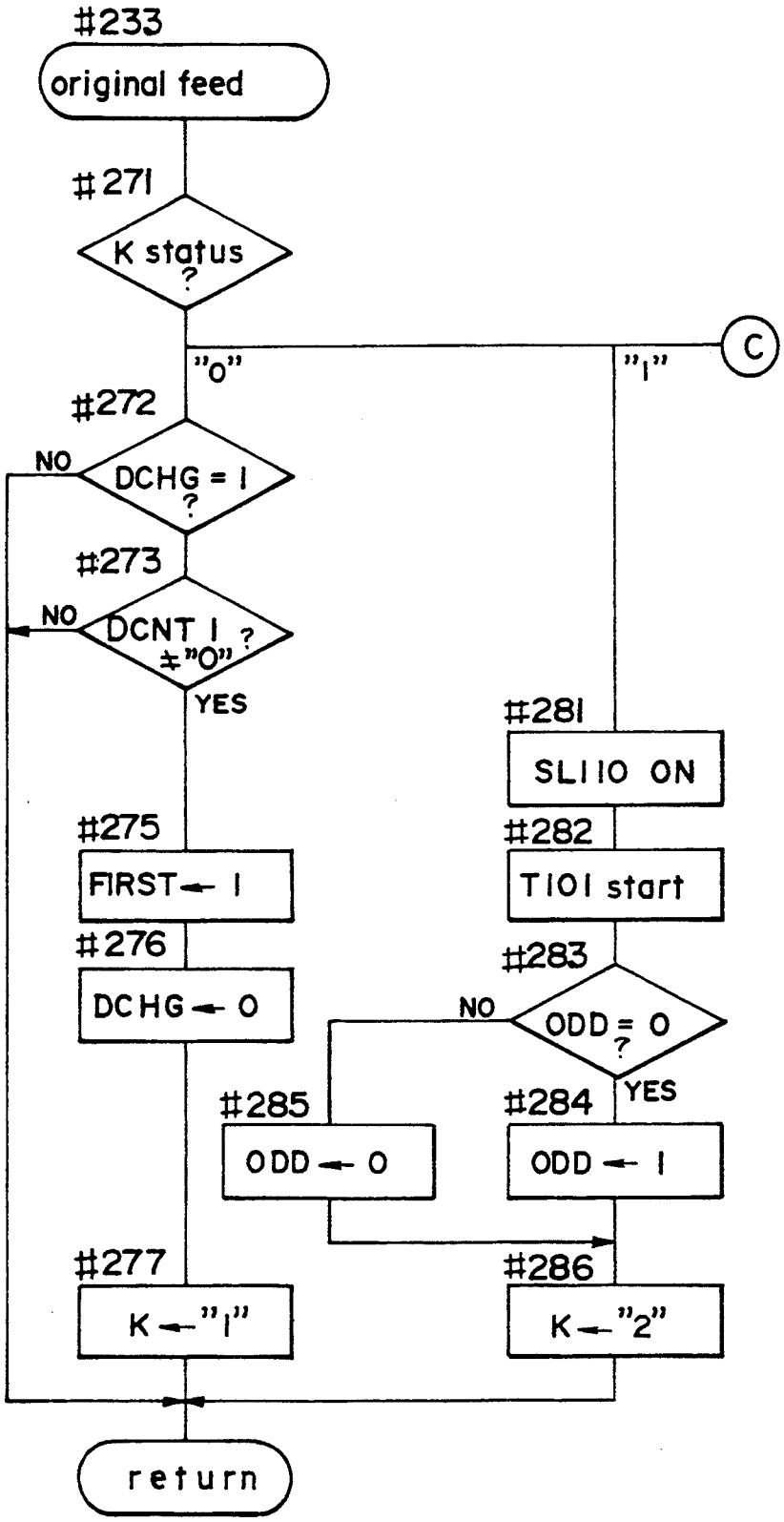
Figure 62:
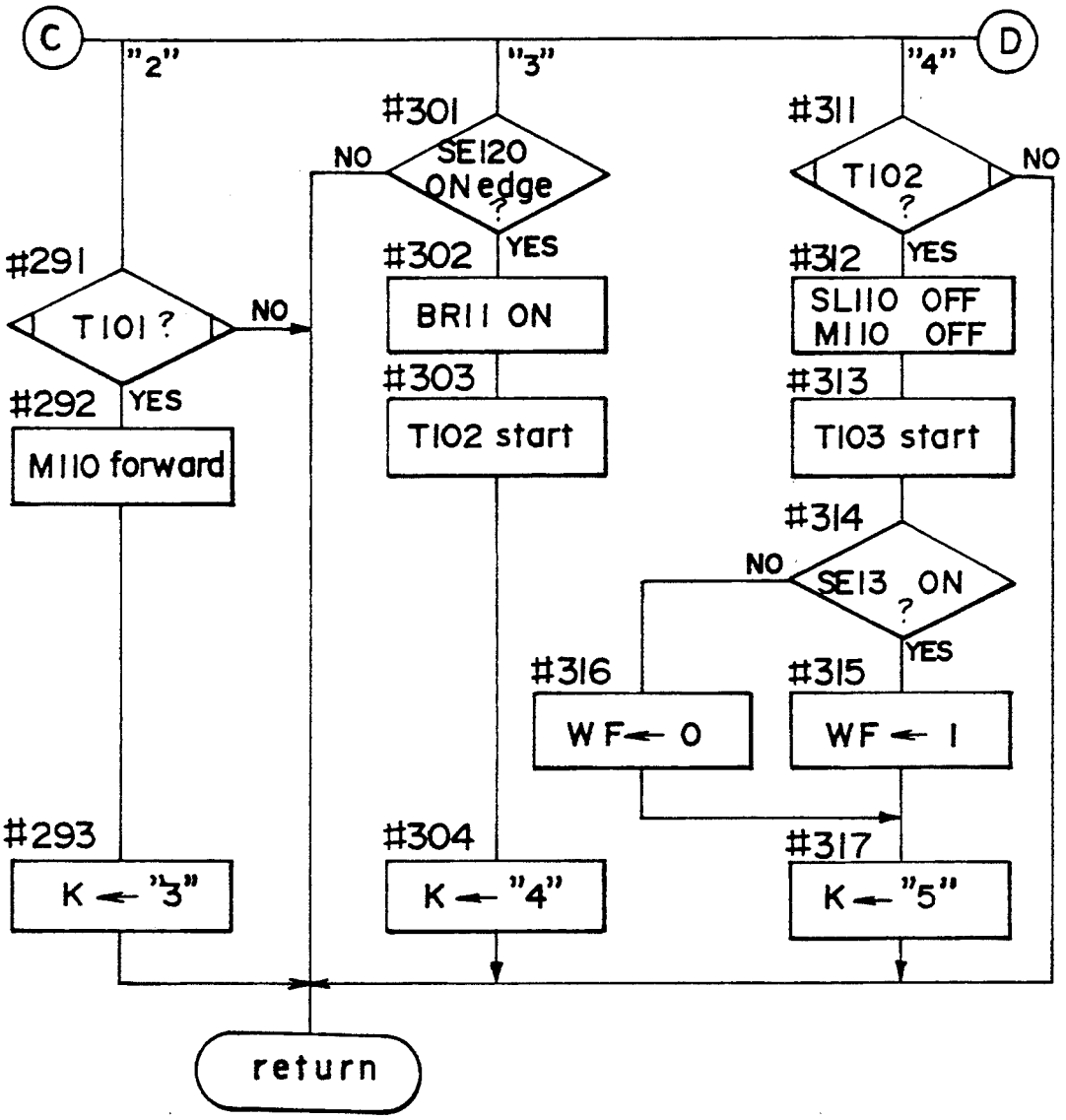
Figure 63:
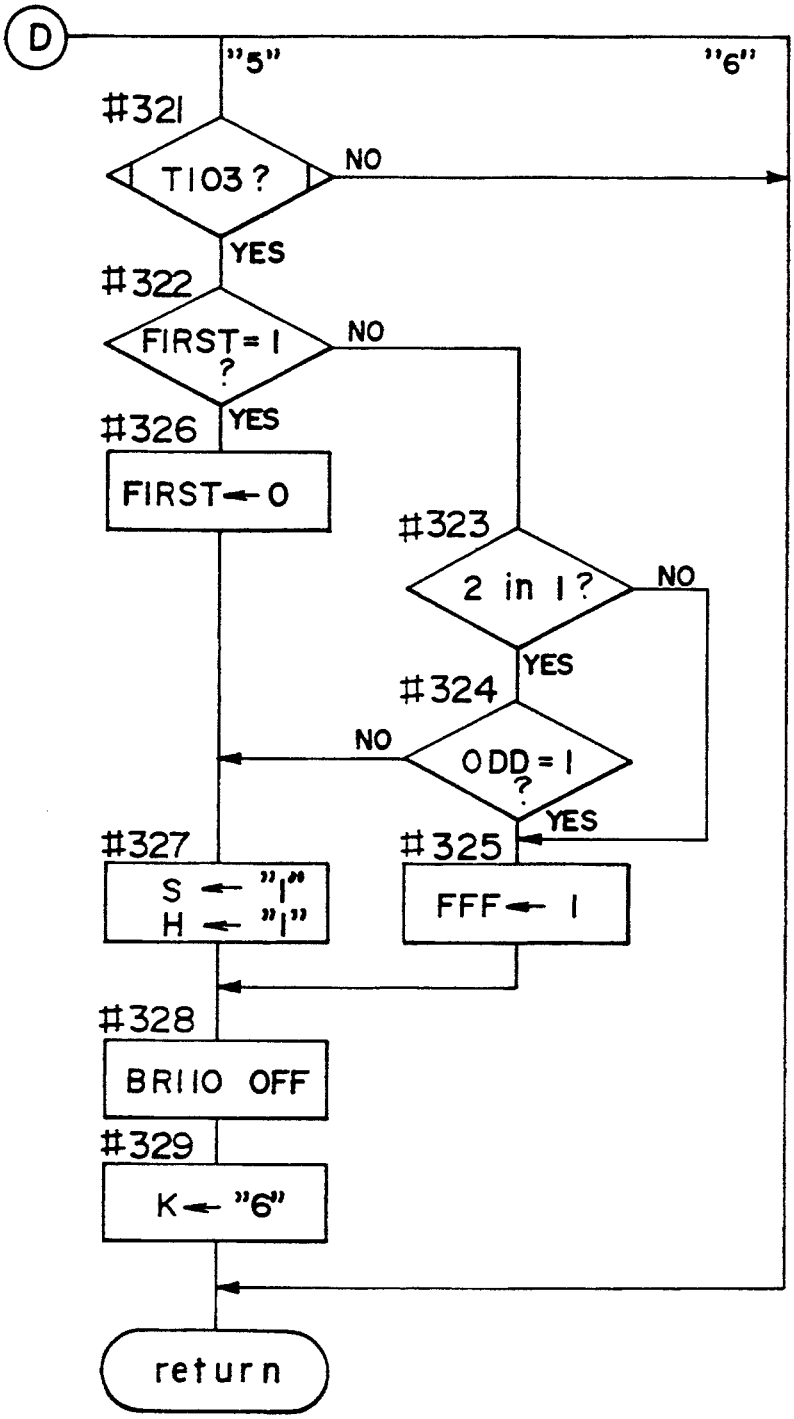

FIGS. 61–63 show the original feed subroutine executed in step #233.

This subroutine checks the count value of the K-status in step #233, and executes processing in accordance with said count value.

First, when the K-status is "0," a check is made in step #272 to determine whether or not the DCHG flag is set at 0. If the reply to the query is YES, an original document exchange is requested, and because there is a subsequent original to be fed, the first original flag FIRST is set at 1 in step #275, the DCHG flag is reset at 0 in step #276, and the K-status is set at "1" in step #277.

When the K-status is set at "1," the original feed process is started. That is, the solenoid SL110 is turned ON in step #281. Thus, the pick-up roller 540 is lowered and the front end stopper 530 is retracted from the standard position. Then, the timer T101 is started in step #282, and a check is made in step #283 to determine whether or not the odd number flag ODD is set at 0. That is, if an odd number of originals are fed, the odd number flag ODD is set at 1 in step #284, whereas if an even number of originals are fed, the flag ODD is reset at 0 in step #285. The odd number flag is reset at 0 when the ADF 500 starts operation (refer to step #219). Thereafter, the K-status is set at "2."

When the K-status is set at "2," first, the aforesaid timer T101 is checked in step #291. The timer T101 determines the timing for forward rotation of the main motor M110, and after said timer T101 is started, the count is checked and completion state is checked in step #291. If the timer T101 has ended, the main motor M110 is turned ON for forward rotation in step #292, and the K-status is set at "3" in step #293. Thus, the original is fed from the rollers 540, 550 and 560 toward the register rollers 580 and 590.

When the K-status is "3," the original is temporarily stopped at the register rollers 580 and 590 for preparation. That is, a check is made in step #301 to determine whether or not the sensor SE120 is ON edge. If sensor SE120 is ON edge, the electromagnetic brake BR110 is turned ON, and the register roller 580 and belt drive shaft 610 are locked in step #302, the timer T102 is started in step #303, and the K-status is set at "4" in step #304 .

When the K-status is "4," the aforesaid timer T102 is first checked in step #311. The timer T102 determines the timing for raising the roller 540, returning the stopper 530 and turning OFF the forward rotation of the main motor M110; after the timer T102 is started, the count and completion state are checked in step #311. When the count of the timer T102 ends, the solenoid SL110 is turned OFF and the main motor M110 is turned OFF in step #312. Up to this point, the leading end of the original abuts the nip portion of the register rollers 580 and 590 so as to form somewhat of a loop.

Next, the timer T103 is started in step #313, and a check is made in step #314 to determine whether or not the sensor SE130 is ON. The sensor SE130 detects the width of the original; if sensor SE130 is ON, the width flag is set at 1 in step #315, whereas if the SE130 is OFF, the width flag is reset at 0 in step #316. The width flag is used in the subsequent size detection process (refer to step #451). Thereafter, the K-status is set at "5" in step #317.

When the K-status is "5," the timer T103 is checked in step #321. The timer T103 is used to end the original feed; after being started, the count and completion state of the timer T103 are checked in step #321. When the count of timer T103 ends, a check is made to ascertain whether or not the first flag is set at 1 in step #322. If the first flag is set at 1, the first flag is reset at 0 in step #326, then the S-status and H-status are respectively set at 1 in step #327. Then, the electromagnetic brake BR110 is turned OFF and the lock is released on the register roller 580 and the belt drive shaft 610 in step #328. The K-status is set at "6" in step #329.

On the other hand, when the first flag is found to be reset at 0 in step #322, the two-in-one mode selection is checked in step #323. If the reply to the query is NO, the prefeed flag FFF is set at 1 in step #325, and the processes of steps #328 and #329 are executed. If the two-in-one mode has been selected, a check is made in step #324 to determine whether or not the odd number flag ODD is set at 1. If the ODD is set at 1 (if an even numbered original), the processes of steps #325, #328 and #329 are executed.

When the K-status is "6," processing is not executed. The original waits in the fed state.

Figure 64:
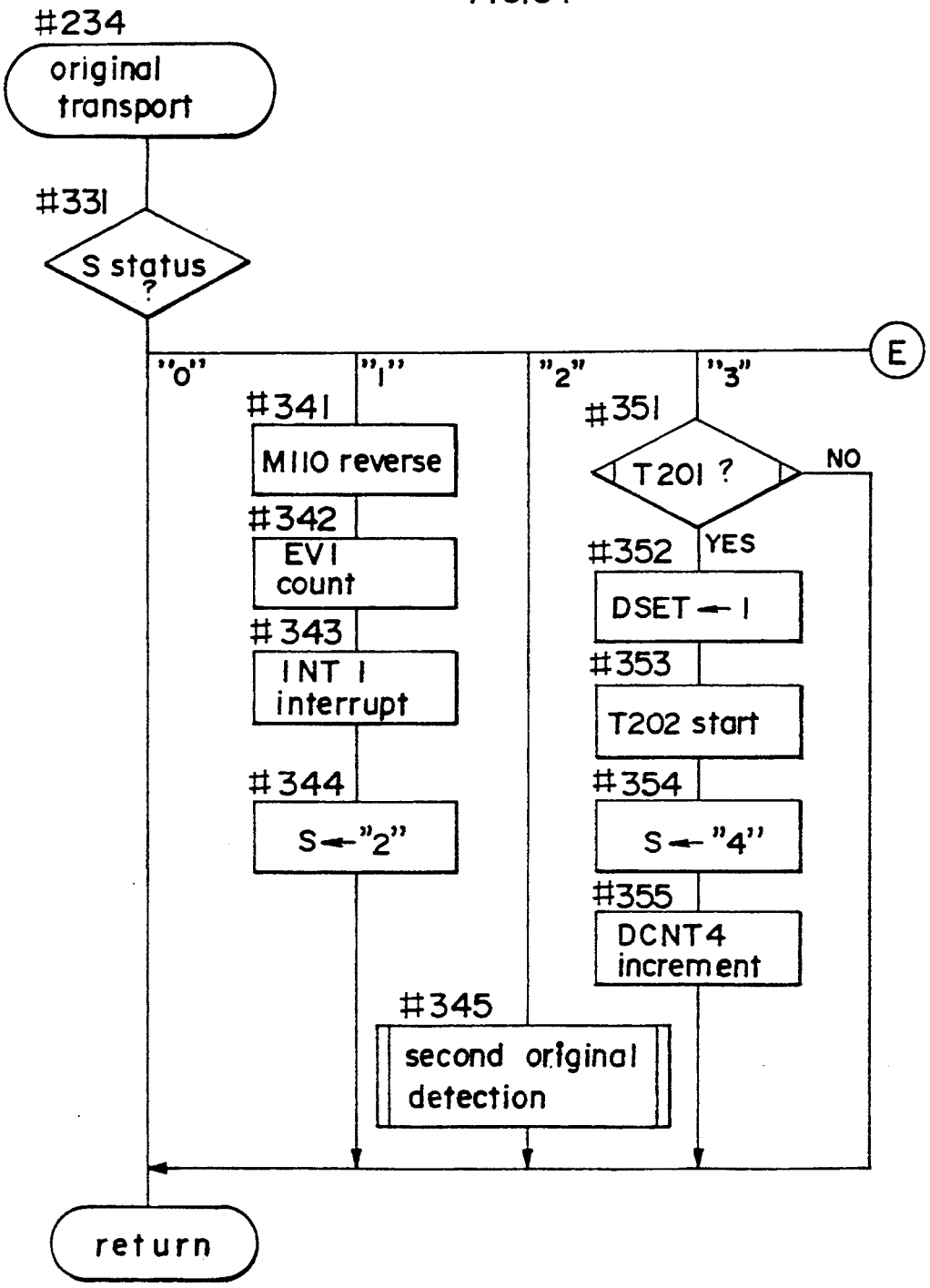
Figure 65:
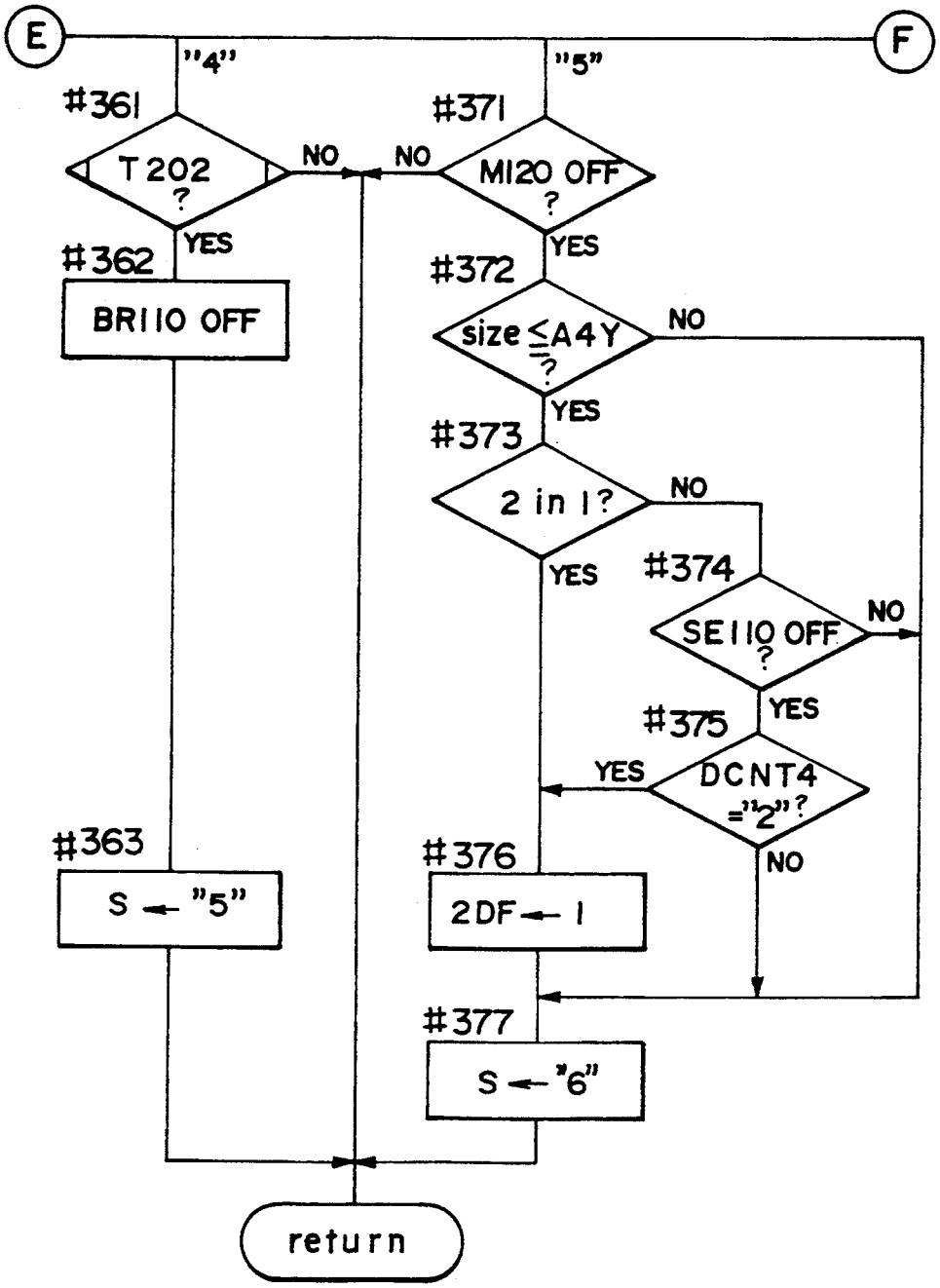
Figure 66:
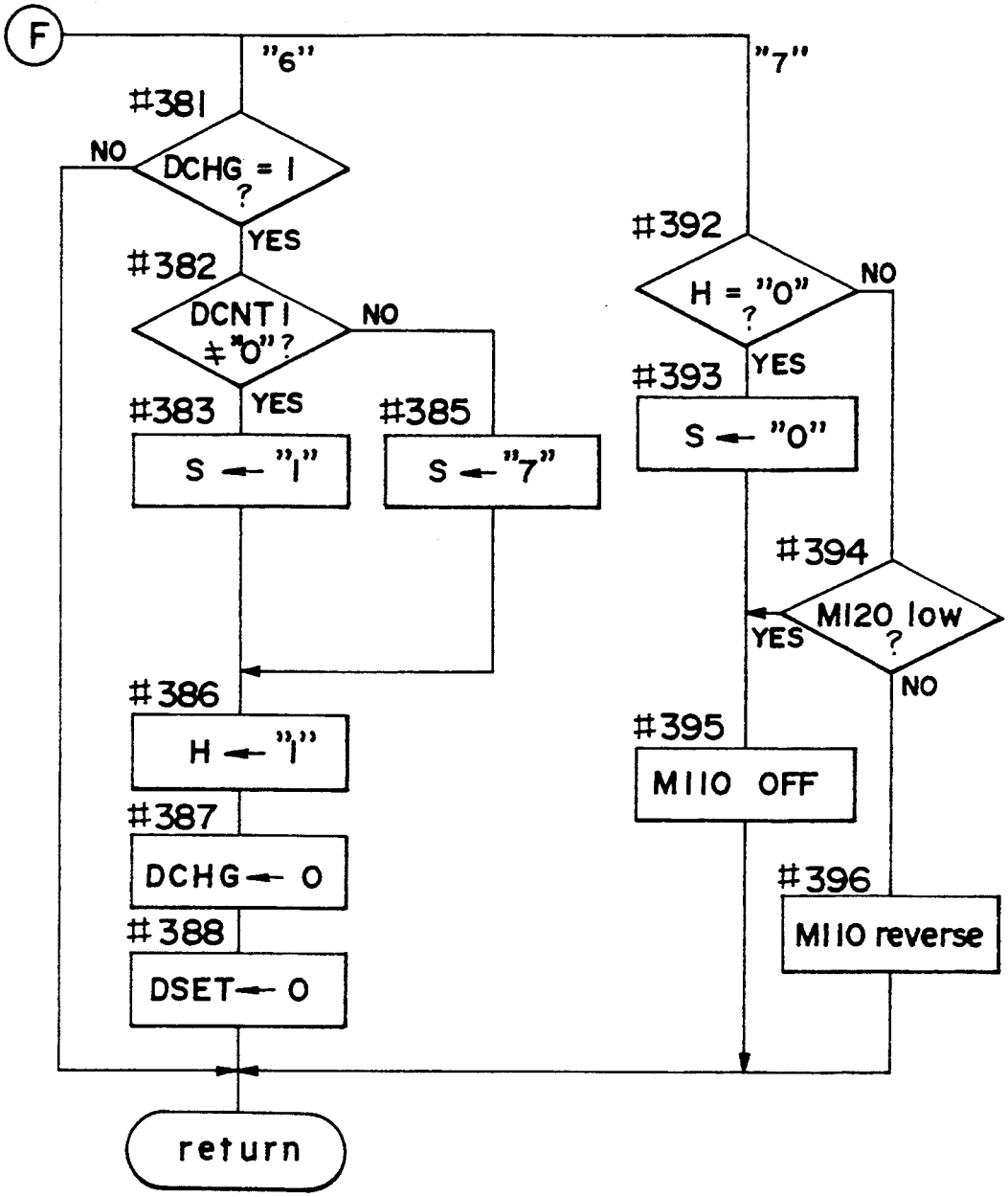

FIGS. 64–66 show the document transport subroutine executed in step #234.

This subroutine checks the count value of the S-status in step #331, and sets the fed original on the platen glass 29 in accordance with said count value.

When the S-status is "0," processing is not executed, and the subroutine is terminated. When the S-status is "0," it indicates no originals remain to be fed.

When the S-status is "1," i.e., when original are to be fed, the main motor M110 is reverse rotated in step #341, the EV1 starts counting the rotation pulses of said main motor M110, and an INT1 interrupt process is permitted in step #343. Thus, the transport belt 600 and the register roller 580 are rotated in the arrow c direction, the original starts feeding onto the platen glass 29, and at the same time the amount of movement of the original is detected by the number of rotation pulses of the main motor M110. Then, the S-status is set at "2" in step #344.

When the INT1 interrupt process is permitted in step #343, the INT1 interrupt process is executed by the sensor SE120 OFF edge timing. During this process (refer to FIG. 36), interrupts are permitted for size detection and setting the EV1 interrupt pulse number, and the rotation pulse number of the main motor M110 continues to be counted. The interrupt step #209 and subsequent steps are executed when a count is achieved which is equivalent to the movement of the trailing end of the original from the sensor SE120 detection point to the standard position 0, or the arrival at the odd numbered original standby position (nip portion of register rollers 580 and 590) in the two-in-one mode.

That is, the main motor M110 is turned OFF in step #501, and the electromagnetic brake BR110 is turned OFF in step #502, as shown in FIG. 64.

When the S-status is set at "2," the second original detection process is executed in step #345. As per the description for FIG. 59, this process determines the presence of a second original via the OFF edge timing of the sensor SE120. If th eoriginal is not an odd numbered original in the two-in-one mode, the S-status is set at "3" and the timer T201 is started.

When the S-status is "3," the timer T201 is checked in step #351. The timer T201 counts, and when said count ends, the DSET flag is set at 1 in step #352, and the timer T202 is started in step #353. Then, the S-status is set at "4" in step #354, and the counter DCNT4 is incremented in step #355.

When the S-status is "4," the timer T202 is first checked in step #351. The timer T202 determines the timing for turning OFF the electromagnetic brake BR110; after being started, the count and completion state of the timer T202 are checked in step #361. When the count of the timer T202 ends, the electromagnetic brake BR110 is turned OFF in step #362, and the S-status is set at "5" in step #363.

When the S-status is "5," a check is made in step #371 to determine whether or not the discharge motor M120 is turned OFF. If the discharge motor M120 is OFF, a check is made in step #372 to ascertain whether or not the size of the original is A4Y or less. If the size of the original is A4Y or less, a check is made in step #373 to ascertain if the two-in-one mode has been selected. If the reply to the query is YES, the two originals discharge flag 2DF is set at 1 in step #376, and the S-status is set at "6" in step #377. When the step feed mode has been selected (step #373: NO), a check is made in step #374 to determine whether or not the sensor SE110 is OFF, and the counter DCNT4 is checked in step #375. When the S-status is "3," the counter DCNT4 is incremented and the timer T201 ends (refer to step #355), and decremented when the original discharge process ends (refer to step #442); the counter DCNT4 shows the number of sheets of originals on the platen glass 29 and in the discharge portion. If the DCNT4 is set at 2, the processes of the aforesaid steps #376 and #377 are executed. If, on the other hand, the size of the original is larger than A4Y (step #372: NO) and the sensor SE110 is ON (step #374: NO), the routine advances to step #377.

That is, the setting of the two originals discharge flag at 1 in step #376, when two or more of the originals are A4Y or less in size, is accomplished after the final original has been set on the platen glass 29 in the step feed mode, and is timed by the turning OFF of the discharge motor M120 each time an original is set in the two-in-one mode.

When the S-status is "6," the DCHG flag is checked in step #381 to determine whether or not it is set at 1. If the DCHG flag is set at 1, the counter DCNT1 is checked in step #382 because an original exchange has been requested. If the DCNT1 is set at a value other than 0, the S-status is set at "1" in step #383. Then, in step #386 the H-status is set at "1," the DCHG flag is reset at 0 in step #387, and the DSET flag is reset at 0 in step #388. If, on the other hand, the DCNT1 is set at 0, the S-status is set at "7" in step #385, and the processes of steps #386–388 are executed.

When the S-status is "7," a check is made in step #392 to determine whether or not the H-status is "0." If the H-status has been reset at "0," the S-status is reset at "0" in step #393, and the main motor M110 is turned OFF in step #395. If, however, the H-status is set at a value other than "0," i.e., if the original discharge process has started, a check is made in step #394 to ascertain whether or not the discharge motor M120 is driving at low speed. If the discharge motor M120 is operating at low speed, the main motor M110 is turned OFF in step #395, whereas if the discharge motor M120 is not operating at low speed, the main motor M110 is turned ON for reverse rotation in step #396. Thus, the transport belt 600 is rotated in the arrow c direction, and the downstream transport of the original on the platen glass 29 starts.

Figure 67:
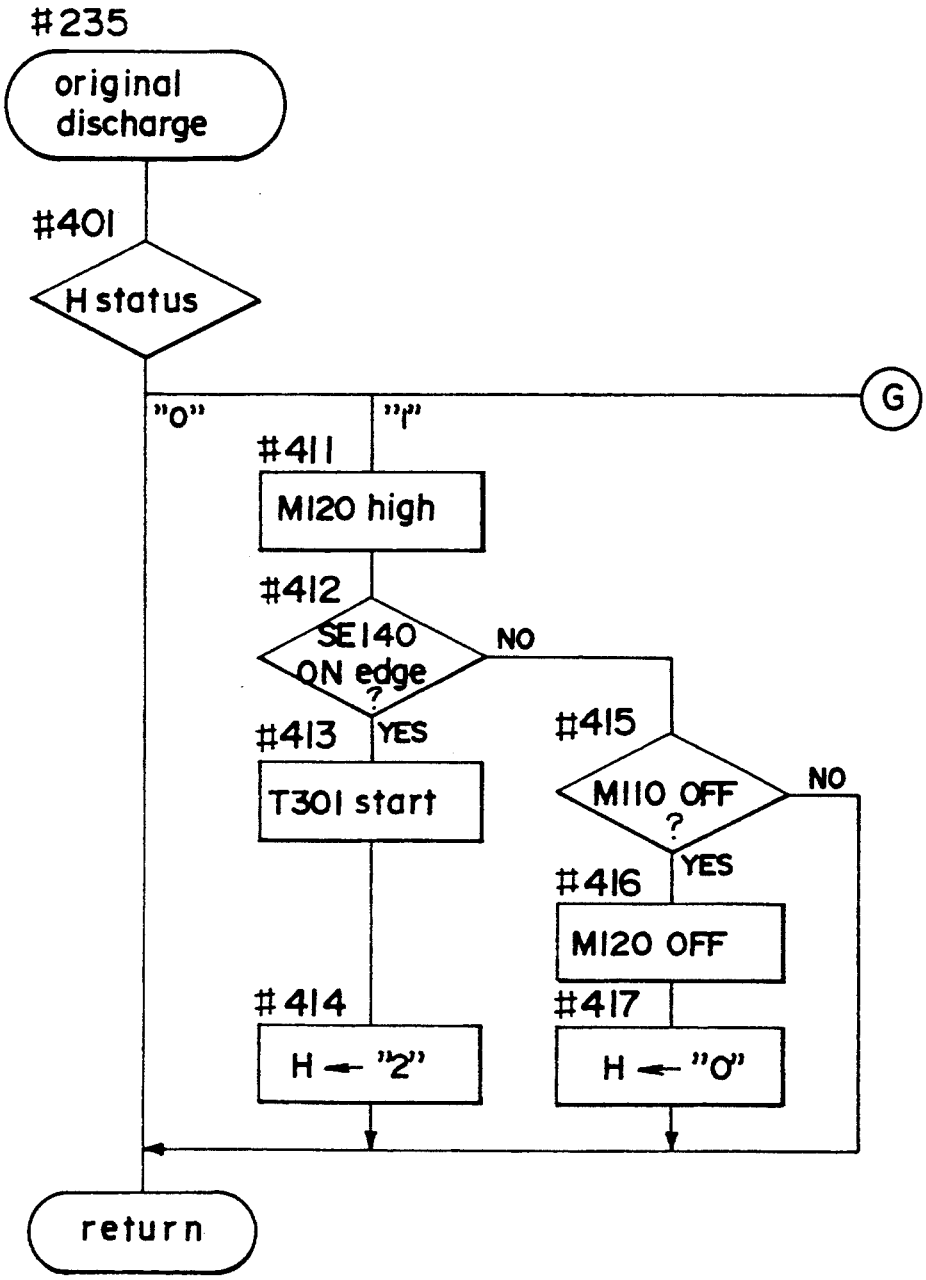
Figure 68:
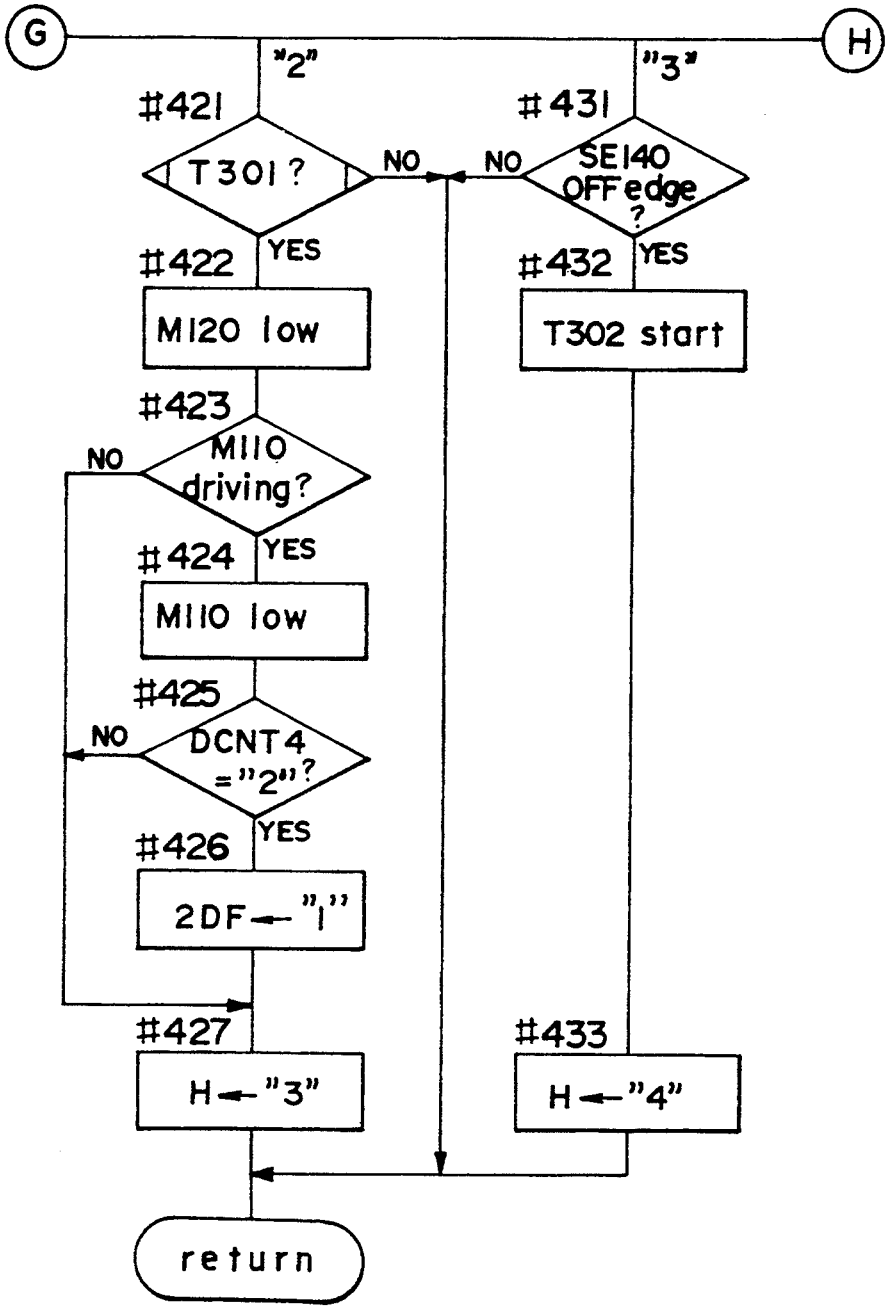
Figure 69:
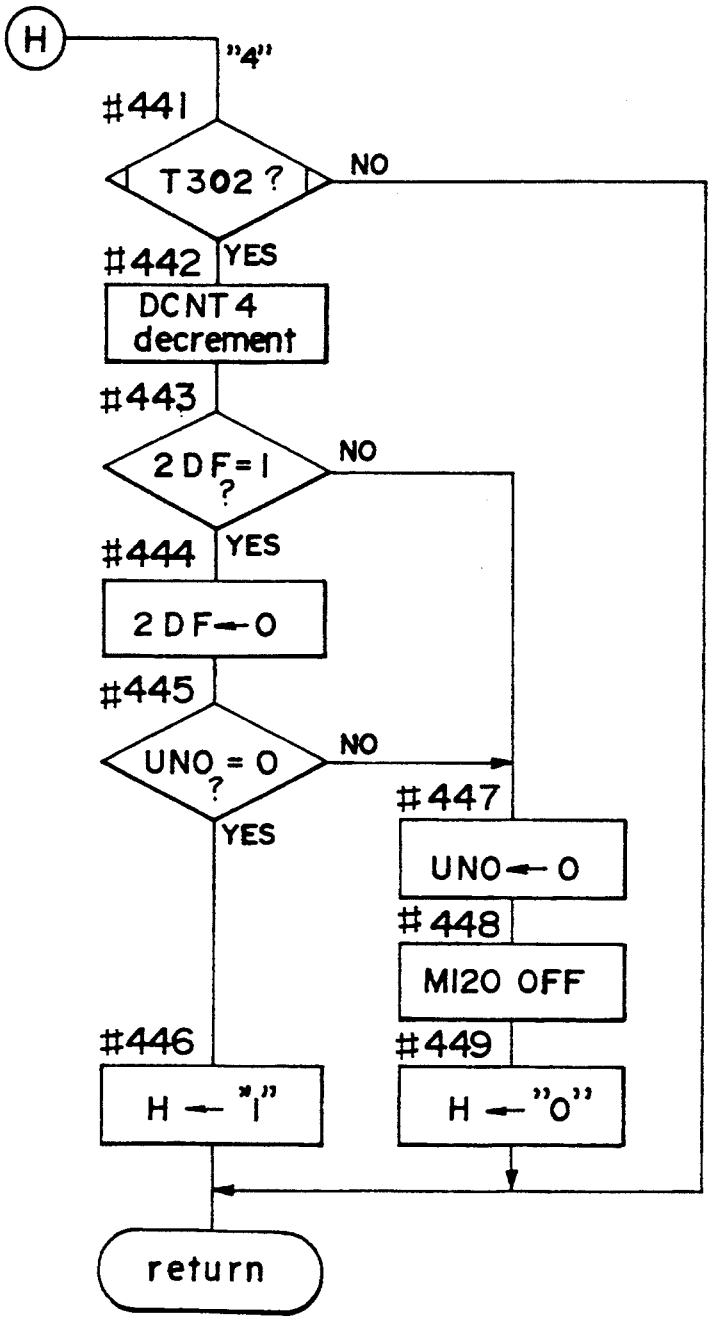

FIGS. 67–69 show the original discharge subroutine executed in step #235.

This subroutine discharges an original to the discharge tray 660 after said original set at the standard position 0 is fed from the platen glass 29 via the transport belt 600.

First, the count value of the H-status is checked in step #401, and subsequent processing is executed in accordance with said value.

When the H-status is "0," the subroutine is immediately terminated.

When the H-status is "1" (refer to steps #327, #386), the discharge motor M120 is turned ON for high speed operation in step #411, and the sensor SE140 is checked in step #412 to ascertain whether or not said sensor is ON edge. If the sensor SE140 is ON edge, i.e., if the leading end of the original has arrived at the detection point of the sensor SE140, the timer T301 is started in step #413, and the H-status is set at "2" in step #414. If, however, the sensor SE140 has not yet detected the leading end of the original, a check is made in step #415 to determine whether or not the main motor is OFF. If the main motor M110 is ON, processing continues with the H-status set at "1." When the main motor M110 is OFF, i.e., when a subsequent original to be read is disposed on the platen glass 29, the H-status is reset at "0" in step #417. When the H-status is "2," the timer T301 is first checked in step #421. The timer T301 determines the timing for switching the discharge motor M120 to high speed operation. The value of the timer T301 is such that the count of the timer ends a set time before the trailing end of the original passes the detection point of the sensor SE140, said value being variable in accordance with the size of the original. After being started, the count and completion state of the timer T301 are checked in step #421. When the count of the timer T301 ends, the discharge motor M120 is switched to low speed operation in step #422. When the main motor M110 is determined to be currently operating in reverse rotation in step #423, i.e., when the originals are of mixed sizes, and the setting of the original sis not yet completed, the main motor M110 is switched to low speed operation (conforming with the discharge speed) in step #424. Then, the DCNT4 is checked in step #425, and if the value is 2, the two original discharge flag is set at 1 in step #426, and the H-status is set at in step #427. On the other hand, if the main motor M110 is not currently reverse rotating, or the DCNT4 is set at a value other than 2, the H-status is set at "3" in step #427 without the process of step #426.

When the H-status is "3," and the OFF edge state of the sensor SE140 is confirmed in step #431, i.e., the trailing end of the original passes the detection point of the sensor SE140, the timer T302 is started in step #432, and the H-status is set at "4" in step #433.

When the H-status is "4," the aforesaid timer T302 is first checked in step #441. The timer T302 determines the timing for turning OFF the discharge motor M120; after being started, the count and completion state of the timer T302 are checked in step #441. When the count of the timer T302 ends, the counter DCNT4 is decremented in step #442, and a check is made in step #443 to determine whether or not the two original discharge flag is set at 1. If the aforesaid flag is set at 1 (refer to steps #376, #426), the two original discharge flag is reset at 0 in step #444, and a check is made in step #445 to ascertain whether or not the last sheet flag UNO is set at 0. If the last sheet flag is reset at 0, i.e., when the read original reaches the discharge portion, the H-status is set at "1" in step #446.

If, however, the two original discharge flag 2DF has been reset at 0 (step #443: NO), or the two original discharge flag 2DF is set at 1 and the last sheet flag UNO is set at 1 (refer to step #457; step #445: NO), i.e., when only one original arrives at the discharge portion, the last sheet flag UNO is reset at 0 in step #447, and the discharge motor M120 is turned OFF in step #448. Then, the H-status is reset at "0" in step #449.

Figure 70:
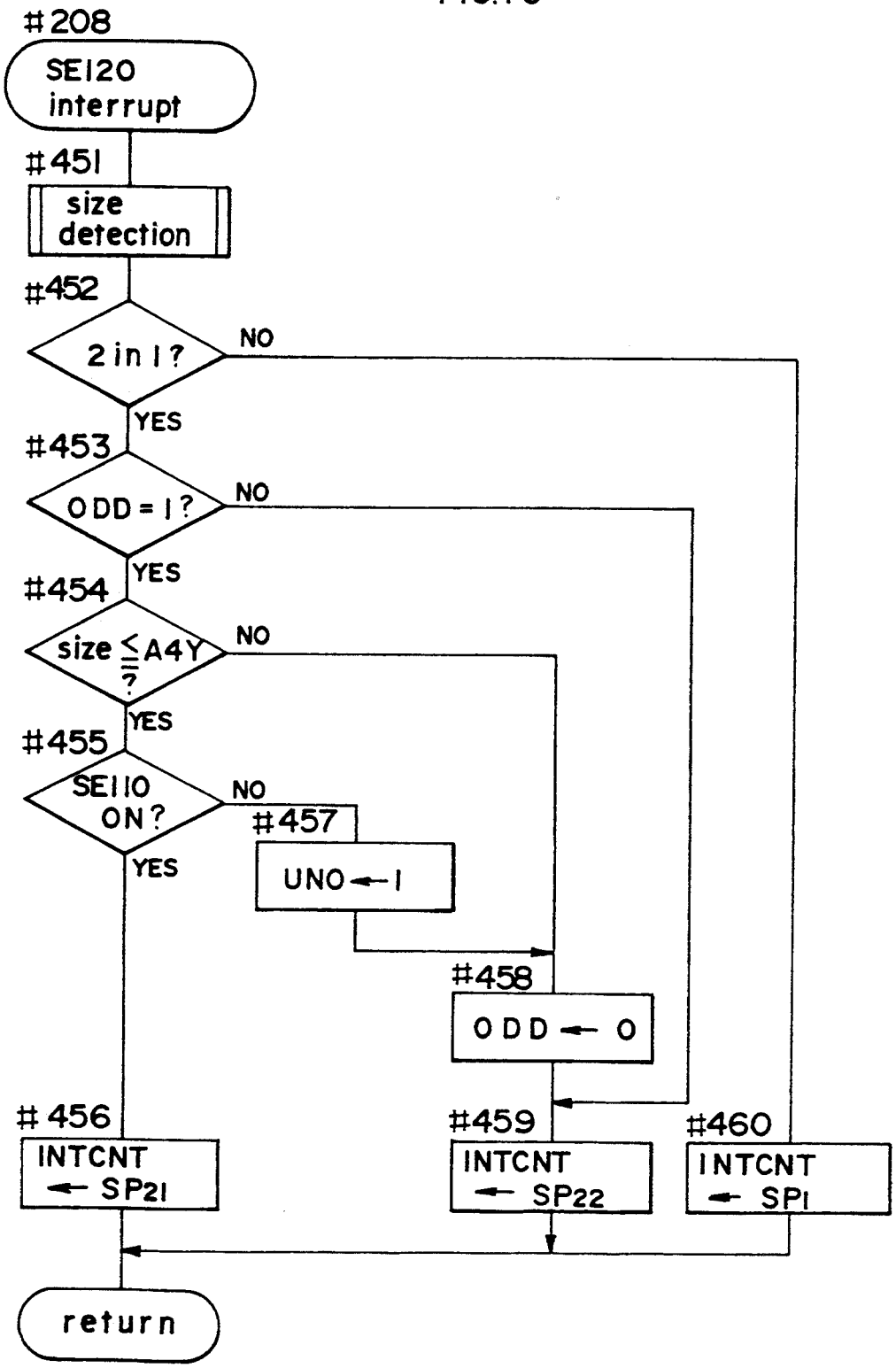

FIG. 70 shows sensor SE120 OFF interrupt subroutine executed in step #208 of the INT1 interrupt process.

This subroutine is an interrupt process triggered by the OFF edge signal of the sensor SE120, and determines the size of the original based on the number of rotation pulses of the main motor M110 input to the EV1, and sets the pulse number for stopping the original at a predetermined position in the EV1 interrupt pulse counter INTCNT.

First, after the size of the original is detected in step #451, the two-in-one mode selection is in step #452. If the two-in-one mode has not been selected, the pulse number $SP_1$ is entered in the EV1 interrupt pulse counter in step #460. The pulse number $SP_1$ is equivalent to the distance of transporting the trailing end of the original from the sensor SE120 detection point to the standard position 0, and is used to set each original at the standard position in the step feed mode.

If, however, the two-in-one mode has been selected, a check is made in step #453 to determine whether or not the odd number flag is set at 1. If the odd number flag is set at 1, a determination is made in step #454 as to whether or not the size of the original is A4Y or less. If the original is A4Y or less, i.e., if an odd numbered original A4Y or less can be processed in the two-in-one mode, a check is made in step #455 to determine whether or not the sensor SE110 is ON. If the sensor SE110 is ON, i.e., if an even numbered original is present, the pulse number $SP_{21}$ is set in the EV1 interrupt pulse counter in step #456. The pulse number $SP_{21}$ is equivalent to the distance of transporting the trailing end of the odd number original from the sensor SE120 detection point to the nip portion of the register rollers 580 and 590, and is used to stop the odd number original immediately after the register rollers 580 and 590 in the two-in-one mode.

If the sensor SE110 is OFF (step #455: NO), the last sheet flag is set at 1 in step #457 and the odd number flag is reset at 0 in step #458 because there is not a next original. The pulse number $SP_{22}$ is then set in the EV1 interrupt pulse counter in step #459. The pulse number $SP_{22}$ is actually the same as the aforesaid pulse number $SP_{21}$, and is used to set the last original at the standard position 0 in the two-in-one mode.

If the size of the original is larger than A4Y, the processes of steps #458 and #459 are executed. In this case, the pulse number $SP_{22}$ set in the EV1 interrupt pulse counter is used to set a only a single odd numbered but larger than A4Y size original at the standard position 0.

When the odd number flag is found to be set at 0 in step #453, i.e., an even numbered original, the process of step #459 is executed. In this case, the pulse number $SP_{22}$ set in the EV1 interrupt pulse counter is used to successively set two originals at the standard position 0. When the value of the EV1 interrupt pulse counter and the pulse number input to the EV1 interrupt pin of the CPU2 are in agreement, the EV1 interrupt process is executed.

Figure 71:
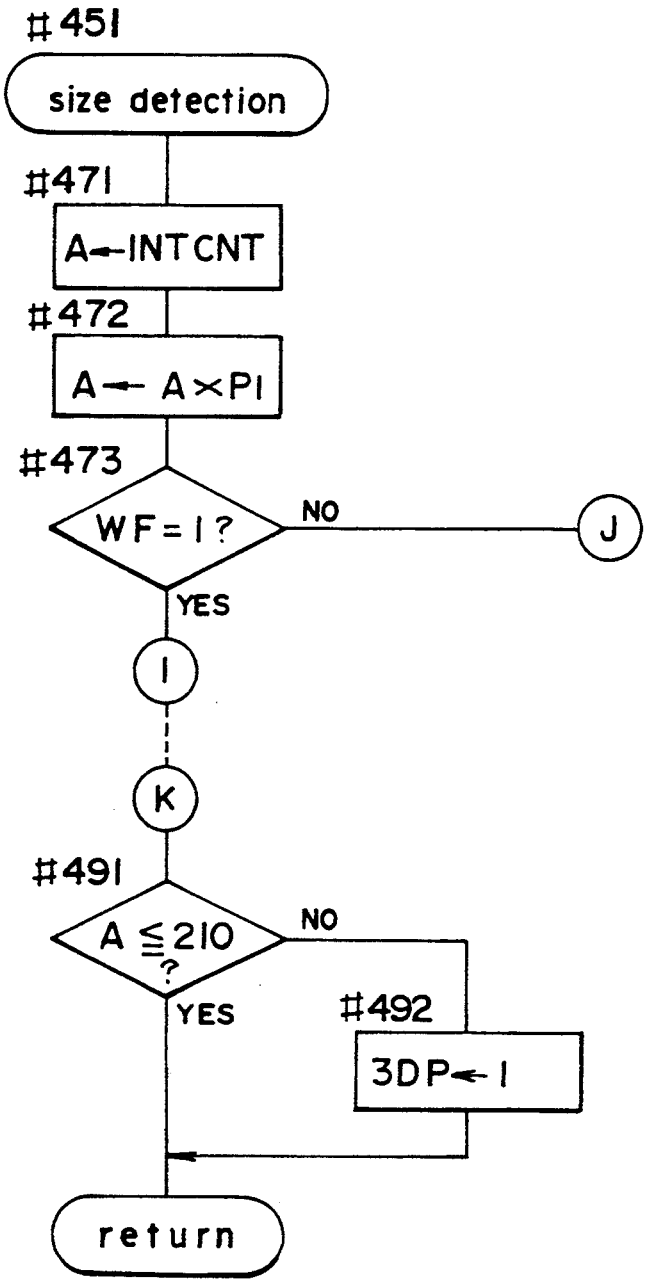
Figure 72:
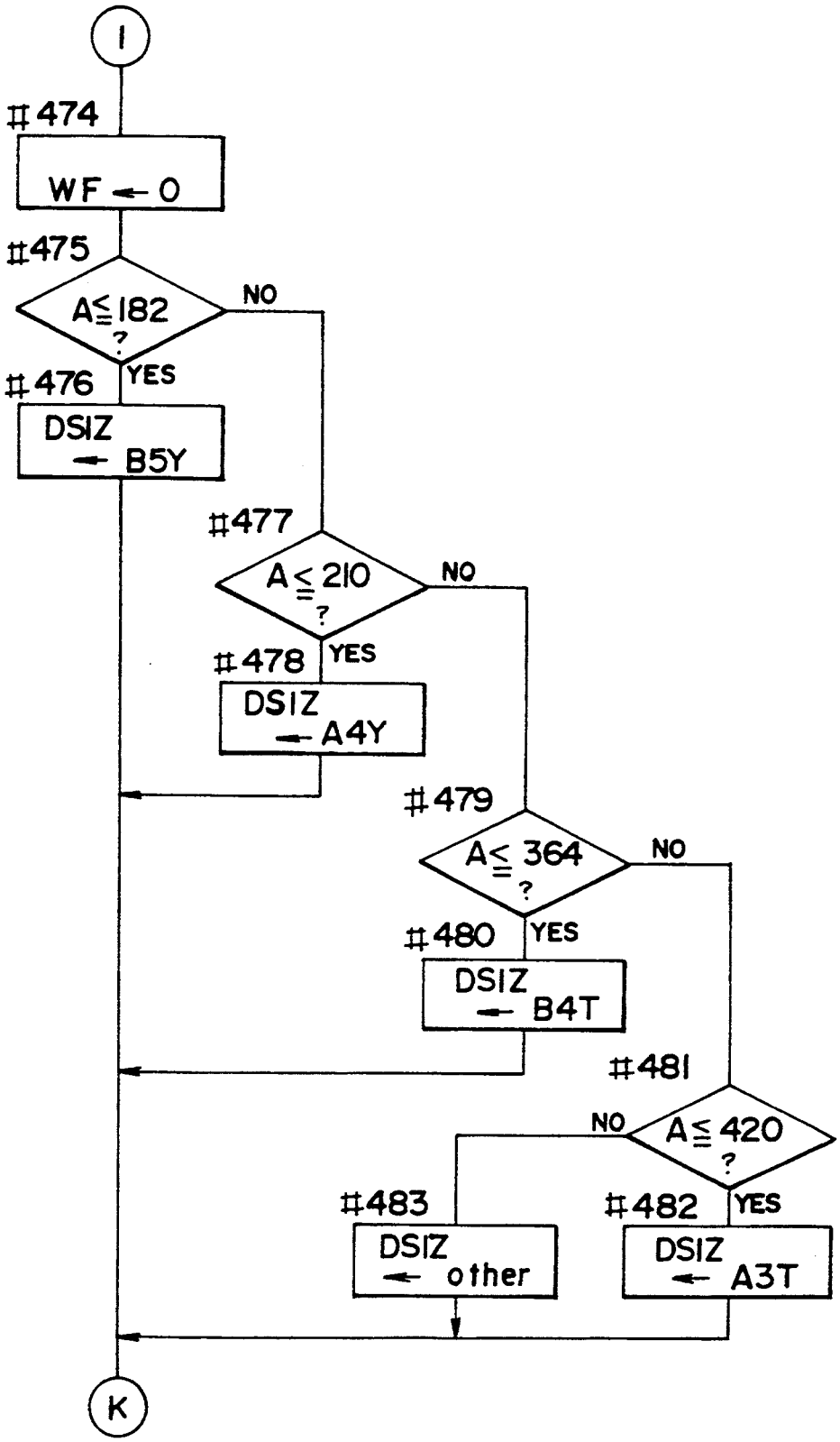
Figure 73:
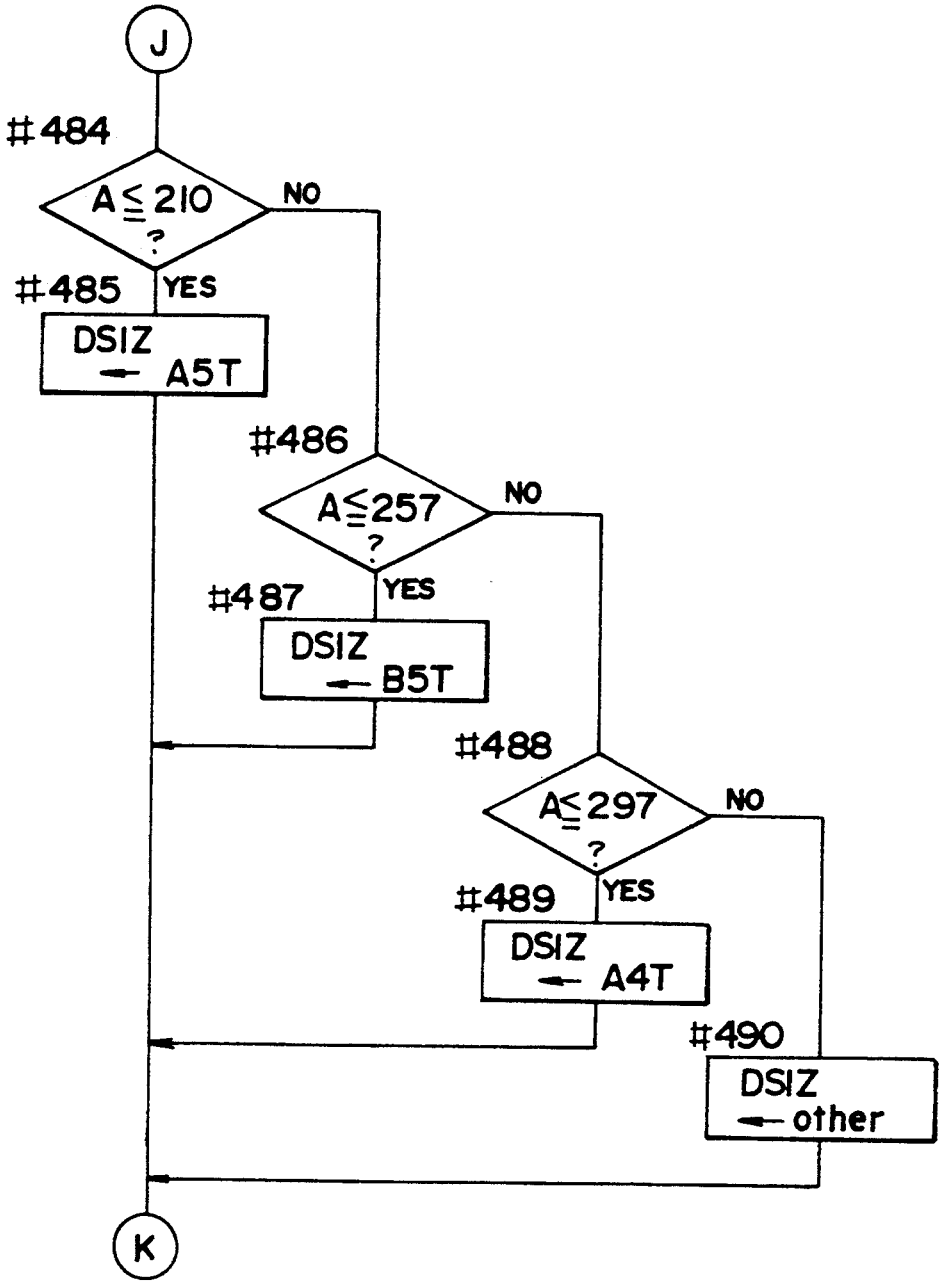

FIGS. 71–73 show the original size detection subroutine executed in step #451.

This subroutine determines the size of the original based on the detection of the width of the original via the ON/OFF switching of the sensor SE130, and the detection of the length of the original via the sensor SE120. The sensor SE130 is positioned so as to detect originals B5Y, A4Y, B4T, and A4T in size, but not detect originals A5T, B5T, A4T in size.

First, the count value of the EV1 is set in the counter A in step #471. Then, the amount of transport $P_1$ per single pulse of the main motor M110 is multiplied by the value in counter A, and the resulting value is entered in counter A in step #472. In this case, $AxP_1$ is equivalent to the length of the original document. Then, a check is made in step #473 to determine whether or not the width flag is set at 1. If the width flag is set at 1 (refer to step #315), the routine continues to steps #474–#483, whereas if the width flag has been reset at 0 (refer to step #316), the routine continues to steps #484–#490, which respectively determine the size of the original.

If the width flag is set at 1, the width flag is reset at 0 in step #474, and a determination is made as to whether or not the length of the original is a specific copy paper size in steps #475, #477, #479, #481. That is, if the counter A value is 182 or less, A5Y is set as the original size in the DSIZ in step #476. If the counter A value is 210 or less, A4Y is set as the original size in the DSIZ in step #478. If the counter A value is 364 or less, B4T is set as the original size in the DSIZ in step #480. If the counter A value is 420 or less, A3T is set as the original size in the DSIZ in step #482. If the counter A value is larger than 420, "other" is set as the original size in the DSIZ in step #483.

If, however, the width flag has been reset at 0, a determination is made as to whether or not the length of the original is a specific copy paper size in steps #484, #486, #488. That is, if the counter A value is 210 or less, A5T is set as the original size in the DSIZ in step #485. If the counter A value is 257 or less, B5T is set as the original size in the DSIZ in step #487. If the counter A value is 297 or less, A4T is set as the original size in the DSIZ in step #489. If the counter A value is larger than 297, "other" is set as the original size in the DSIZ in step #490.

When the aforesaid processes are completed, a check is made in step #491 to determine whether or not the value of counter A is 210 or less. When the counter A value is greater than 210, the third original detection prohibit flag 3DP is set at 1 in step #492.

Figure 74:
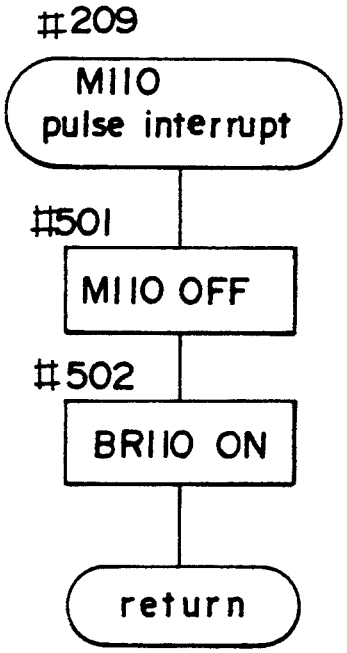

FIG. 74 shows the M110 pulse interrupt subroutine executed in step #209 of the EV1 interrupt process. This process is executed to set the original at the standard position 0, and is described together with the original document transport process.

The automatic document feeder of the present invention is not limited to the previously described embodiment, and may be variously modified within the scope of the invention.

More specifically, the basic construction of the ADF 500 is optional insofar as the arrangement of the document tray 510 and discharge tray 660 may be reversed, and the tray types may be divided by the transport means. Furthermore, the drive force transmission path from the main motor M110 may be variously constructed.

Although the present invention has been described with the preferred embodiment thereof, it is to be noted that various changes and modifications are apparent to those skilled in the art. Such changes and modifications are to be understood as included within the scope of the present invention as defined by the appended claims, unless they depart therefrom.

What is claimed is:

1. A copying apparatus comprising:
a platen glass;
an original document support table which supports a plurality of originals;
original document feed means for feeding a first original, a second original and a third original one by one in this order from the support table along an original document path to said platen glass;
image forming means for forming an image of an original document disposed on the platen glass and transferring the image onto a copy sheet at an image transfer station;
paper storage means for storing a plurality of copy paper;
paper feed means for feeding said copy paper one by one along a copy paper path to the image transfer station;
original document detecting means for detecting the originals in the original document path, said detecting means detects said first original, second original and third original before said first original has been subjected to image formation; and
control means for controlling said paper feed means in response to said original detecting means.

2. The copying apparatus as claimed in claim 1, wherein
said paper feed path is capable of supporting and guiding at least two sheets of copy paper simultaneously.

3. The copying apparatus as claimed in claim 1, wherein
said image forming means continues to operate when the original detecting means fails to detect the third original as long as said detecting means detects the second original.

4. The copy apparatus as claimed in claim 1, further comprising:
copy number input means for inputting a number (N) which represents a copy number corresponding to the number of originals.

5. The copying apparatus as claimed in claim 4, wherein
said paper feed means feeds a first sheet of copy paper in response to the detection of said first original by said detecting means, feeds the $(N+1)^{th}$ sheet of copy paper in response to a detection of said second original by said detecting means, and feeds the $(2N+1)^{th}$ sheet of copy paper in response to a detection of said third original.

6. In a copying apparatus which forms an image of an original document on an exposure station, the method comprising the steps of:
placing a plurality of originals on a support tray;
feeding a first original from the support tray along an original feed path to an exposure station, said original feed path connecting said support tray and said exposure station;
before an image of said first original has been formed, feeding a second original from the support tray along the original feed path to a first preparing position which locates between said support tray and said exposure station and feeding a third original along the original feed path to a second preparing position which locates between said first preparing position and said support tray;
after the image of said first original has been formed, discharging said first original from said exposure station and advancing said second original to the exposure station and said third original to the first preparing station;

detecting the originals in the original feed path; and;

feeding the copy sheets in response to the detection of the originals.

7. The method as claimed in claim 6, further comprising the step of:

after the image of said first original has been formed, feeding a fourth original from the support tray to the second preparing position.

8. In a copying apparatus which forms an image of an original disposed on an exposure station, the method comprising the steps of:

placing a plurality of originals on a support tray;

feeding a first original and second original from the support tray along an original feed path to an exposure station and set them side by side, said original feed path connecting said support tray and said exposure station;

forming an image of the first original on a copy paper; and feeding, before an image of said first original has been formed, a third original from the support tray along the original feed path to a preparing position which locates between said support tray and said exposure station;

after the image of said first original has been formed, discharging said first original from said exposure station, advancing and setting said second original and said third original on the exposure station side by side in order to form an image of the second original and feeding a fourth original from the support tray along the original feed path to said preparing position;

detecting the originals in the original feed path; and feeding copy sheets in response to the detection of the originals.

9. An automatic document feeder which feeds an original document to an exposure platen, comprising:

a document support table which supports a plurality of originals;

a document feed path which connects said document support table and a platen glass;

a document feed device which feeds said originals one by one along said document feed path to a preparing position which locates between the document support table and the platen glass;

a document transport device which transports the original fed to the preparing position to the exposure platen;

a single driving source which is capable of rotating both in a first direction and in a second direction; and a drive mechanism which transmits a drive force of the driving source to the document feed device when the driving source rotates in the first direction and transmits the drive force of the driving source to the document transport device when the driving source rotates in the second direction.

10. The automatic document feeder as claimed in claim 9, further comprising:

a controller which controls said single drive source so as to rotate alternatively in the first direction and in the second direction.

11. The automatic document feeder as claimed in claim 10, further comprising:

a detector which is provided at the preparing position and detects an original fed to the preparing position;

wherein said controller controls said single drive source in response to the detection of the detector.

12. The automatic document feeder as claimed in claim 11, wherein said controller changes the rotating direction of the drive source in response to the detection.

13. In an automatic document feeder which feeds originals on an original support tray to an exposure position along a feed path, a method comprising the steps of:

driving a single drive source in a first direction in order to feed a first original from the original support tray to a preparing position located between the original support tray and the exposure position;

when a leading end of the first original has arrived at the preparing: position, driving the single drive source in a second direction in order to feed the first original from the preparing position to the exposure position; and when said first original has arrived at the exposure position, driving the single drive source in the first direction in order to feed a second original from the support tray to the preparing position.

14. In a copying apparatus which feeds originals placed on an original support tray to an exposure position along a feed path and forms an image of the original fed to the exposure position, the method comprising the steps of:

driving a single drive source in a first direction in order to feed a first original from the original support tray to a preparing position which locates between the original support tray and the exposure position;

when a leading end of the first original has arrived at the preparing position, driving the single drive source in a second direction in order to feed the first original from the preparing position to the exposure position;

forming an image of the first original fed to the exposure position;

during the image formation of the first original, driving the single drive source in a first direction in order to feed a second original from the support tray to the preparing position.

15. The method as claimed in claim 14, further comprising the step of:

after the image formation of the first original, driving the single drive source in the second direction in order to discharge the first original from the exposure position and to feed the second original to the exposure position.

16. A copying apparatus, comprising:

a platen glass;

an original support table which supports a plurality of originals;

an original feed device which feeds a first original, a second original and a third original one by one in this order from the support table along an original path to said platen glass, said original feed device including a pick-up means for picking up said original from the original support table, separation means for separating the originals picked up by said pick-up means and feeding them one by one, registration means for feeding an original fed by said separation means with temporary holding of the original and transport means for transporting an original fed by said registration means along a platen glass, said pick-up means, separation means, and registration means being arranged in this order between said original support table and platen glass;

an image forming device which forms an image of an original disposed on the platen glass and transfers the image onto a copy sheet at an image transfer station;

a paper storage which stores a plurality of copy paper;

a paper feed device which feeds said copy paper one by one along a copy paper path to the image transfer station;

a first detector which is provided between said pick-up means and said separation means and detects the second original when said first original has passed through the first detector;

a second detector which is provided on said original support table and detects the third original when said second original is fed by said separation means to said registration means; and a control device which controls said paper feed device in response to said first detector and said second detector.

17. The copying apparatus as claimed in claim 16, wherein said transporting means is capable of transporting two sheets of originals side by side simultaneously.

18. The copying apparatus as claimed in claim 17, wherein a distance $L_1$ between said registration means and said second detector and a distance $L_2$ between said second detector and said separation means satisfy the following conditions:

$L_1 L_1$ and $L_2 < l_2$, where $l_1$: a maximum size of the originals which said transporting means is capable of simultaneously transporting two at a time;

$l_2$: a minimum size of the originals which said transporting means is capable of simultaneously transporting two at a time.

19. In a copying apparatus which forms an image of an original on an exposure station, a method comprising the steps of:

placing a plurality of originals on a support tray;

feeding a first original from the support tray along an original feed path to an exposure station and setting the first original on an exposing area on the exposure station, said original feed path connecting said support tray and said exposure station;

before an image of said first original has been formed, feeding a second original from the support tray along the original feed path to a preparing position which locates between said support tray and said exposure station;

after the image of said first original has been formed, feeding the first original from the exposure area of the exposure station to a non-exposure area of the exposure station, advancing and setting said second original to the exposure area of the exposure station and feeding a third original from the support tray along the original feed path to the preparing position;

detecting the originals in the original feed path; and feeding copy sheets in response to the detection of the originals.

20. The method as claimed in claim 19, further comprising the step of:

forming an image of said second original which is set on the exposure area of the exposure station;

after the image of said second original has been formed, discharging the first original from the exposure station, feeding the second original from the exposure area to the non-exposure area of the exposure station, advancing and setting said third original to the exposure area of the exposure station and feeding a fourth original from the support tray along the original feed path to the preparing position.

21. In a copying apparatus which forms an image of an original disposed on an exposure station, the method comprising the steps of:

placing a plurality of originals on a support tray;

feeding a first original from the support tray along an original feed path to an exposure station;

forming an image of the first original on a copy sheet;

feeding, before the image of said first original has been formed, a second original from the support tray along the original feed path to a preparing position which locates between said support tray and said exposure station;

advancing said first original and said second original and setting them side by side on the exposure station;

forming an image of the second original on a copy paper;

feeding, before the image of said second original has been formed, a third original from the support tray along the original feed path to the preparing position;

after the image of said second original has been formed, discharging said first original from said exposure station and advancing said second original and said third original and setting said second original and said third original side by side on the exposure station;

detecting the originals in the original feed path; and feeding copy sheets in response to the detection of the originals.

22. In a copying apparatus which forms an image of an original disposed on an exposure station, the method comprising the steps of:

placing a plurality of originals on a support tray;

feeding a first original and a second original from the support tray along an original feed path to the exposure station and setting them on the exposure station side by side, said original feed path connecting said support tray and said exposure station;

forming images of the first and second originals on a single copy paper;

feeding, before images of said first and second originals have been formed, a third original from the support tray along the original feed path to a preparing position located between said support tray and said exposure station;

after the images of said first and second originals have been formed, discharging said first original from said exposure station and feeding the third original from the preparing position along the original feed path to the exposure station;

feeding, before the second original has been discharged from said exposure station, a fourth original from the support tray along the original feed path to the preparing position;

discharging the second original from said exposure station and setting said third original and said fourth original on the exposure station side by side in order to form images of the third and fourth originals on a single copy paper;

detecting the originals in the original feed path; and feeding copy sheets in response to the detection of the originals.

23. The method as claimed in claim 22, further comprising the step of:

before the first original and the second original have been fed to the exposure station, coinciding a leading end of said second original with a trailing end of said first original.

24. An automatic document feeder which feeds an original document to an exposure platen, comprising:

a document support table for supporting a plurality of originals;

a document feed device for feeding a first original, a second original and a third original one by one in this order from said document support table to a preparing position located between the document support table and the exposure platen;

a document transport device for transporting the originals from the preparing position to the exposure platen;

a document discharge device for discharging the originals from the exposure platen to a document discharge table;

first reducing means for reducing a discharging speed of said discharge device before the first original has been discharged; and second reducing means for reducing a transporting speed of said transport device when the discharging speed of said discharge device is reduced and the third original is transported by the transport device.

* * * * *